US011920886B2

(12) United States Patent
Ruck et al.

(10) Patent No.: US 11,920,886 B2
(45) Date of Patent: Mar. 5, 2024

(54) CASED TELESCOPED WEAPON ACTION FEEDING FROM A MAGAZINE

(71) Applicant: Textron Systems Corporation, Hunt Valley, MD (US)

(72) Inventors: Joshua Stephen Ruck, Baltimore, MD (US); Brandon Scott Recchia, Parkton, MD (US); Bradford Timothy Jones, Baltimore, MD (US); Benjamin Tyler Cole, Baltimore, MD (US); Petro Romanovych Khoma, Bel Air, MD (US); Mark Timothy Fellows, Towson, MD (US); Madeline Claire Spurlock, Baltimore, MD (US)

(73) Assignee: Textron Systems Corporation, Hunt Valley, MD (US)

( * ) Notice: Subject to any disclaimer, the term of this patent is extended or adjusted under 35 U.S.C. 154(b) by 0 days.

(21) Appl. No.: 17/668,126

(22) Filed: Feb. 9, 2022

(65) Prior Publication Data

US 2023/0035677 A1 Feb. 2, 2023

Related U.S. Application Data

(60) Provisional application No. 63/148,019, filed on Feb. 10, 2021.

(51) Int. Cl.

| | |
|---|---|
| ***F41A 9/45*** | (2006.01) |
| ***F41A 3/10*** | (2006.01) |
| *F41A 15/10* | (2006.01) |

(52) U.S. Cl.

CPC ..... *F41A 9/45* (2013.01); *F41A 3/10* (2013.01); *F41A 15/10* (2013.01)

(58) Field of Classification Search

CPC ..... F41A 9/45; F41A 3/10; F41A 15/10

(Continued)

(56) References Cited

U.S. PATENT DOCUMENTS

| | | | |
|---|---|---|---|
| 2,397,963 | A | 4/1946 | Harvey |
| 3,114,290 | A | 12/1963 | Harvey et al. |

(Continued)

FOREIGN PATENT DOCUMENTS

| | | |
|---|---|---|
| DE | 9200505 | 4/1992 |
| DE | 9201632 | 4/1992 |

(Continued)

OTHER PUBLICATIONS

"ARES-Olin AIWS", Gun Wiki, Random powered by Wikia, Year designed: 1987, article accessed Jul. 31, 2018, 4 pages.

*Primary Examiner* — Bret Hayes
(74) *Attorney, Agent, or Firm* — BainwoodHuang

(57) ABSTRACT

A weapon is capable of firing cased telescoped (CT) ammunition rounds. The weapon includes a barrel, a chamber member that defines a chamber configured to hold a CT round for firing from the weapon, a non-rotating carrier body, and linkage. The linkage is constructed and arranged to move the chamber member (i) from a firing position in which the chamber member is aligned with the barrel for firing the CT round to an ejection/loading position in which the chamber member is not aligned with the barrel for ejecting a spent CT round and receiving a next CT round in response to the non-rotating carrier body moving away from the barrel, and (ii) from the ejection/loading position to the firing position in response to the non-rotating carrier body moving toward the barrel.

13 Claims, 68 Drawing Sheets

(58) Field of Classification Search
USPC ..... 42/15; 89/155, 156
See application file for complete search history.

(56) References Cited

U.S. PATENT DOCUMENTS

| | | | | |
|---|---|---|---|---|
| 3,198,076 | A | 8/1965 | Stoner | |
| 3,345,770 | A | 10/1967 | Scanlon, Jr. | |
| 3,474,560 | A * | 10/1969 | Ramsay | F41A 9/23 42/15 |
| 3,667,147 | A | 6/1972 | Goldin et al. | |
| 3,736,839 | A | 6/1973 | Childers | |
| 3,738,223 | A | 6/1973 | Post et al. | |
| 3,738,224 | A | 6/1973 | Post et al. | |
| 4,265,043 | A | 5/1981 | Rowlands | |
| 4,487,103 | A | 12/1984 | Atchisson | |
| 4,791,851 | A * | 12/1988 | Stoner | F41A 9/42 89/33.03 |
| 4,872,391 | A | 10/1989 | Stoner | |
| 4,895,064 | A | 1/1990 | Marzocco | |
| 4,942,802 | A | 7/1990 | Stoner | |
| 5,117,735 | A | 6/1992 | Flashkes | |
| 5,447,092 | A | 9/1995 | Dobbins | |
| 6,634,274 | B1 | 10/2003 | Herring | |
| 6,637,310 | B2 | 10/2003 | Borgwarth | |
| 6,761,102 | B2 | 7/2004 | Giza | |
| 6,898,888 | B2 | 5/2005 | Greenhut | |
| 7,137,217 | B2 | 11/2006 | Olson et al. | |
| 7,526,991 | B2 | 5/2009 | Steimke et al. | |
| 7,596,900 | B2 | 10/2009 | Robinson et al. | |
| 7,717,024 | B2 | 5/2010 | Steimke et al. | |
| 7,849,777 | B1 | 12/2010 | Zedrosser | |
| 7,886,470 | B1 | 2/2011 | Doiron | |
| 8,136,440 | B1 | 3/2012 | Shirts et al. | |
| 8,776,419 | B2 | 7/2014 | Obermeit | |
| 8,807,039 | B2 | 8/2014 | Carpenter et al. | |
| 8,869,672 | B2 | 10/2014 | Smith | |
| 8,875,433 | B2 | 11/2014 | Beckman | |
| 8,919,238 | B2 | 12/2014 | Steimke et al. | |
| 9,267,772 | B2 | 2/2016 | Carpenter et al. | |
| 9,429,379 | B2 | 8/2016 | Fellows | |
| 9,488,425 | B2 | 11/2016 | Delury et al. | |
| 9,638,484 | B1 | 5/2017 | Friend | |
| 9,879,931 | B2 | 1/2018 | Patel | |
| 10,180,296 | B2 | 1/2019 | Polston | |
| 10,584,928 | B2 | 3/2020 | Shipley et al. | |
| 10,591,241 | B2 | 3/2020 | Schneider | |
| 10,641,561 | B2 | 5/2020 | Shipley et al. | |
| 10,941,994 | B2 | 3/2021 | Shipley et al. | |
| 11,268,774 | B1 | 3/2022 | Landies, III et al. | |
| 2005/0262750 | A1 | 12/2005 | Olson et al. | |
| 2016/0033226 | A1 | 2/2016 | Potter et al. | |
| 2017/0328689 | A1 | 11/2017 | Dindl | |
| 2017/0328690 | A1 | 11/2017 | Dindl | |
| 2018/0066925 | A1 | 3/2018 | Skowron et al. | |
| 2022/0341689 | A1 | 10/2022 | Ayotte et al. | |
| 2023/0035677 | A1 | 2/2023 | Ruck et al. | |

FOREIGN PATENT DOCUMENTS

| | | |
|---|---|---|
| EP | 3397916 | 11/2018 |
| RU | 2201573 | 3/2003 |
| RU | 2717112 | 3/2020 |
| WO | 2017197415 | 11/2017 |

* cited by examiner

1. Battery
Slide Position at
Cartridge ignition

2. Recoil Stroke
a. Chamber Indexed; Rammer
Spring Cocked; then
Released by Chamber Cam b. Rammer Stroke:
Cartridge stripped
from magazine c. Max Travel
2 inch overtravel provided
To reduce felt recoil

CASED TELESCOPED WEAPON ACTION FEEDING FROM A MAGAZINE

STATEMENT OF GOVERNMENT RIGHTS

The invention was made with government support under W15QKN-19-9-1025 awarded by the US Army. The government has certain rights in the invention.

CROSS REFERENCE TO RELATED APPLICATIONS

This is a regular utility patent application based on U.S. Application No. 63/148,019, filed on Feb. 10, 2021, and entitled "Cased Telescoped Weapon Action Feeding from a Magazine", the contents and teachings of which are hereby incorporated by reference in their entirety.

BACKGROUND

The present invention is related to the field of firearms, and in particular to firearms such as carbines firing cased telescoped (CT) ammunition.

As it is generally known, most traditional firearm ammunition cartridges are constructed using a metal shell casing (e.g. a brass casing). The metal casing of a traditional cartridge typically contains some amount of propellant (e.g. gunpowder, smokeless powder, etc.) in a rearward portion of the cartridge that is sometimes referred to as the cartridge "body". The metal casing of a traditional casing also holds a projectile in a frontward portion of the cartridge that is sometimes referred to as the cartridge "neck". Traditional metal cartridge cases typically have a tapered shape, in which a relatively wider diameter body steps down to a relatively smaller diameter neck. When a traditional metal case cartridge is fired, the propellant contained in the metal casing is ignited. Gases resulting from the burning of the propellant pressurize and expand the metal casing against the wall of the chamber, and push against the base of the brass casing, causing the projectile to be expelled from the front of the cartridge and through the barrel of the firearm.

In contrast to traditional metal case cartridges, cased telescoped (CT) ammunition cartridges completely encase the propellant and the projectile within a cylindrical shell that is made of polymer. By eliminating the relatively heavy metal casing used in traditional metal case ammunition, CT ammunition provides a significant reduction in ammunition weight, enabling relatively larger numbers of rounds to be carried per unit weight, e.g. by infantry soldiers.

SUMMARY

A weapon for firing cased telescoped (CT) ammunition is disclosed, the weapon including a barrel, a chamber member and a carrier assembly. The chamber member defines a chamber for a CT round for firing, and translates between a firing position aligned with the barrel and an ejection/loading position. The carrier assembly carries the firing pin and (1) performs a recoil in which a carrier and rammer move rearward from a battery position to bring the next CT round into a ramming position and to move the chamber member from the firing position to the ejection/loading position, and (2) performs a counter-recoil to return to the battery position and cause the rammer to push the next CT round into the chamber.

In accordance with certain embodiments, a weapon for firing CT ammunition rounds includes a barrel, a chamber member that defines a chamber configured to hold a CT round for firing from the weapon, a carrier body, and linkage. The linkage is constructed and arranged to move the chamber member (i) from a firing position in which the chamber member is aligned with the barrel for firing the CT round to an ejection/loading position in which the chamber member is not aligned with the barrel for ejecting a spent CT round and receiving a next CT round in response to the carrier body moving away from the barrel, and (ii) from the ejection/loading position to the firing position in response to the carrier body moving toward the barrel.

Another embodiment is directed to a method of operating a weapon for firing CT ammunition rounds. The method includes moving a chamber member, which defines a chamber configured to hold a CT round for firing from the weapon, from a firing position in which the chamber member is aligned with a barrel of the weapon to an ejection/loading position of the weapon in which the chamber member is not aligned with the barrel. The method further includes, after the chamber reaches the ejection/loading position, moving the chamber member from the ejection/loading position to the firing position in response to a carrier body moving toward the barrel, ejecting a spent CT round, and receiving a next CT round in response to the carrier body of the weapon moving away from the barrel.

Another embodiment is directed to a method of operating a weapon for firing CT ammunition rounds. The method includes (A) moving (e.g., via linkage) a chamber member, which defines a chamber configured to hold a CT round for firing from the weapon, from a firing position in which the chamber member is aligned with a barrel of the weapon to an ejection/loading position of the weapon in which the chamber member is not aligned with the barrel;

(B) while the barrel is in the ejection/loading position, ejecting a spent CT round and receiving a next CT round in response to a carrier body of the weapon moving away from the barrel; and (C) moving (e.g., via the linkage) the chamber member from the ejection/loading position to the firing position in response to the carrier body moving toward the barrel.

In some arrangements, the linkage includes a linkage body that pushes the chamber member from the firing position into the ejection/loading position in response to movement of the carrier body moving in a recoil direction away from the barrel and pushes the chamber member from the ejection/loading position into the firing position in response to movement of the carrier body moving in a counter-recoil direction toward the barrel. The recoil direction is opposite the counter-recoil direction along a carrier body travel axis.

In some arrangements, the linkage includes a chamber carrier. The chamber member is retained by the chamber carrier and moves along a vertical axis that is perpendicular to the carrier body travel axis.

In some arrangements, the carrier body maintains constant mechanical communication with the chamber carrier to enable the carrier body to provide full mechanical control over positioning the chamber member between the firing position and the ejection/loading position (e.g., via the linkage body and the chamber carrier).

In some arrangements, the carrier body is constructed and arranged to impart counter-recoil force on the linkage body when the carrier body moves in the counter-recoil direction. Additionally, the linkage body is constructed and arranged to translate the counter-recoil force into an upward force on the chamber carrier to raise the chamber member from the ejection/loading position into the firing position.

In some arrangements, the linkage body mates with the chamber carrier and the carrier body via respective friction connections to enable each of the carrier body, the linkage body and the chamber carrier to move together.

In some arrangements, the weapon further includes a lower receiver that receives at least a portion of the linkage. The lower receiver has a magazine well that is constructed and arranged to interface with a magazine that vertically stores CT rounds and feeds the CT rounds into the lower receiver through the magazine well.

In some arrangements, the weapon further includes an upper receiver that houses the carrier body. The upper receiver couples with the lower receiver at a top of the lower receiver. The magazine well resides at a bottom of the lower receiver.

In some arrangements, the weapon further includes an upper receiver that houses the carrier body. The upper receiver prevents the carrier body from rotating within the weapon.

In some arrangements, the weapon further includes a disconnecting rammer coupled with the carrier body. The disconnecting rammer is constructed and arranged to push the next CT round fed from the magazine into the chamber member and disconnect from the carrier body while the carrier body moves in the counter-recoil direction.

In some arrangements, the weapon further includes a trigger group coupled with the lower receiver. The trigger group is constructed and arranged to initiate closed bolt firing action.

In some arrangements, the carrier body is non-rotating when moving within the weapon. In some arrangements, the carrier body is non-rotating when moving relative to the barrel, the chamber member, and the linkage.

Other embodiments are directed to apparatus, devices, assemblies, and so on. Some embodiments are directed to various methods, systems, and componentry which are involved in utilizing cased telescoped weapon action feeding from a magazine.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DETAILED DESCRIPTION

Figure 1:
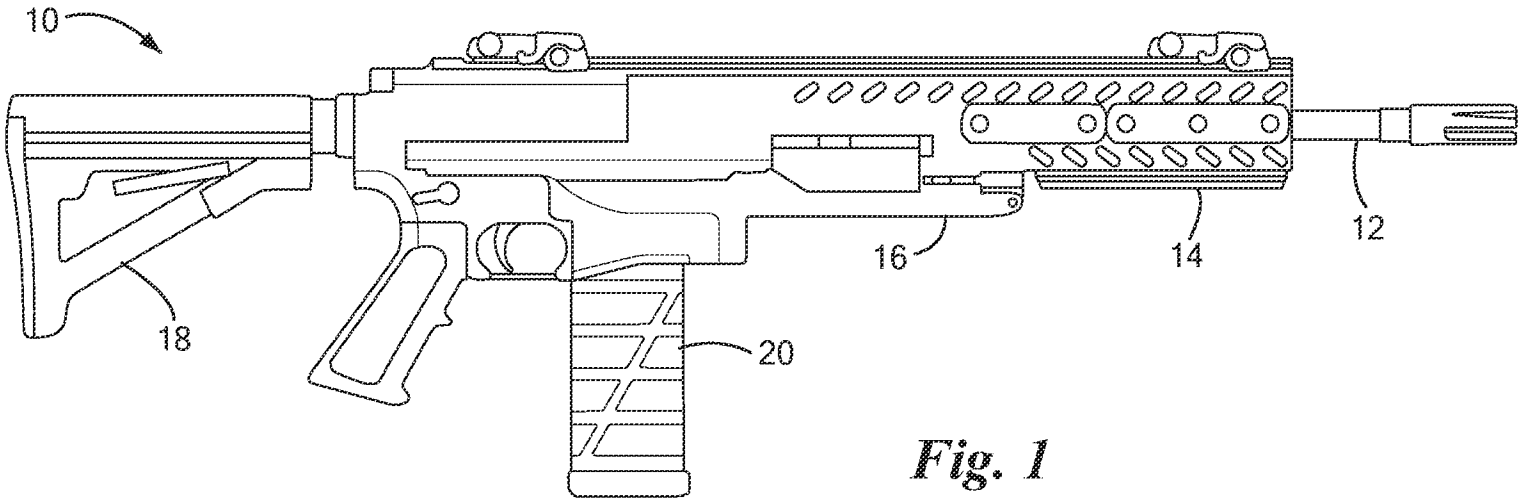
FIG. 1 is a side elevation view of a carbine.
Figure 2:
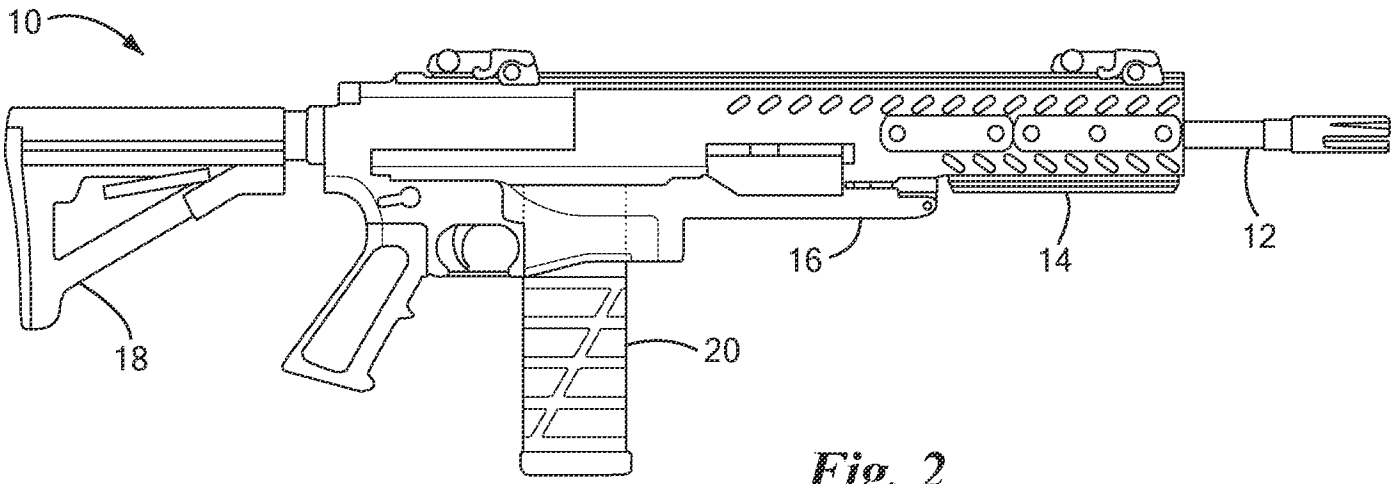
FIG. 2 is a side elevation view of a carbine with internal structure revealed.
Figure 3:
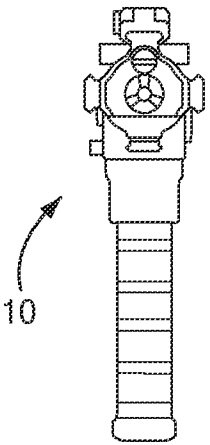
FIG. 3 is a front elevation view of a carbine.

FIGS. 1-3 show a carbine 10 according to one embodiment. FIG. 1 is a fully exterior view in which the following major components are visible:

Barrel 12
Upper receiver 14
Lower receiver 16
Buttstock 18
Magazine 20

FIG. 2 shows a view of the carbine 10 similar to that of FIG. 1.

FIG. 3 is a front elevation view of the carbine 10.

Figure 4:
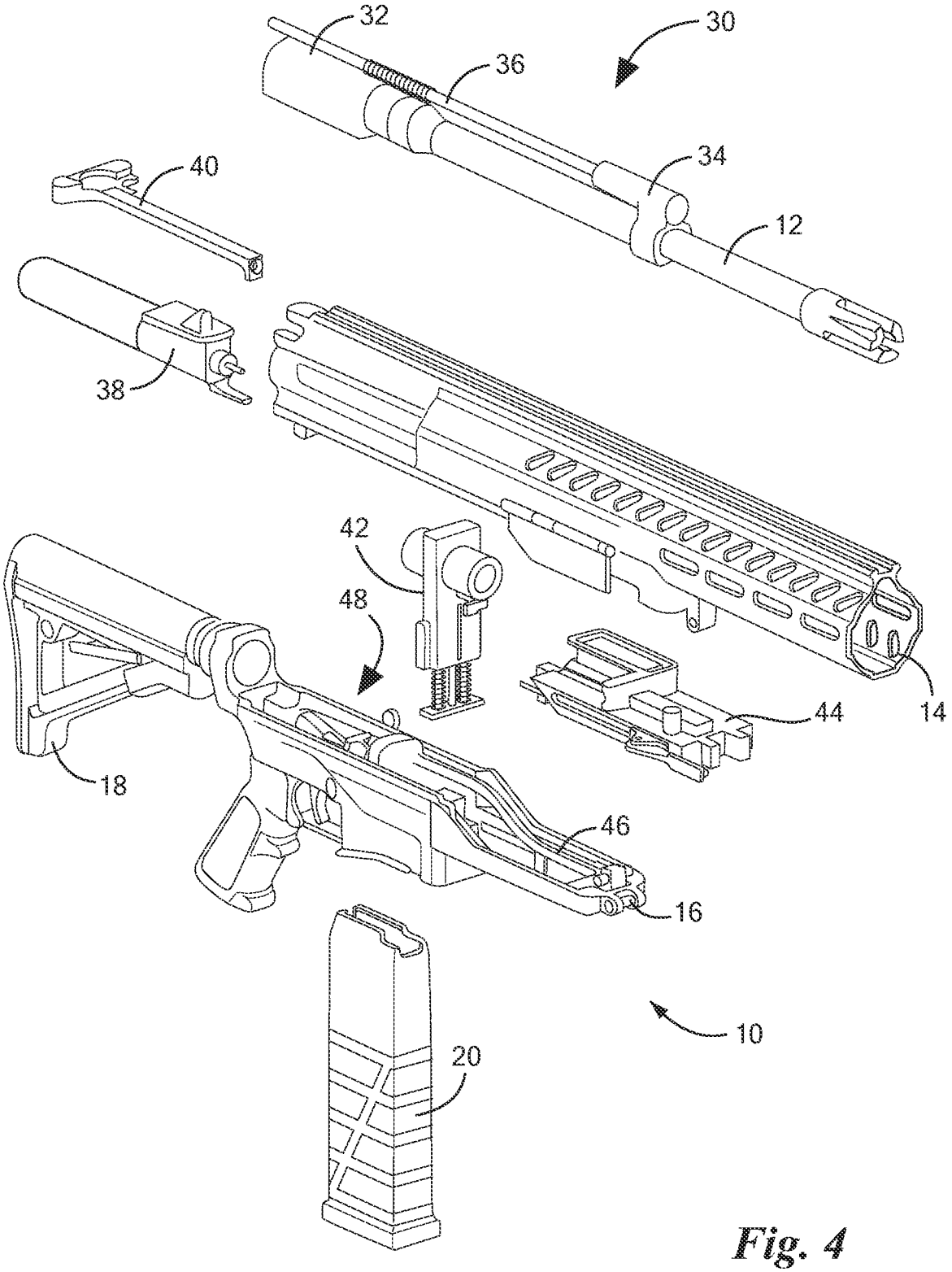
FIG. 4 is a perspective exploded view of a carbine.

FIG. 4 is an exploded view of the carbine 10 showing additional details. The barrel 10 is part of a barrel assembly 30 also including a barrel extension 32, gas block 34, and gas piston 36. The upper receiver 14 houses a carrier assembly 38 and a charging handle 40. The lower receiver 16 houses a chamber assembly 42, ejector assembly 44, slide 46 and trigger group 48, and includes a magazine well (e.g., which may be downward-facing) for receiving the magazine 20. The lower receiver 16 is also attached to the buttstock 18, which includes an internal buffer and drive spring of the type generally known in the art.

FIGS. 5-20 show more detailed arrangement and structural detail of the components of the carbine 10.

Figure 5:
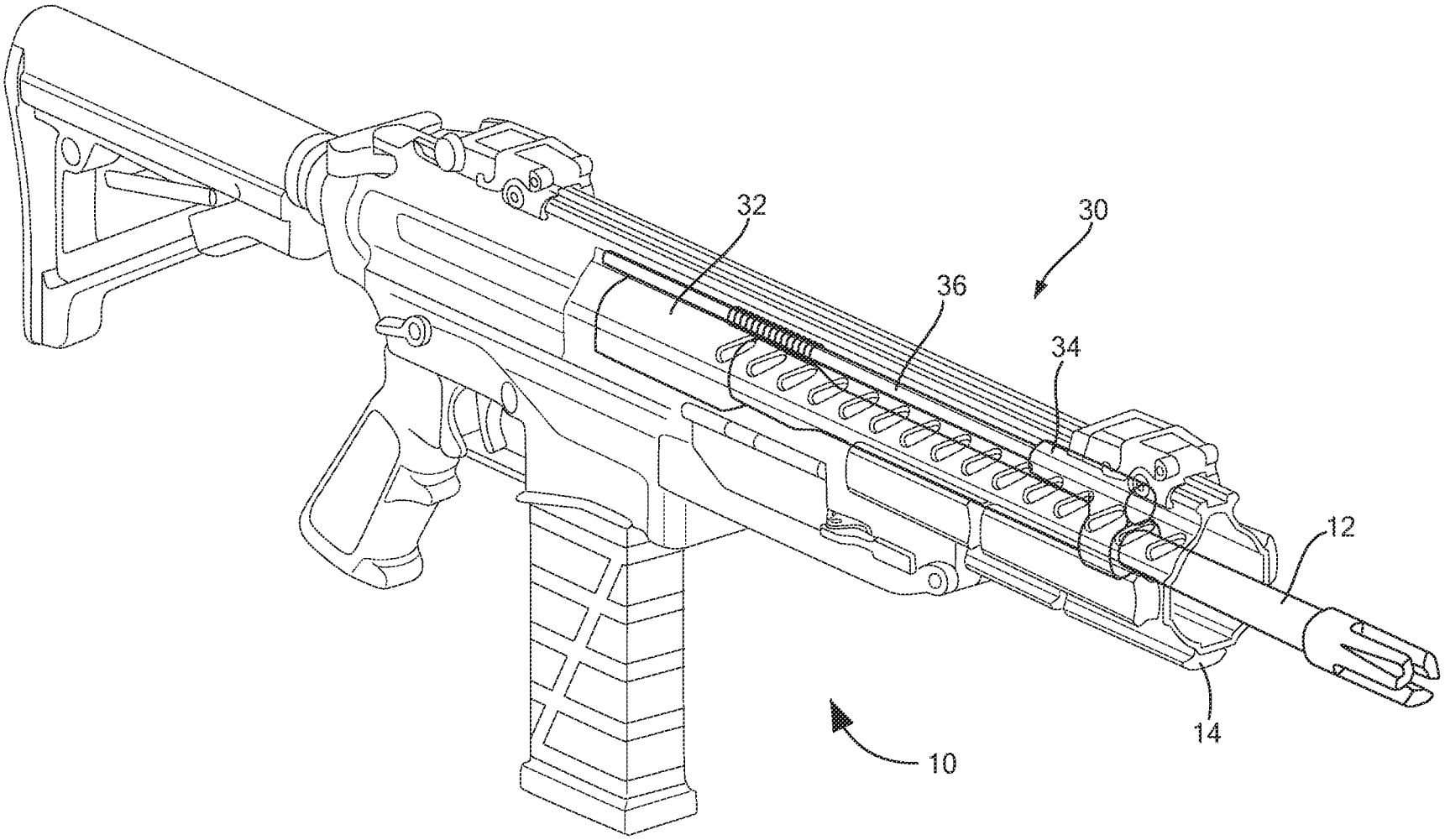
FIG. 5 is a perspective view of a carbine highlighting a barrel group.

FIG. 5 shows the barrel assembly 30 in place within the carbine 10, specifically within the upper receiver 14. The barrel extension 32 and barrel 12 are machined steel components connected. In one embodiment, a rear end of the barrel 12 is screwed into a forward end of the barrel extension 32, and chordal pins (which may not be required in certain arrangements) are used to inhibit any loosening of the screw attachment during operation. FIG. 5 also shows the gas block 34 and gas piston 36.

Figure 6:
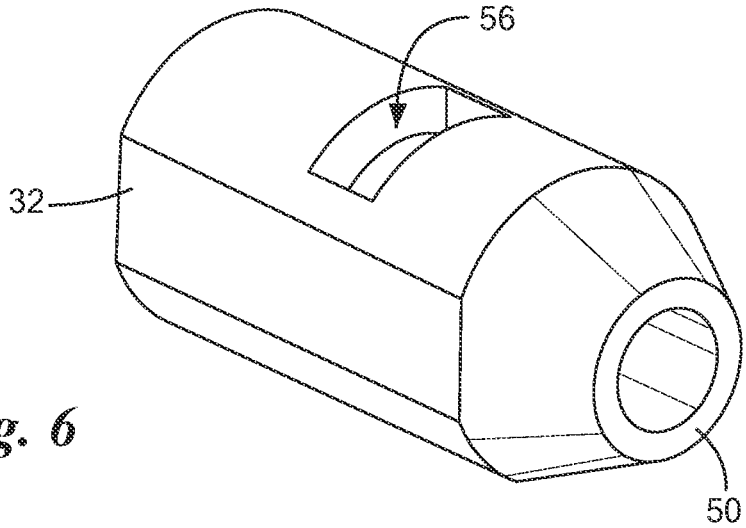
FIGS. 6-8 are views of a barrel extension.
Figure 7:
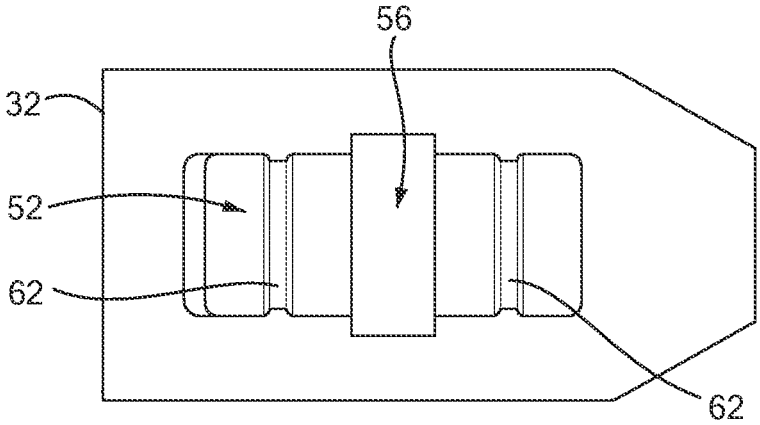
Figure 8:
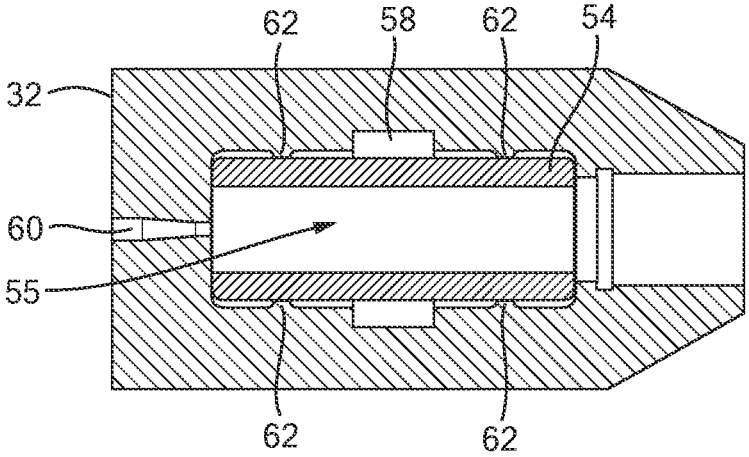

FIGS. 6-8 shows details of the barrel extension 32. In the illustrated embodiment it has an elongated shape, which may be roughly cylindrical, that is open along its bottom. A front circular face 50 mates with a corresponding surface of the barrel 12 (FIG. 5). The roughly cylindrical shape defines an interior chamber cavity 52 for receiving a cylindrical chamber member 54, as shown in the cutaway view of FIG. 8 and described more below. The chamber member 54 defines a cylindrical firing chamber 55, which is also referred to as simply the "chamber" herein. The barrel extension 32 also has a rectangular opening 56 to allow passage of an upper part of a chamber carrier 58 that holds the chamber member 54, as also described more below. Also shown in FIG. 8 is a conical firing pin opening 60 for receiving a firing pin carried by the carrier assembly 38 (FIG. 5). As seen in FIGS. 7-8, the interior surface of the barrel extension 32 includes machined ribs 62 whose function is to hold the chamber member 54 in a position of precise alignment with the barrel 12, specifically to align the cylindrical chamber 55 with the bore of the barrel 12 to ensure that a fired round enters the barrel 12 smoothly and in alignment with the barrel axis. Additional details regarding functions of the barrel extension 32 are provided below.

Figure 9:
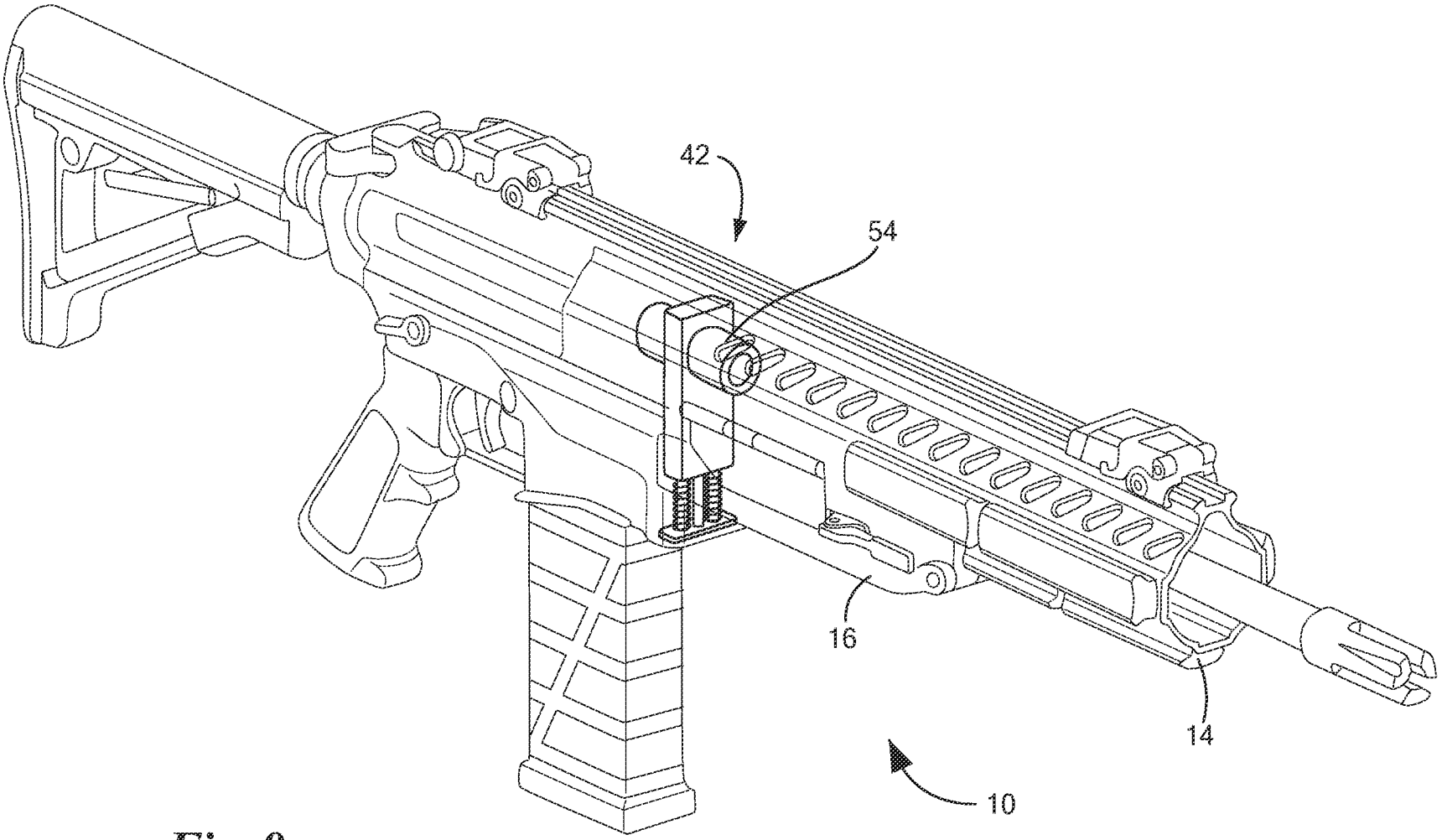
FIG. 9 is a perspective view of a carbine highlighting a chamber carrier assembly.

FIG. 9 shows the chamber assembly 42 in place within the carbine 10. The chamber assembly 42 rests within the lower receiver 16, with an upper portion including the chamber member 54 extending upwardly into the barrel extension 32 (not shown) within the upper receiver 14.

Figure 10:
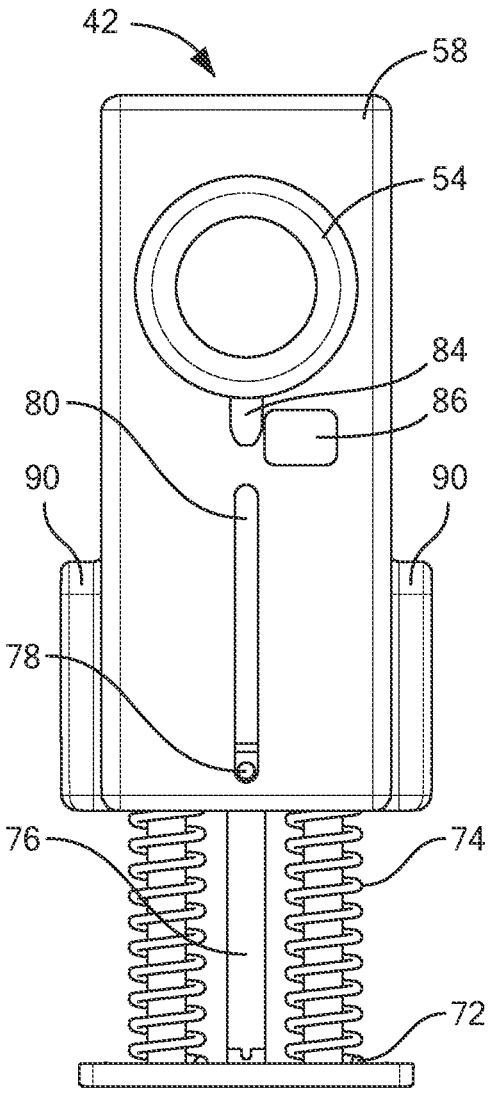
FIGS. 10-12 are views of the chamber carrier assembly and components thereof.
Figure 11:
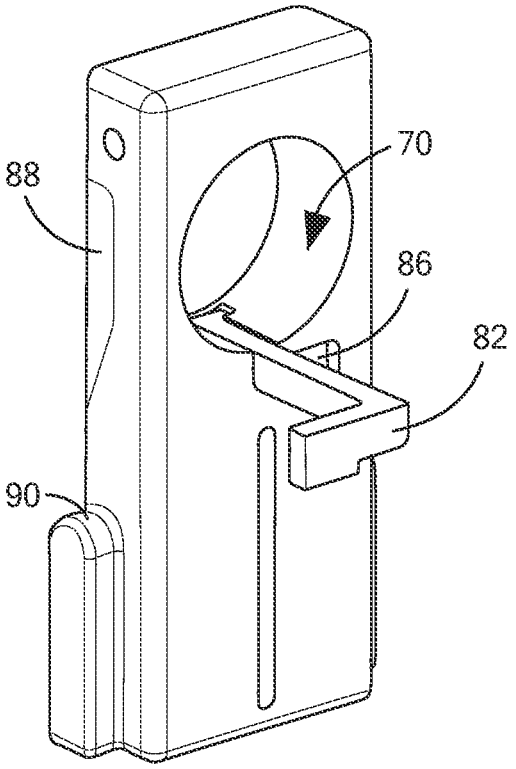
Figure 12:
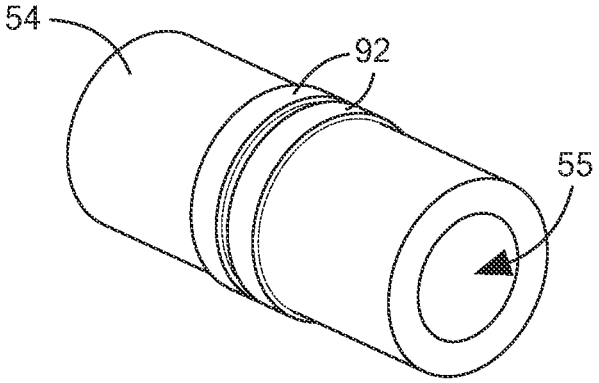

FIGS. 10-12 show additional detail of the chamber assembly 42. The chamber member 54 is retained within a circular bore 70 of the rectangular-shaped chamber carrier 58. The assembly is anchored within the lower receiver 16 by a base plate 72, coupled to the chamber carrier 58 by springs 74 and a spring retention rod 76 whose upper end 78 is captured in a spring retention slot 80 of the chamber carrier 58. The springs 74 bias the chamber carrier 58 upwardly, providing for movement of the chamber member 54 into a firing position at a certain point in the firing cycle as described more below. A front round stop 82 resides within a keyway 84 at the bottom of the bore 70. The chamber carrier 58 also includes a chamber carrier catch cutout 86, a sear link cam indentation 88 providing camming for a separate sear link (not shown), and slide cam shoulders 90 that engage the slide 46 (FIG. 4) for counter-bias downward movement of the chamber carrier 58 into an ejection/loading position, as also described more below. As shown in FIG. 12, the chamber member 54 includes two annular protrusions 90 that provide for precise positioning of the chamber member 54 in the chamber carrier 58.

Figure 13:
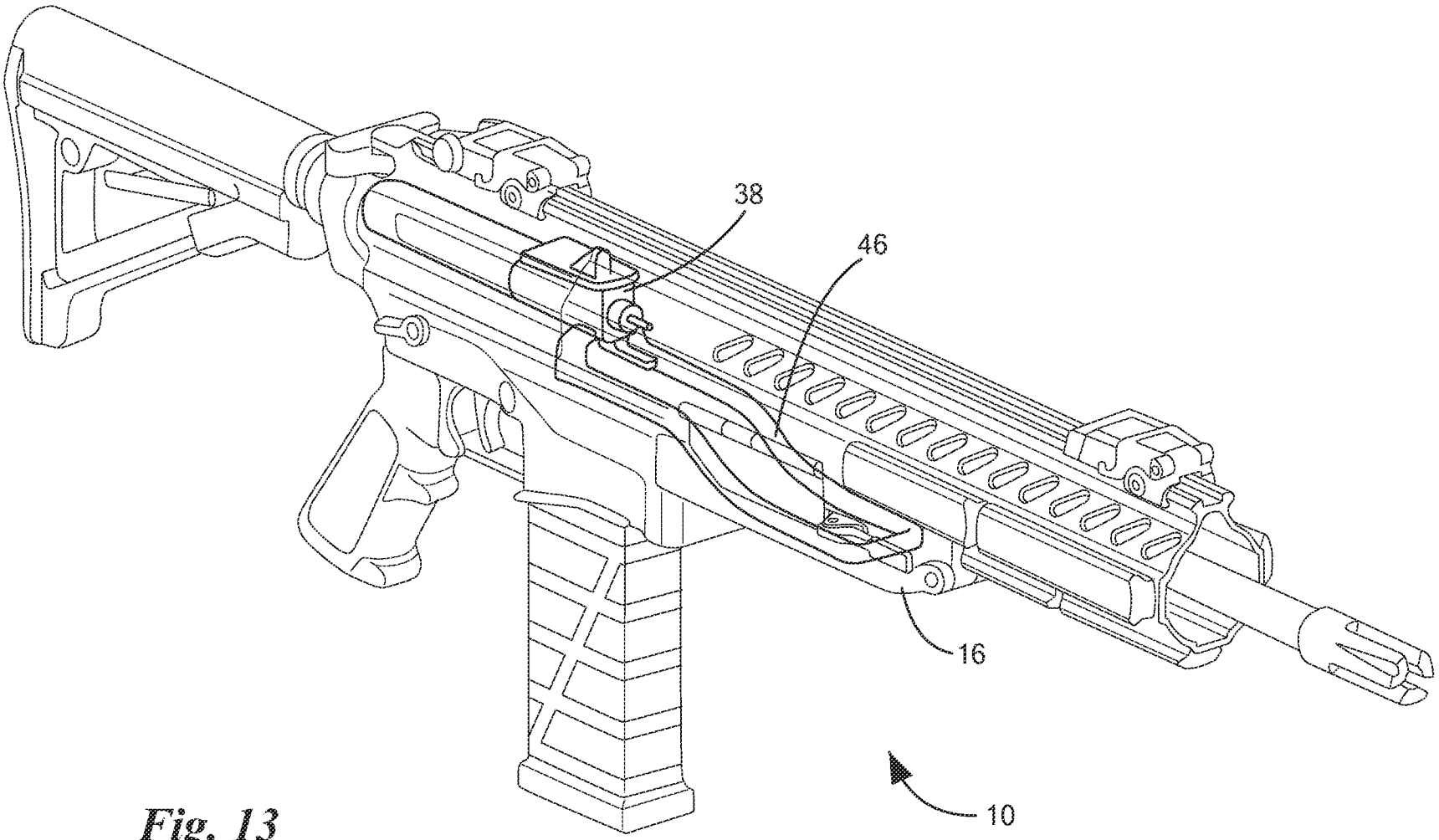
FIG. 13 is a perspective view of a carbine highlighting a carrier assembly and slide.

FIG. 13 shows the carrier assembly 38 and slide 46 within the carbine 10. These two components are mated together by a connection and move together in a reciprocating manner in operation, as described more below. Among other things, the carrier assembly 38 carries the firing pin and a fixed rammer that performs push-through loading and ejection, and the slide 46 actuates the chamber carrier 58 to move the chamber member 54 between the firing position and ejection/loading position, as described more below.

Figure 14:
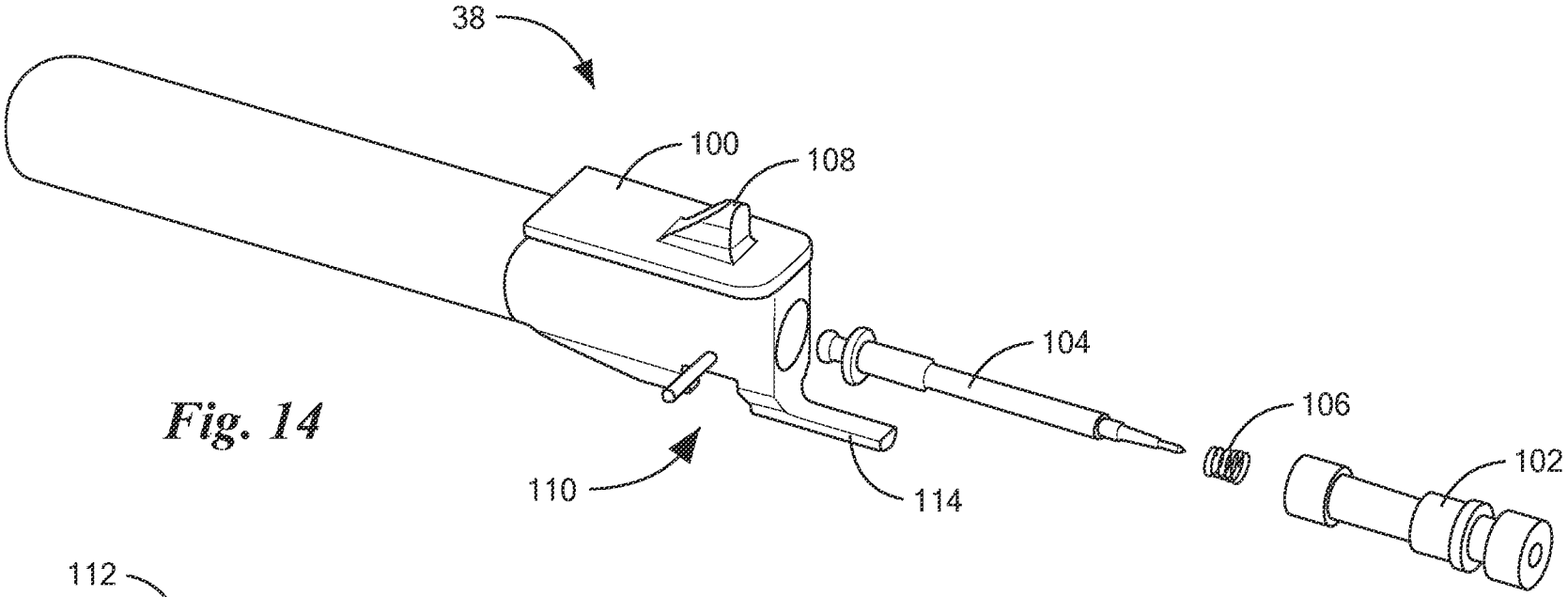
FIG. 14 is a perspective exploded view of the carrier assembly.
Figure 15:
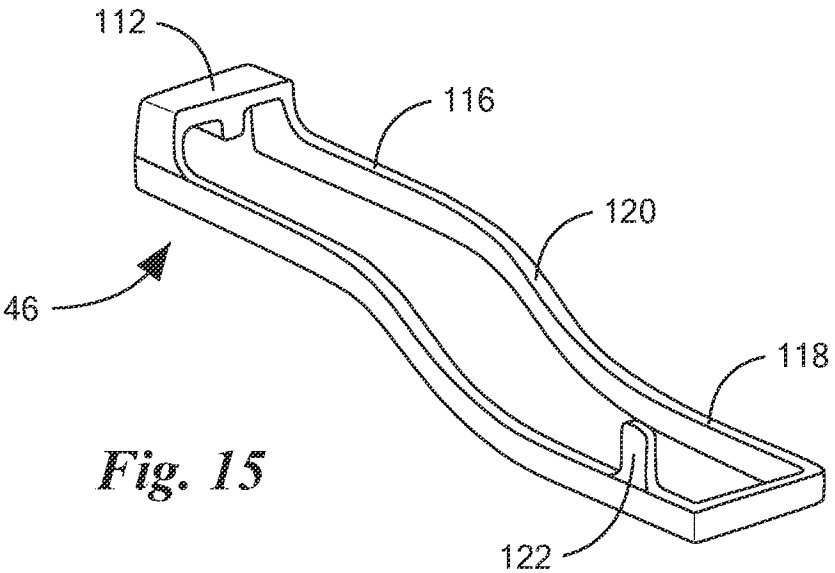
FIG. 15 is a perspective view of the slide.

FIGS. 14-15 show details of the carrier assembly 38 and slide 46. The carrier assembly 38 includes a machined carrier 100, a firing pin protrusion insert 102, firing pin 104, and firing pin return spring 106. The carrier 100 has a piston interface boss 108 and a bottom-facing notch 110 for receiving a rear end 112 of the slide 46, as well as a forward-facing, foot-like protrusion referred to as a rammer 114. The slide 46 has a generally S-shaped profile, with relatively flat rear and forward portions 116, 118 separated by a sloping intermediate portion 120 (e.g., for smooth function, to reduce acceleration, to compress overall carrier stroke, combinations thereof, etc.). It also includes an upward-facing clearing rod reset boss 122.

Figure 16:
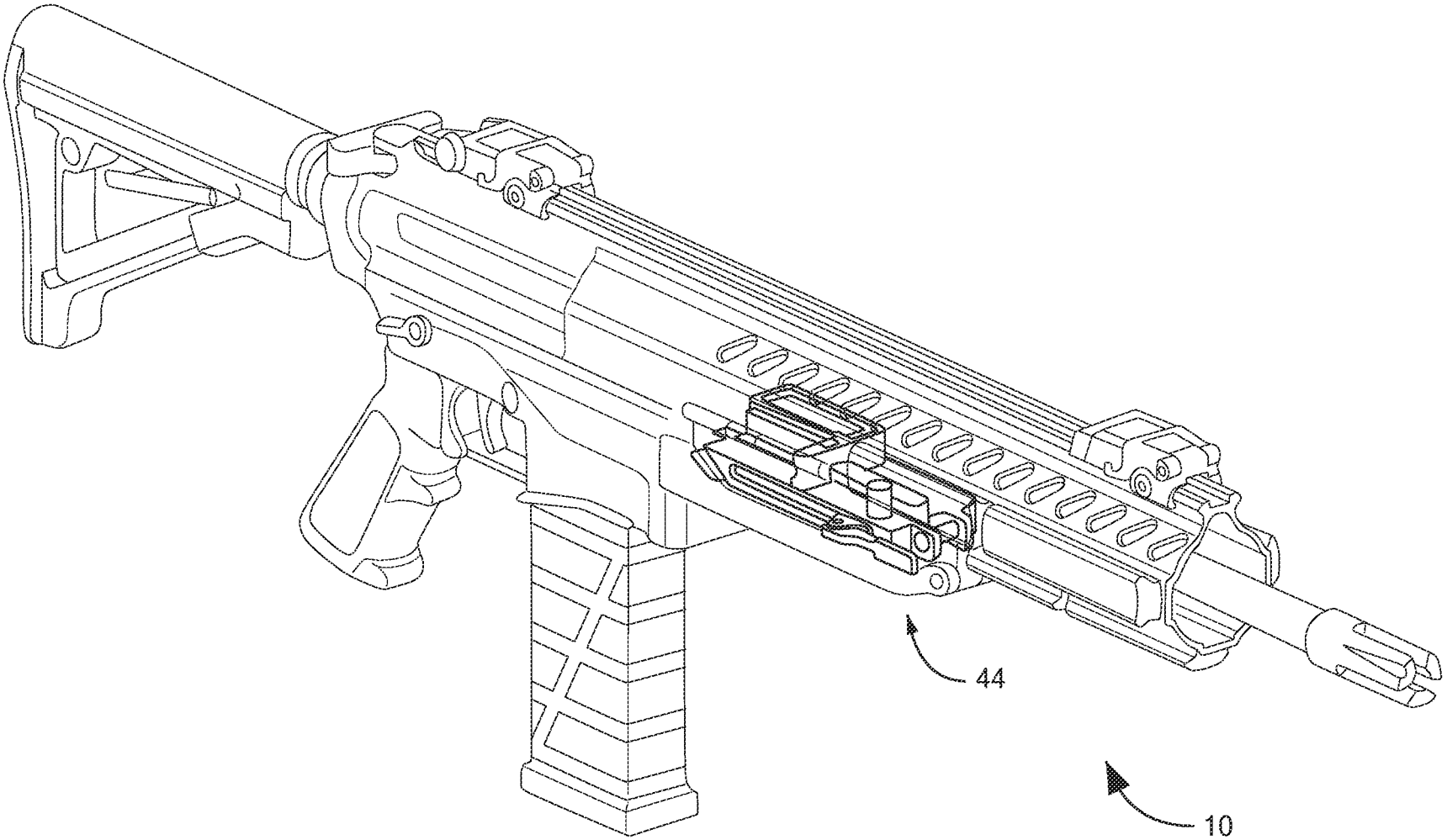
FIG. 16 is a perspective view of a carbine highlighting an ejector assembly.

FIG. 16 shows the ejector assembly 44 within the carbine 10.

Figure 17:
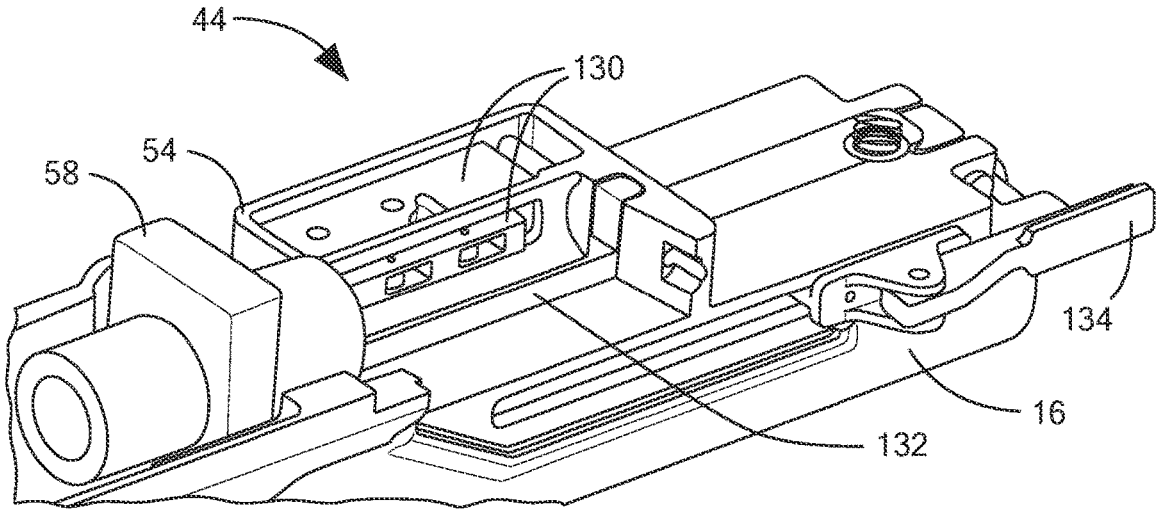
FIGS. 17-18 are views of the ejector assembly.
Figure 18:
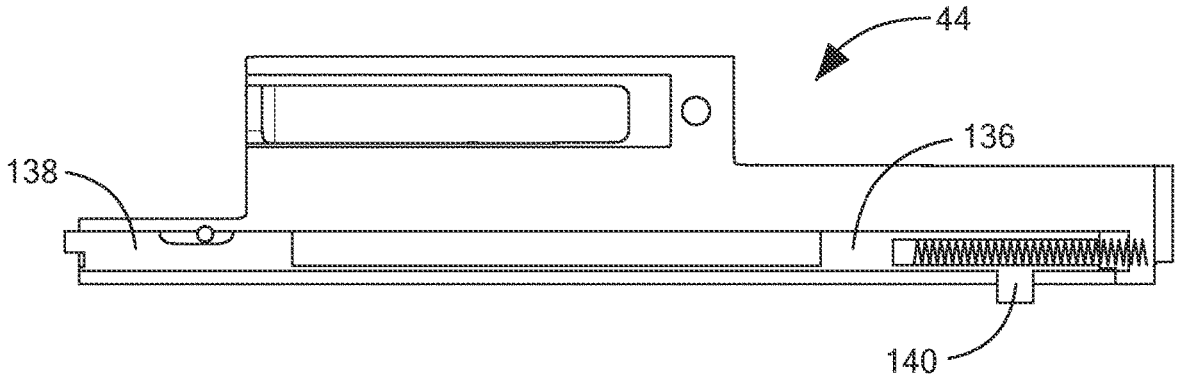

FIGS. 17-18 show certain details of the ejector assembly 44. It includes an ejector sub-assembly (or mechanism) 130 and a clearing rod mechanism with a clearing rod 132 and clearing handle 134. As shown in FIG. 18, the ejector assembly 44 also includes a spring-loaded chamber carrier catch 136 that functions to latch the chamber carrier 58 in the ejection/loading position as described more below. The chamber carrier catch 136 has an end protrusion 138 that engages the carrier catch cutout 86 (FIGS. 10-11), as well as a forward protrusion 140 that is engaged by the slide 46 to hold the chamber carrier 58 in the ejection/loading position throughout a certain part of the operating cycle as also described more below.

Figure 19:
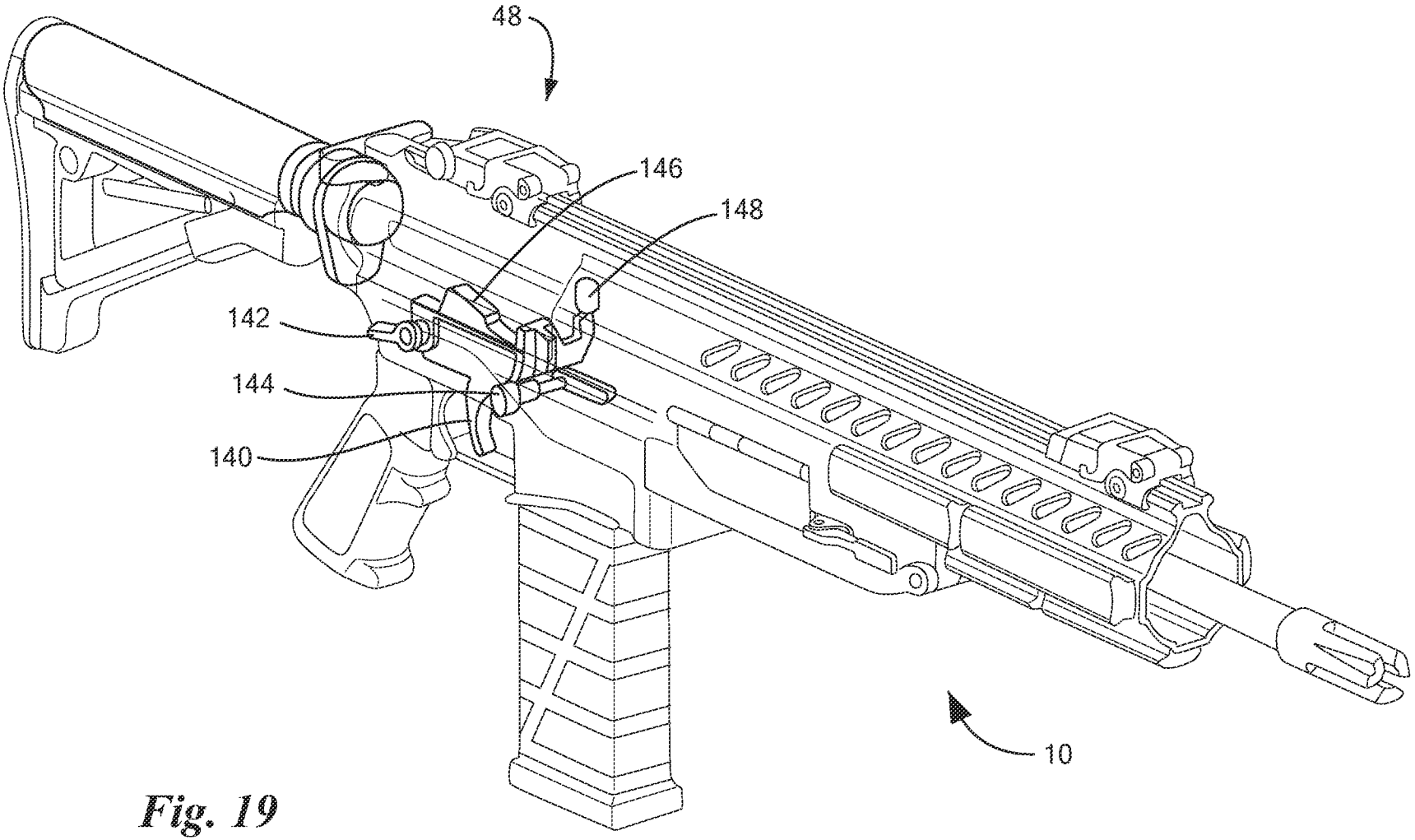
FIG. 19 is a perspective view of a carbine highlighting a trigger group.

FIG. 19 shows the trigger group 48 within the carbine 10. External components include a trigger 140, mode selector 142, and magazine release 144. Internal components include a hammer 146 and carrier catch 148.

Figure 20:
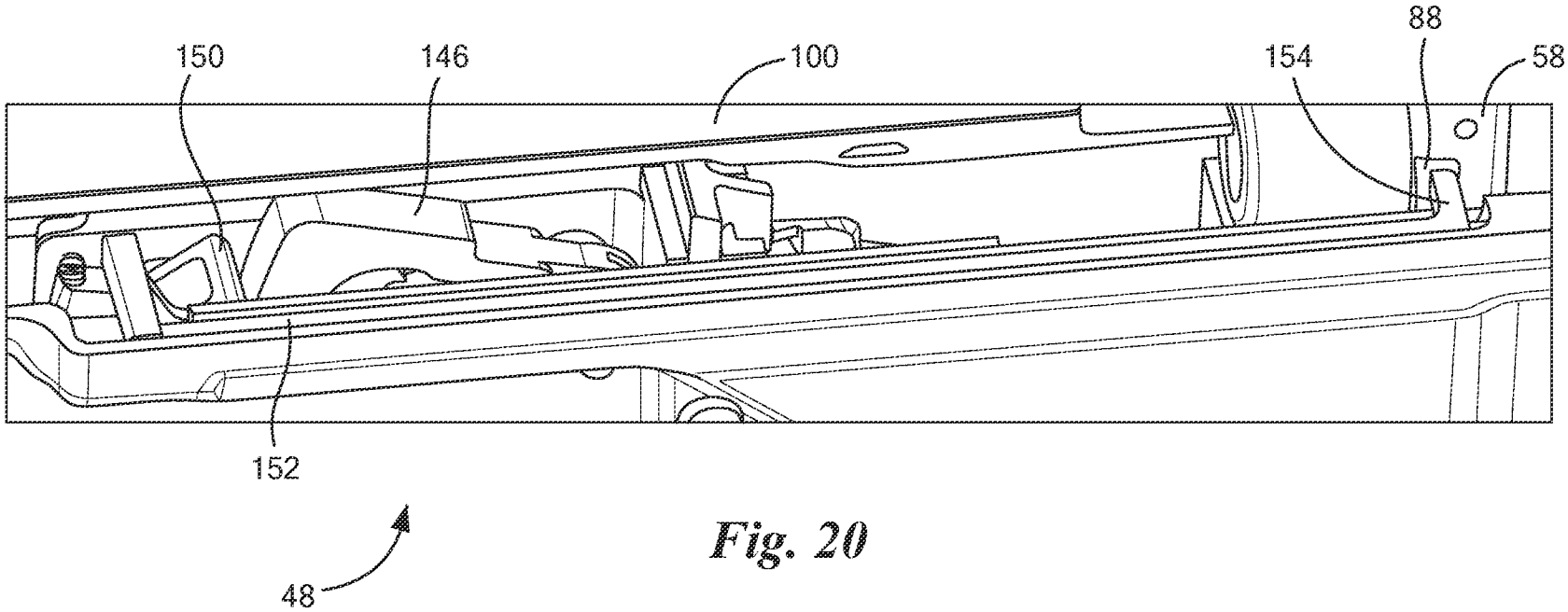
FIG. 20 is a view of a sear link and related components.

FIG. 20 shows the trigger group 48 and related structure in more detail. A spring-biased hammer 146 is engaged by a spring-biased full auto sear 150, which in turn is engaged by a full-auto-sear (FAS) link 152 having a forward portion 154 that engages the sear link cam indentation 88 of the chamber carrier 58. In operation, when the chamber carrier 58 is in the downward ejection/loading position as shown, the FAS link 152 is moved forward (rightward in FIG. 20) and allows the FAS 150 to engage the hammer 146, preventing it from releasing. When the chamber carrier 58 is in the upward firing position (described more below), the FAS link 152 is moved rearward (leftward in FIG. 20) and pushes the FAS 150 away from the hammer 146, enabling the hammer to be released based on depression of the trigger 140.

FIGS. 21-26 are used to describe basic operation of the carbine 10.

Figure 21:
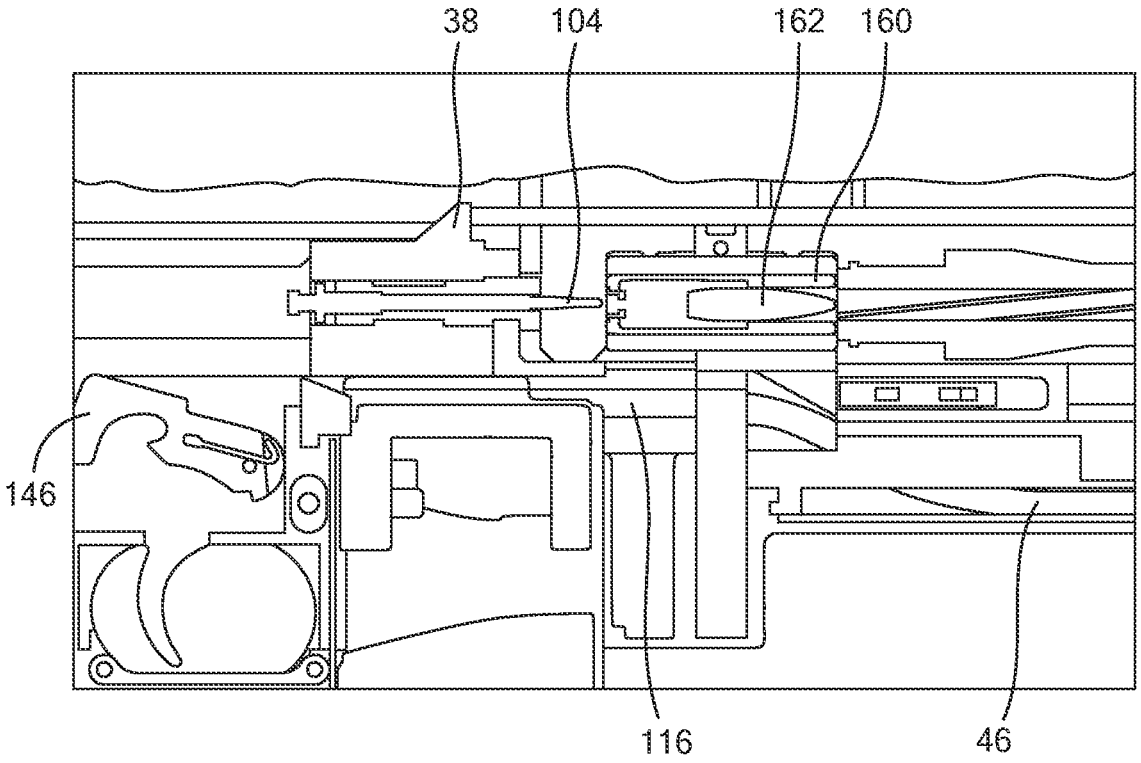
FIGS. 21-26 are side internal views illustrating operation of the carbine.

FIG. 21 shows an initial state in which a cartridge 160 is chambered and the chamber member 54 is in the firing position, within the chamber cavity 52 of the barrel extension 32 (FIGS. 6-8). The hammer 146 is cocked, and the carrier assembly 38 is in a battery position against the rear face of the barrel extension 32, with the tip of the firing pin 104 adjacent to a primer of the cartridge 160. The slide 46 is completely forward (rightward in these figures), so that its rear portion 116 clears the cam shoulders 90 of the chamber carrier 58 (not visible in FIG. 21), enabling the chamber carrier 58 to be urged completely upward into the firing position.

When the trigger is pulled (or, in full auto mode, based on action of the FAS link 152 as described above), the hammer 146 is released, which strikes the firing pin 104 and ignites the primer to fire the cartridge 160. As the projectile 162 exits the barrel 12, gas in the barrel 12 pushes the gas piston 36 rearward. The carrier assembly 38 recoils, pulling the slide 46 rearward and cocking the hammer 146.

Figure 22:
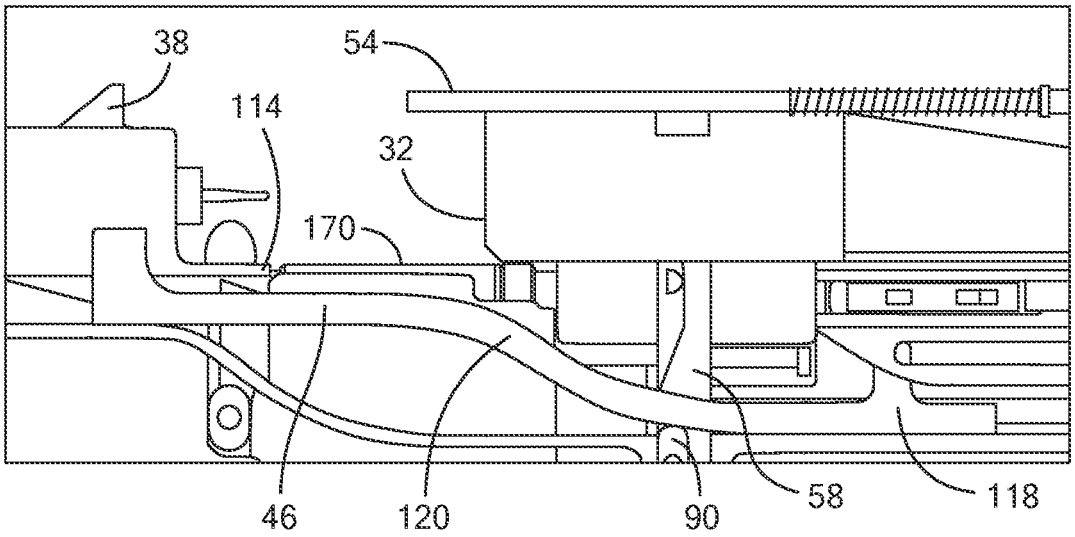

FIG. 22 shows the end of recoil, when the slide assembly 38 is at its farthest rearward travel. The sloped portion 120 of the slide 46 has pushed downwardly on the cam shoulders 90 to lower the chamber carrier 58, bringing the chamber member 54 into the ejection/loading position in which it is aligned with a next CT cartridge 170 which is the topmost round in the magazine. The next CT cartridge 170 has its upper edge aligned with the rammer 114. It will be appreciated that at this instant the spring within the buttstock 18 has maximal compression and urges the carrier assembly 38 forward, starting counter-recoil.

Figure 23:
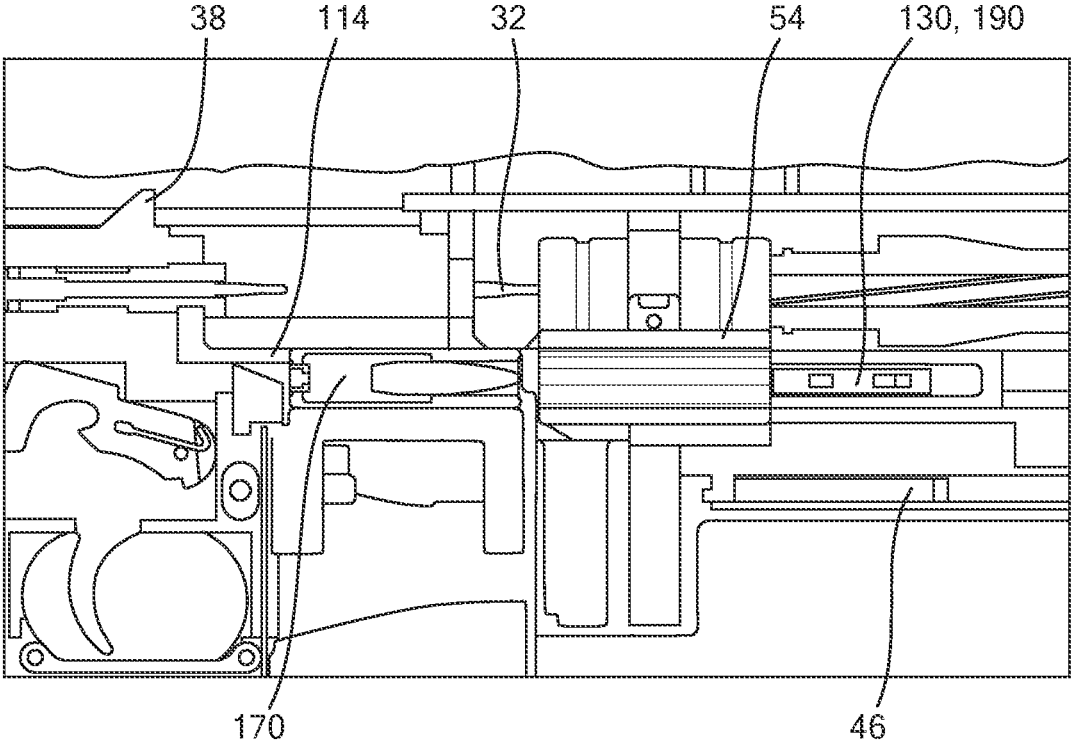
Figure 24:
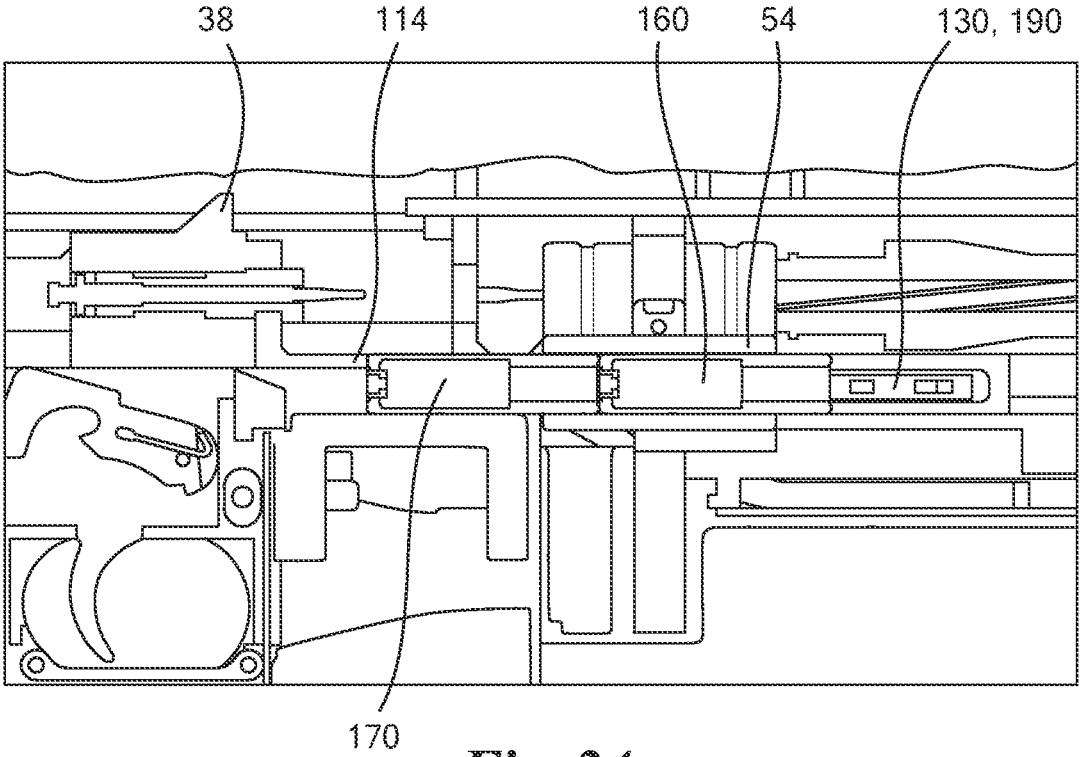
Figure 25:
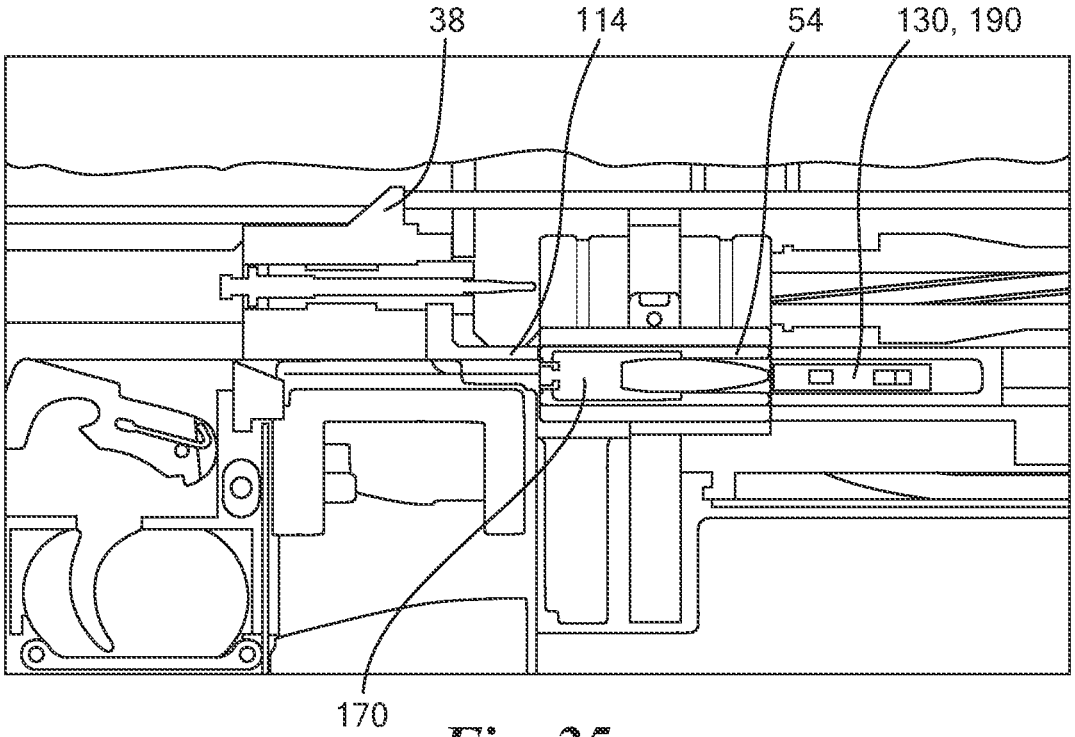

FIGS. 23-25 illustrate counter-recoil, during which the carrier assembly 38 moves forward to return to the battery position for firing a next round. Throughout counter-recoil, the rammer 114 pushes against the rear of the next CT round 170, pushing it into the chamber member 54. This has the effect of loading the next CT round 170 into the chamber 55 while simultaneously ejecting the just-fired "spent" CT round 160 when present (omitted in FIG. 23) by pushing it out the front of the chamber member 54. Action of the ejector 130 on the spent cartridge 160 is described more below. Also throughout counter-recoil, the chamber carrier catch 136 (FIG. 18) engages the chamber carrier catch cutout 86 (FIGS. 10-11) to hold the chamber carrier 58 in the downward ejection/loading position.

Figure 26:
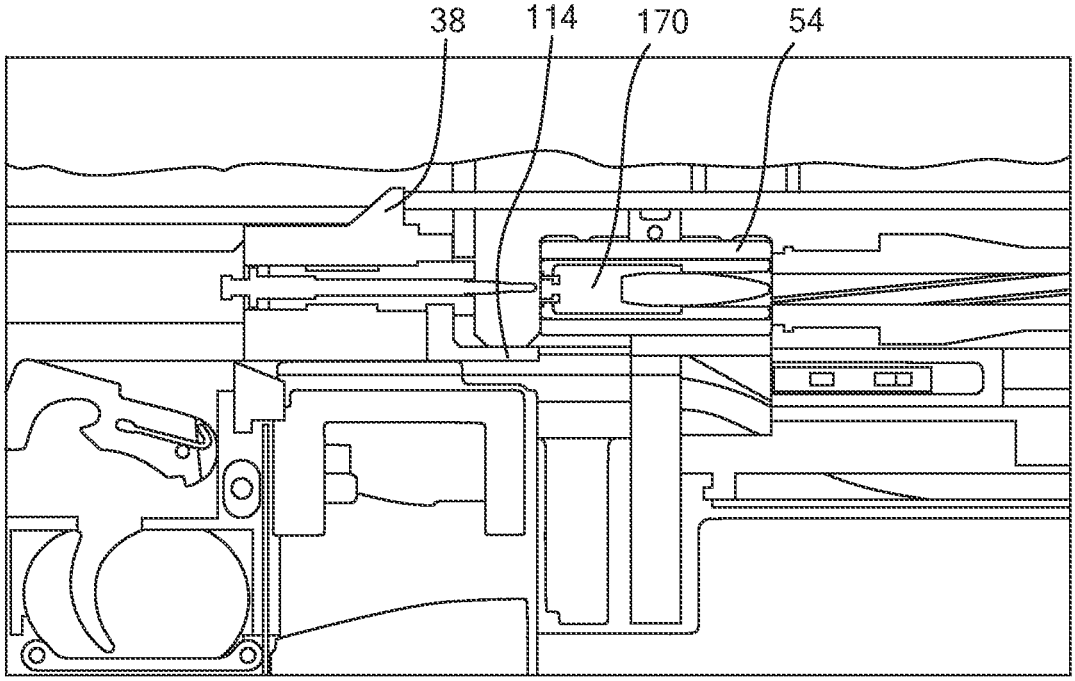

FIG. 26 shows the very end of counter-recoil in which the carrier assembly 38 has returned to the battery position. A feature on the slide 46 has hit the forward protrusion 140 of the chamber carrier catch 136 (FIG. 18) to urge it slightly rearward, allowing the chamber carrier 58 to return upward to the firing position by action of the springs 74 (FIG. 10). The carbine 10 is ready to fire the chambered next CT round 170.

Figure 27:
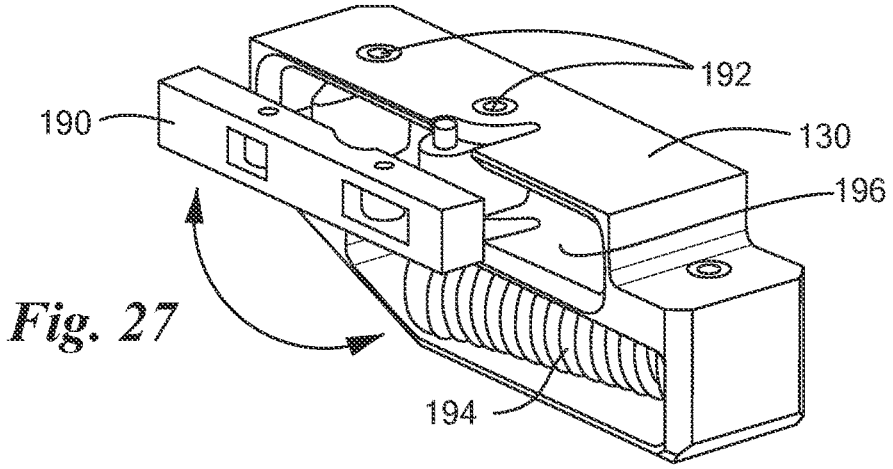
FIG. 27 is a perspective view of an ejector.

FIG. 27 shows the ejector 130, which performs an ejection function as well as a first round stop function. The ejector 130 includes a horizontal bar 190 mounted on two pivots 192 for swiveling movement under a spring load provided by a pivoting spring 194. During operation, the bar 190 travels in an arc as indicated, beginning in a rearward position (upper left in FIG. 27), traveling through the illustrated midway position, and ending in a forward position (lower right in FIG. 27) in which it is nestled within the cavity 196, before returning to the rearward position by spring action. Referring back to FIG. 23, at the start of ramming the bar 190 abuts the front of the chamber member 54 in the ejection/loading position, providing a stop for a cartridge that has been pushed into the chamber 55 (not shown in FIG. 23). As ramming progresses (FIG. 24), the cartridge 160 being ejected pushes against the bar 190, rotating it outward and forward. Once the bar 190 has rotated completely forward and becomes recessed within the cavity 196, the cartridge 160 begins to slide past it, and the spring-loaded bar 190 now exerts an outward force on the cartridge 160. As the bar 190 arcs back to its initial position, it pushes the exiting cartridge 160 out of the ejector assembly 44, ejecting the cartridge from the carbine 10.

Figure 28:
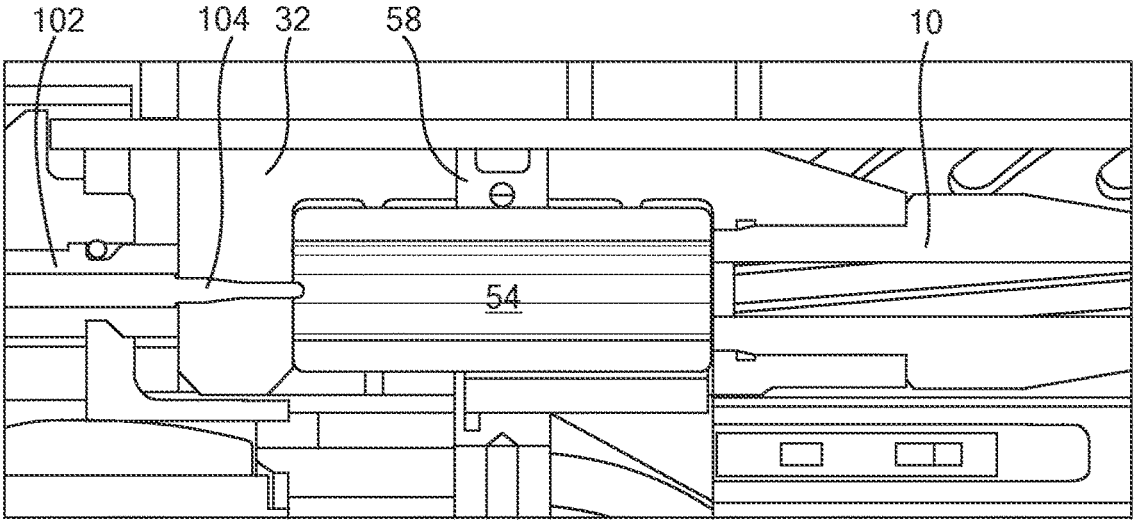
FIGS. 28-29 are side internal views illustrating function of a barrel extension.
Figure 29:
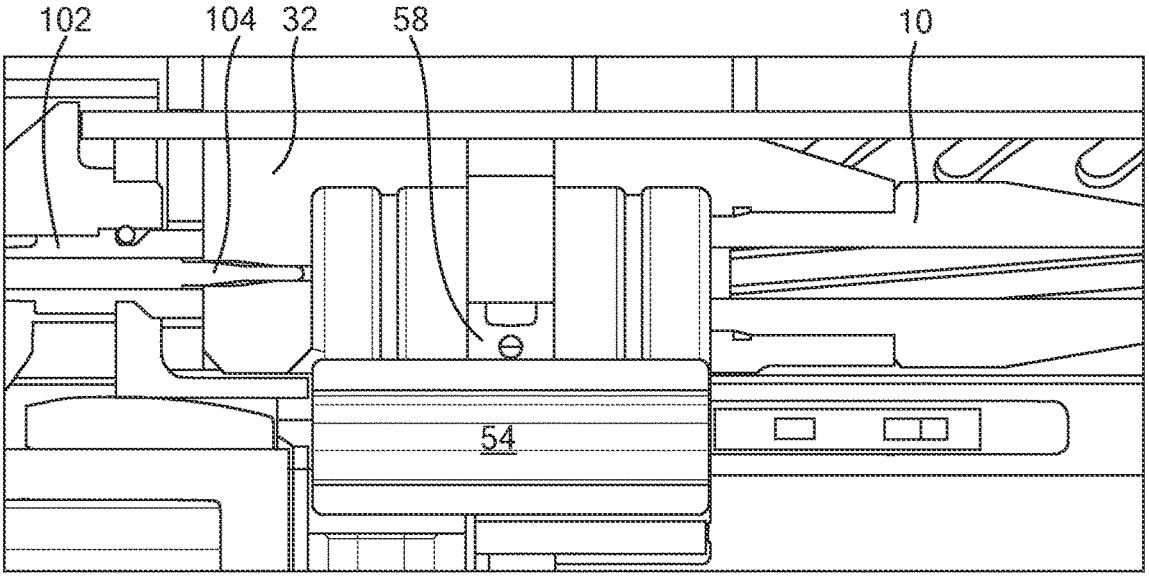

FIGS. 28-29 illustrate functionality of the barrel extension 32. Generally, it aligns the chamber member 54 to the barrel 12 and firing pin 104 via tightly controlled diametrical ribs 62, as described above. The springs 74 of the chamber assembly 42 provide upward pressure, keeping the chamber member 54 in place. The barrel extension 32 also inhibits lateral and axial motion of the chamber member 54 and chamber carrier 58 during ramming. Additionally, it controls protrusion of the firing pin 104 (in combination with the protrusion insert 102), sets headspace (in combination with the barrel 10), and guides the gas piston 36 (with the upper receiver 14).

Figure 30:
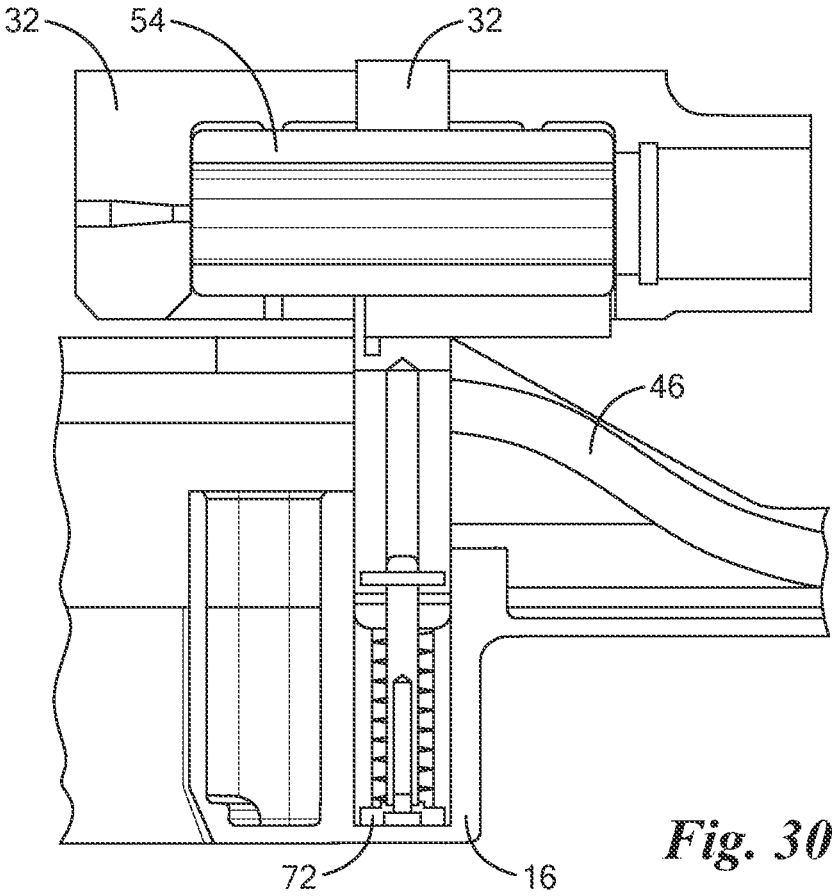
FIGS. 30-31 are side internal views illustrating chamber carrier movement in response to motion of a slide.
Figure 31:
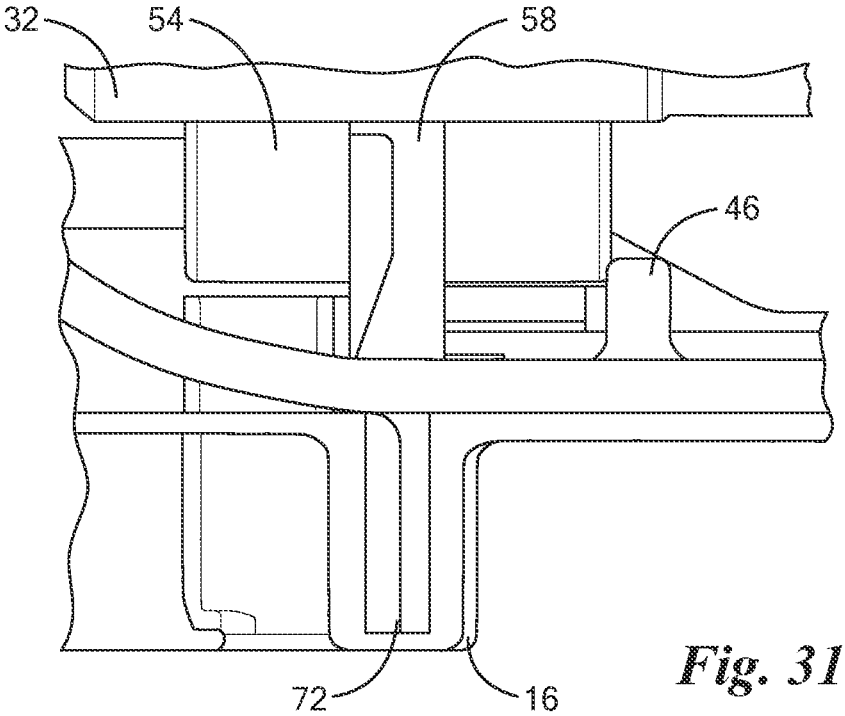

FIGS. 30 and 31 illustrate additional details regarding retention of the chamber carrier 58. It is axially, laterally, and vertically controlled in the barrel extension 32. It is vertically controlled by the slide 46, the camber carrier catch 136 (not shown) or the chamber member 54 in the barrel extension 32 depending on the phase of operation (recoiling, ramming, or firing). It is vertically controlled at its bottom by the base plate 72 and the lower receiver 16.

Figure 32:
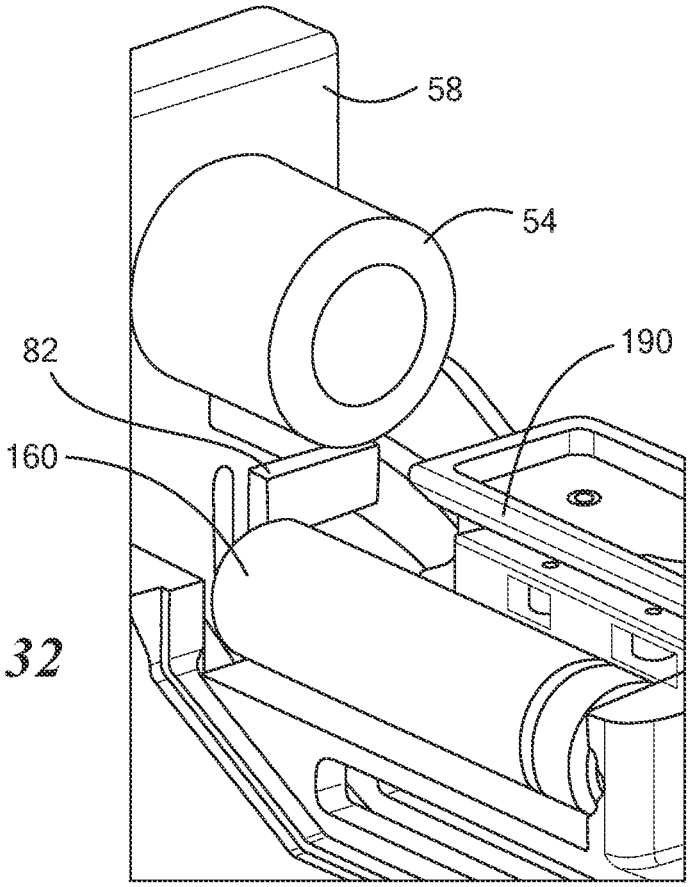
FIG. 32 is a perspective view of a front round stop and related structure.
Figure 33:
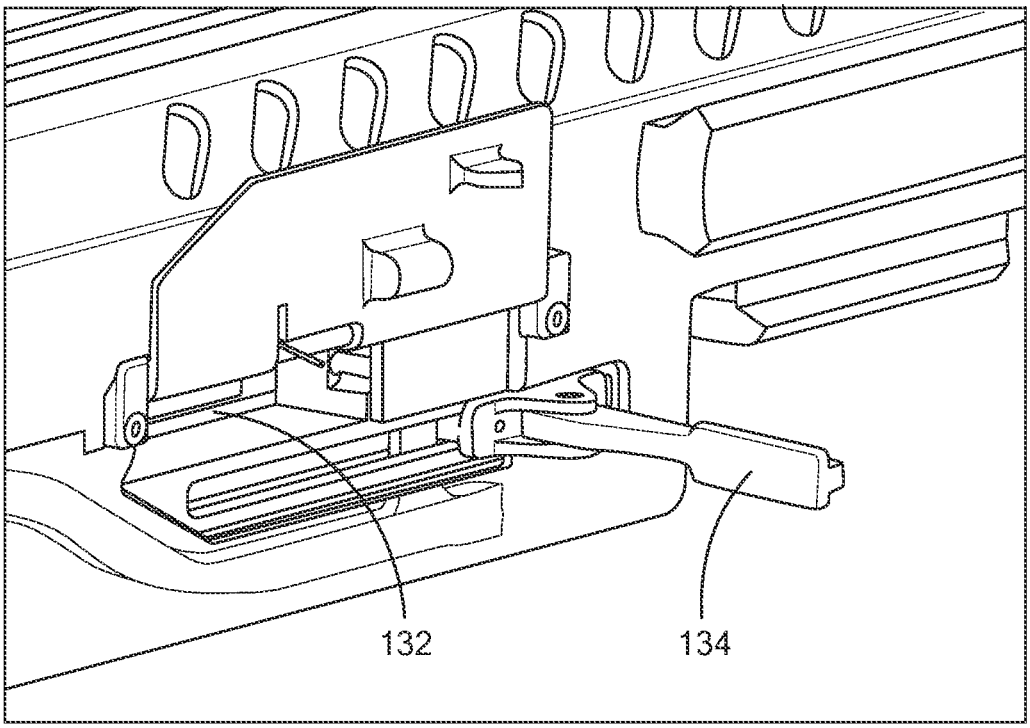
FIGS. 33-36 are perspective views of an ejector assembly showing a clearing rod in operation.

FIG. 32 illustrates function of the front round stop 82. When the chamber member 54 is in the illustrated upward firing position, the front round stop 82 prevents rearward motion of a spent cartridge 160 that is being ejected by outward motion of the ejector bar 190, which is explained above. This prevents the weapon from jamming due to the spent cartridge 160 backing under a lowering chamber member 54 if ejection fails.

Figure 34:
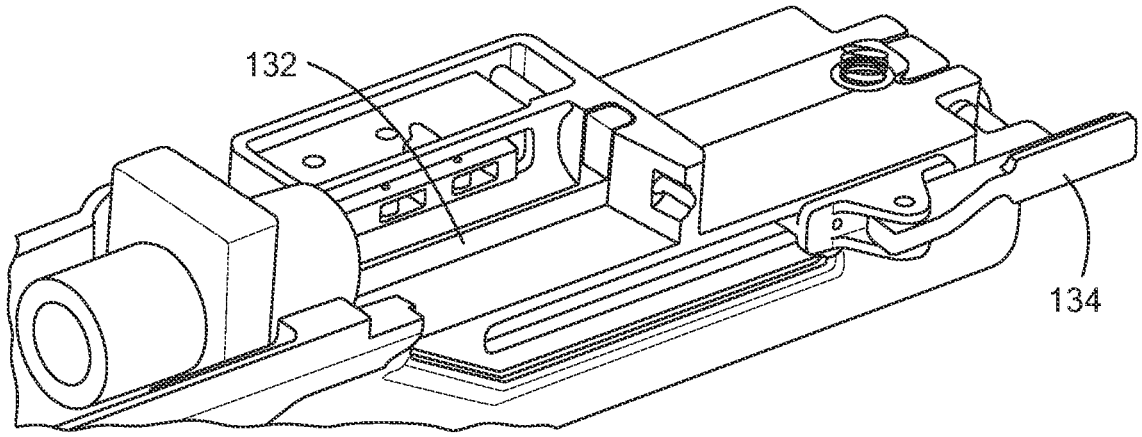
Figure 35:
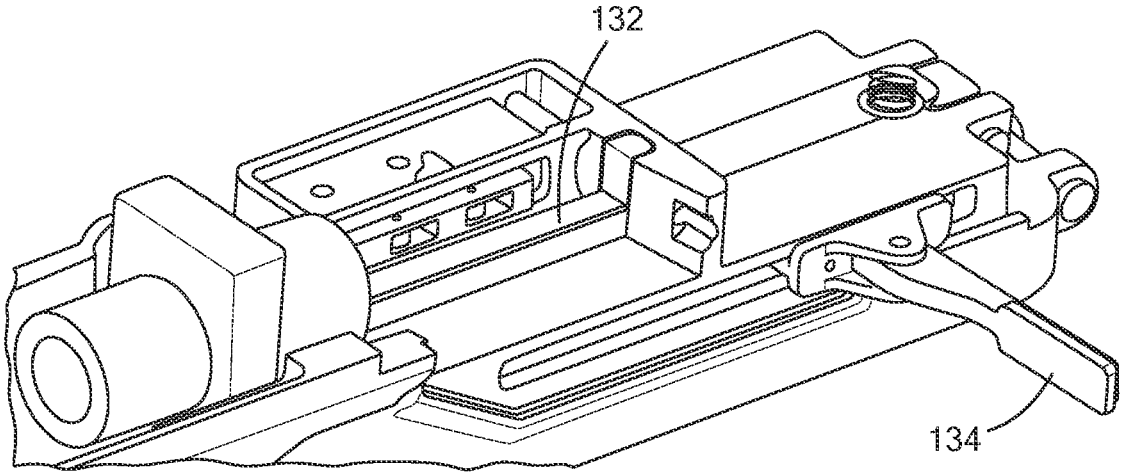
Figure 36:
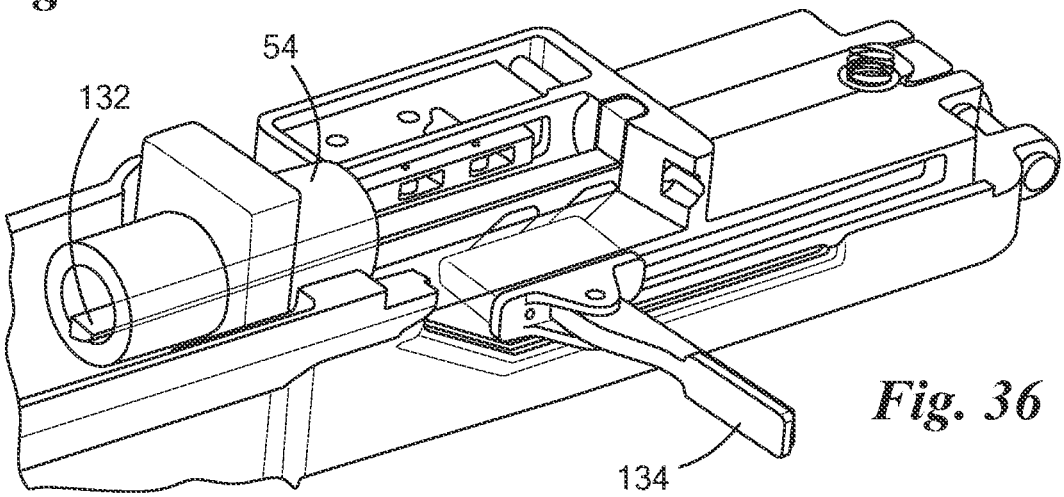
Figure 37:
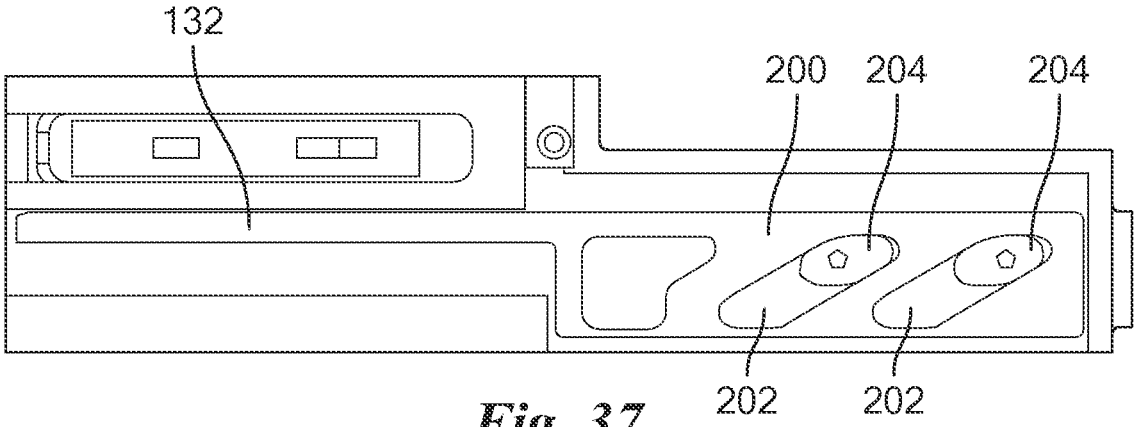
FIGS. 37-40 are side internal views of the ejector assembly showing the clearing rod in operation.
Figure 38:
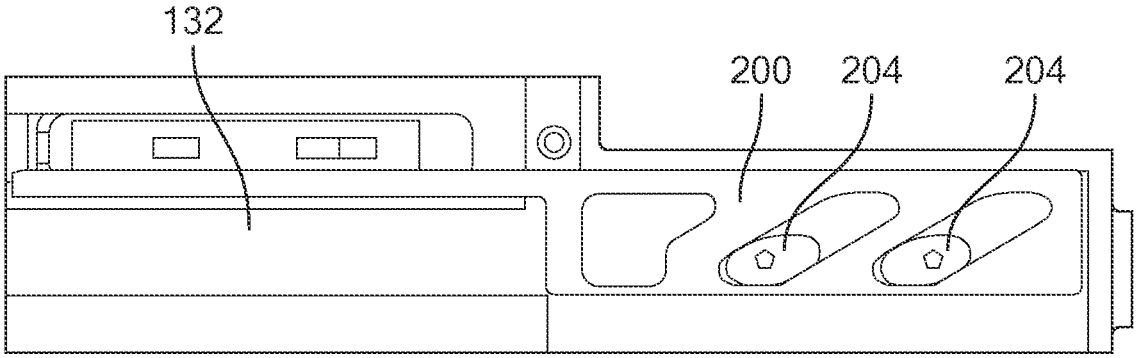
Figure 39:
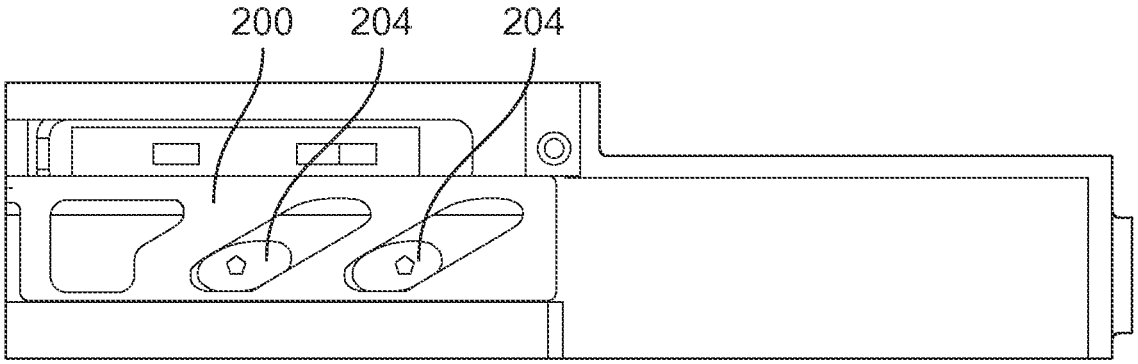
Figure 40:
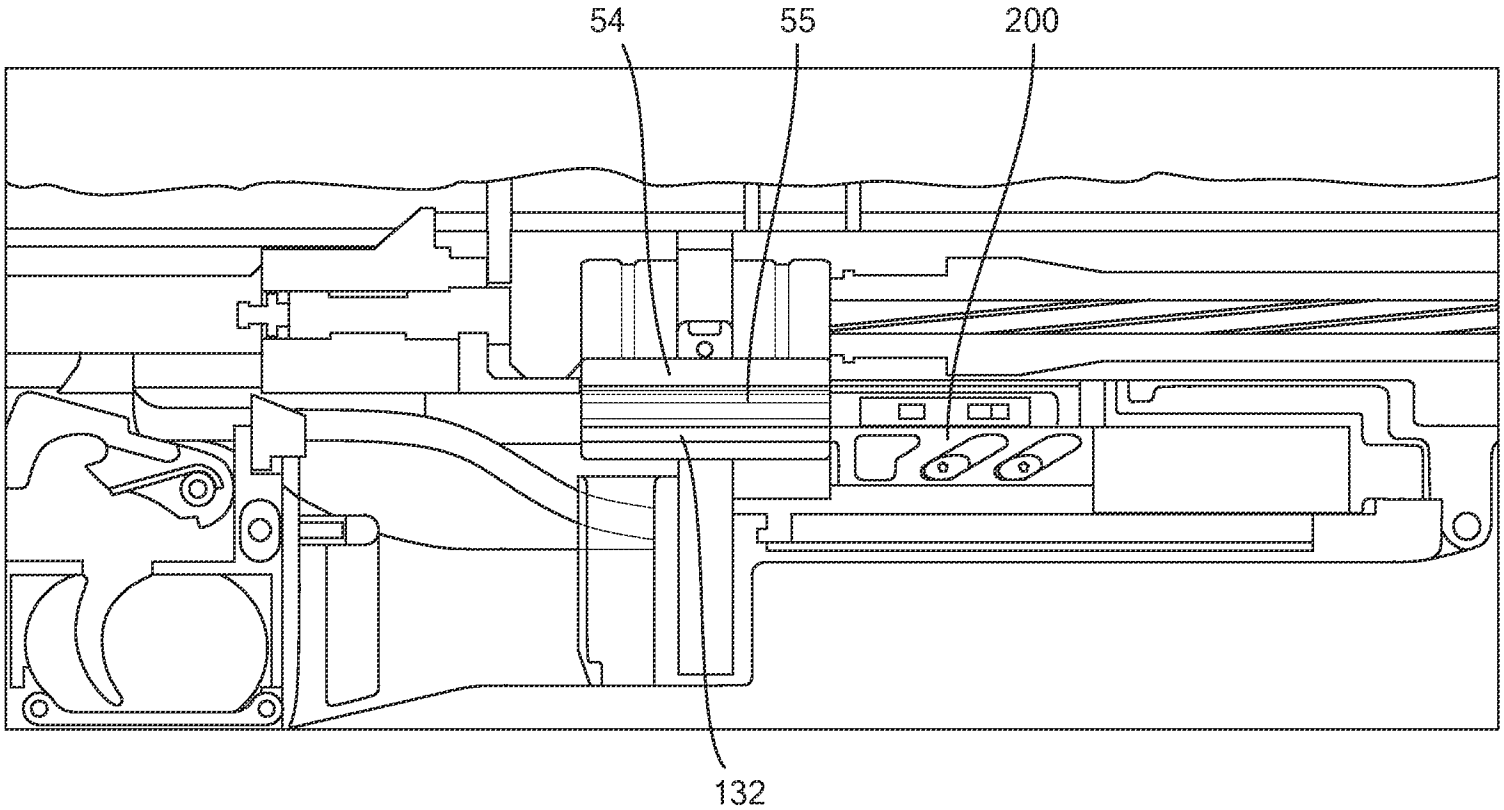

FIGS. 33-40 describe operation of the clearing rod components of the ejector assembly 44, including the clearing rod 132 and clearing handle 134. FIGS. 34-36 show externals, while FIGS. 37-40 show internals. First, the clearing handle 134 is rotated outward, then pulled rearward toward the operator, to the position shown in FIG. 36. In that position as shown, the clearing rod 132 has been pulled completely through the chamber member 54, pushing out any spent or unfired cartridge in the rearward direction. FIGS. 37-39 show that the clearing rod 132 is an extension of a member 200 having slanted openings 202 that ride on cams 204, which are secured to the same slide-like member to which the clearing handle 134 is mounted. FIG. 37 illustrates a stowed position, corresponding to FIG. 34. When the clearing handle 134 is pulled rearward, the first movement of the member 200 is upward, bringing the clearing rod 132 into alignment with the chamber 55 (FIG. 40). Then the cams 204 contact the lower-right surfaces adjacent the openings 202 (FIGS. 38-39) and drag the member 200 rearward.

Figure 41:
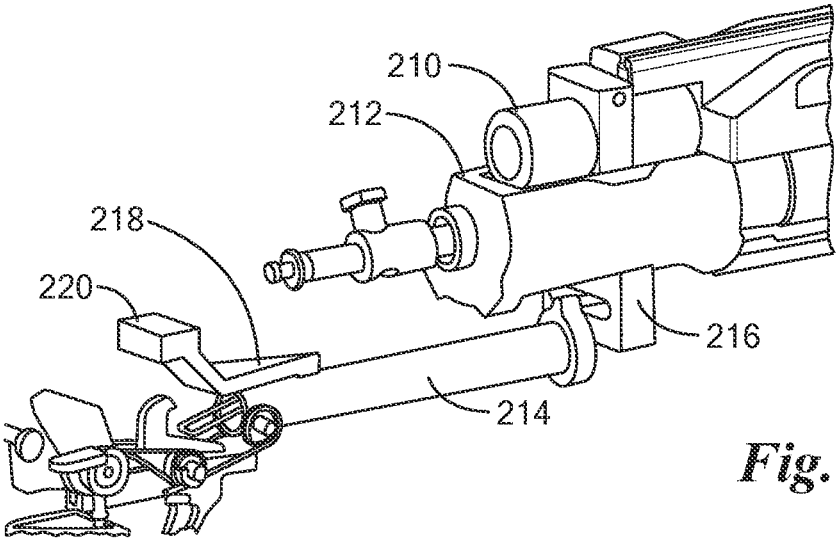
FIGS. 41-43 are perspective views of a rotational drive mechanism for controlling linear chamber carrier movement.
Figure 42:
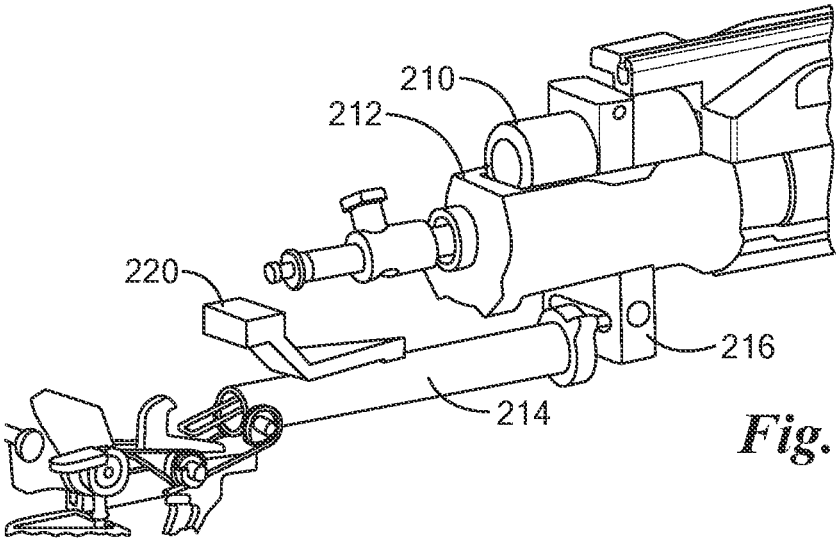
Figure 43:
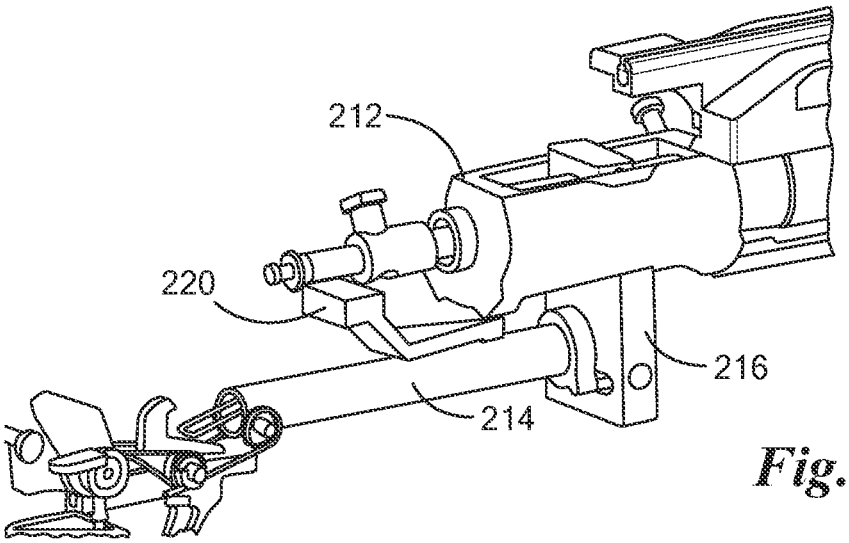
Figure 44:
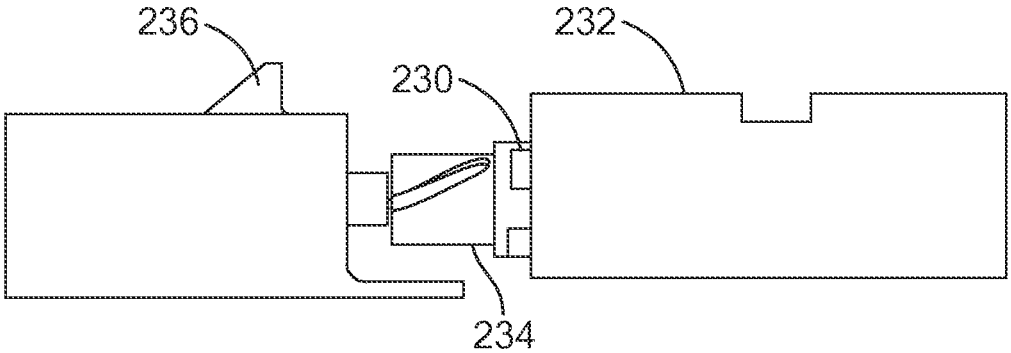
FIGS. 44-50 are views illustrating a first headspace reduction technique.

FIGS. 41-43 describe an alternative arrangement for vertical movement of a chamber member 210. In the arrangement, the chamber member 210 is moved downwardly from an ejection/loading position (FIG. 41) to a firing position within a barrel extension 212 (FIG. 43). One end of a rotating shaft 214 engages a slotted opening of the chamber carrier 216. The shaft 214 has an arcuate groove (not shown) into which a corresponding foot member 218 of a carrier 220 is disposed. Linear movement of the carrier 220 during operation causes corresponding rotational movement of the shaft 214. The progression of FIGS. 41-43 shows counter-recoil, during which the carrier 220 is moving forward. The shaft 214 rotates to the right as shown, moving the chamber carrier 216 downward. It will be appreciated that during recoil the movement is exactly the opposite, bringing the chamber member 210 from the firing position to the ejection/loading position. One difference between this arrangement and that described above is the fully direct relationship between the linear position of the carrier 220 and the vertical position of the chamber member 210 there are no separate springs or latches as in the above arrangement. This direct mechanical linkage necessitates use of a disconnecting rammer, i.e., a rammer whose forward motion stops at the instant shown in FIG. 41 and then disconnects from the carrier 220 to permit the carrier 220 to continue forward and drive the chamber 210 downward. In the contrasting arrangement described above, the carrier 100 and rammer 114 stop together, and the return of the chamber member 54 to the firing position is achieved by the springs 74 upon release of the chamber carrier catch 136.

FIGS. 44-52 illustrate a first technique for controlling/reducing "headspace", which is empty space adjacent to the front and/or rear of a chambered cartridge.

Figure 45:
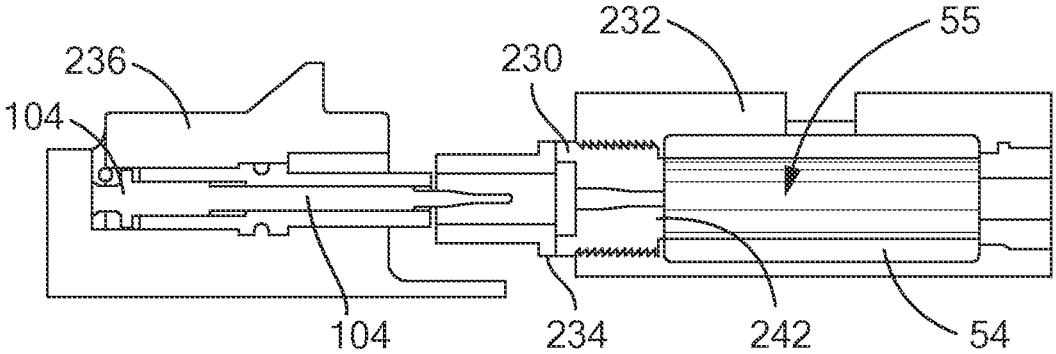
Figure 46:
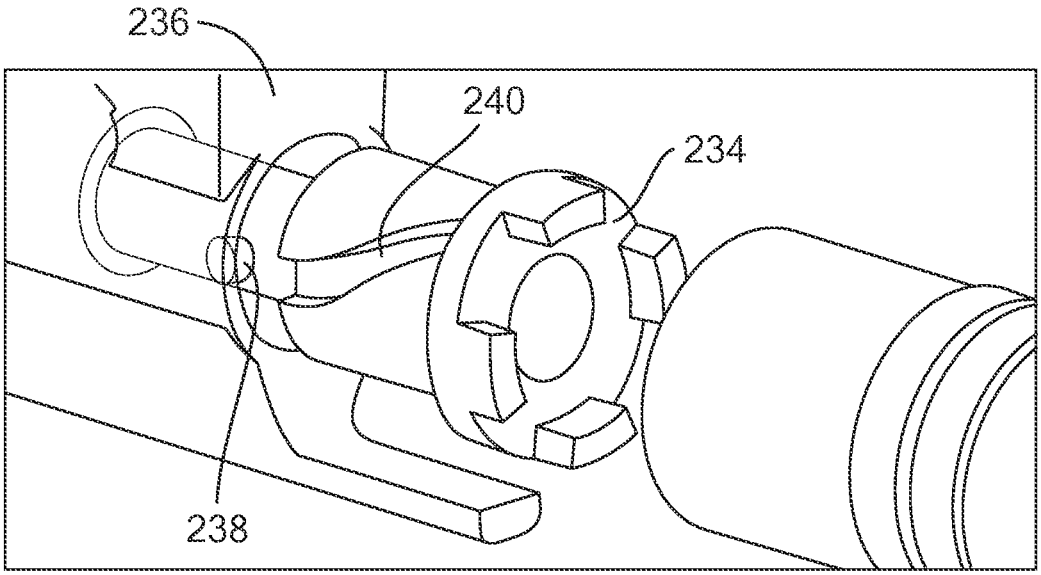
Figure 47:
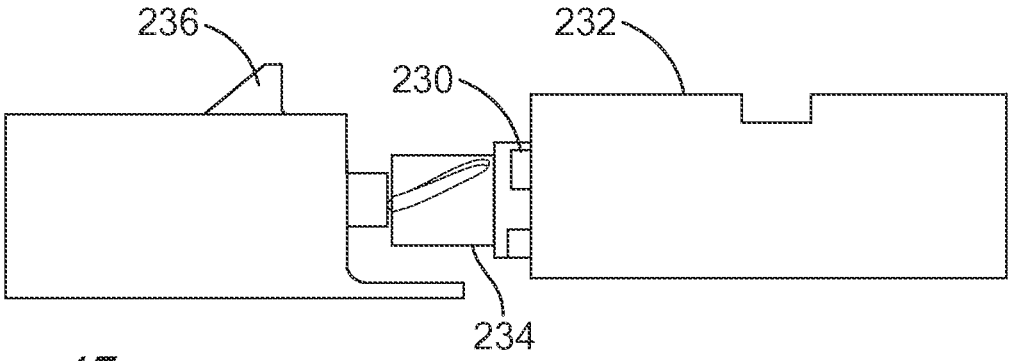
Figure 48:
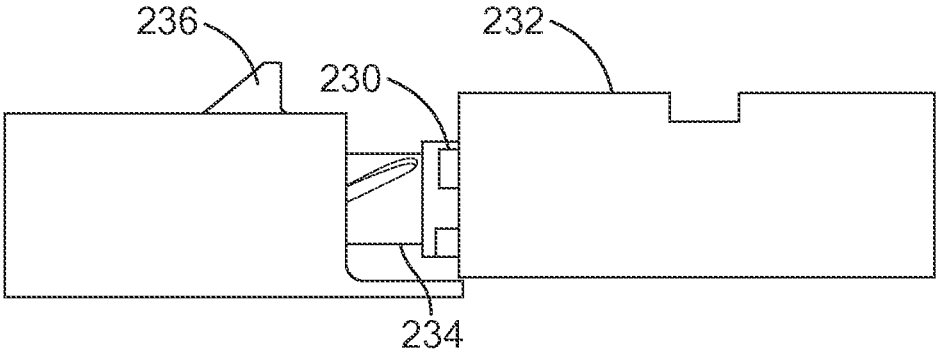
Figure 49:
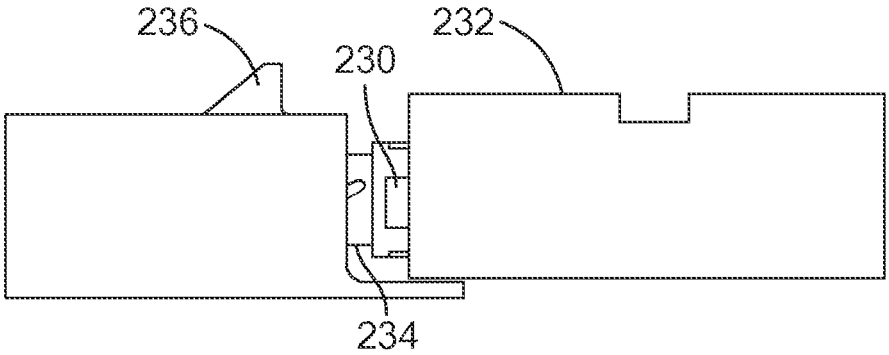
Figure 50:
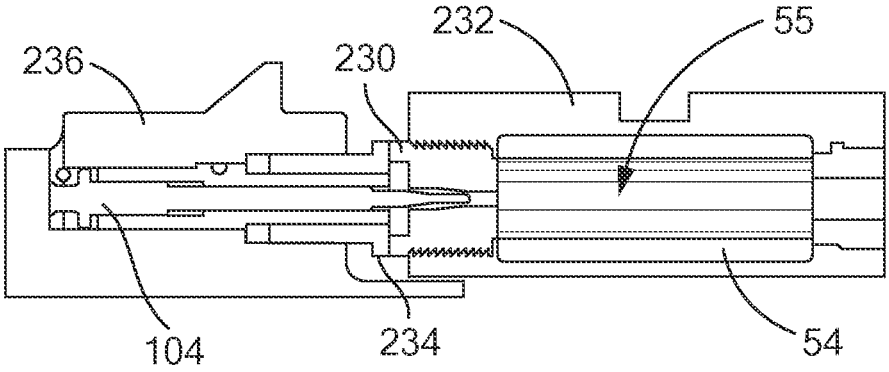

FIGS. 44-50 illustrate a first headspace reduction technique. A cylindrical breech 230 is screwed into the rear of the barrel extension 232, and mates with a breech actuator 234 via interlocking lugs as shown. As best seen in FIG. 46, the carrier 236 has an inward-facing boss 238 that engages with a corresponding arcuate groove 240 of the breech actuator 234. In operation, as the carrier 236 moves forward in counter-recoil, this camming of the boss 238 and groove 240 cause the breech actuator 234 to rotate. As best seen in FIG. 45, the breech 230 has a slight raised portion 242 whose diameter is equal to that of the chamber 55 (inner diameter of chamber member 54). Rotation of the breech 230 moves this portion 242 into the rear end of the chamber 55, closing any headspace at the ends of a chambered cartridge (not shown). FIGS. 47-50 illustrate three points in the recoil movement, with FIG. 50 illustrating the final (battery) position in cutaway.

Figure 51:
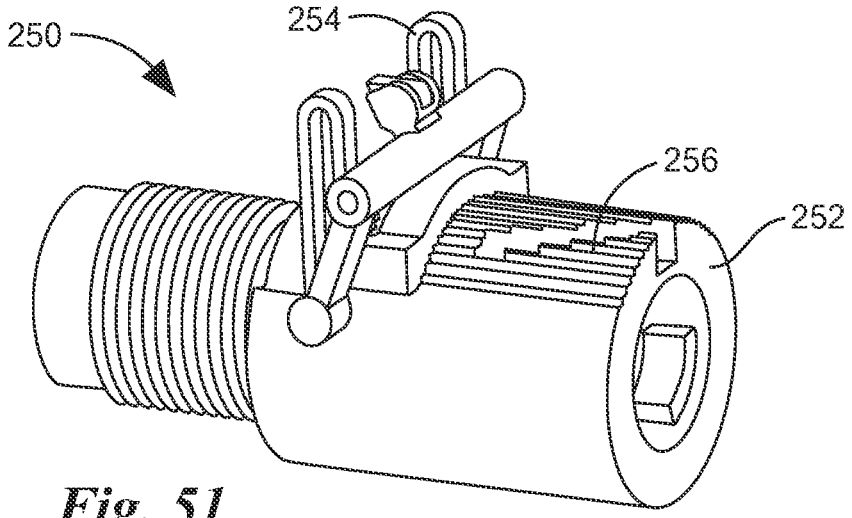
FIGS. 51-58 are views illustrating a second headspace reduction technique.
Figure 52:
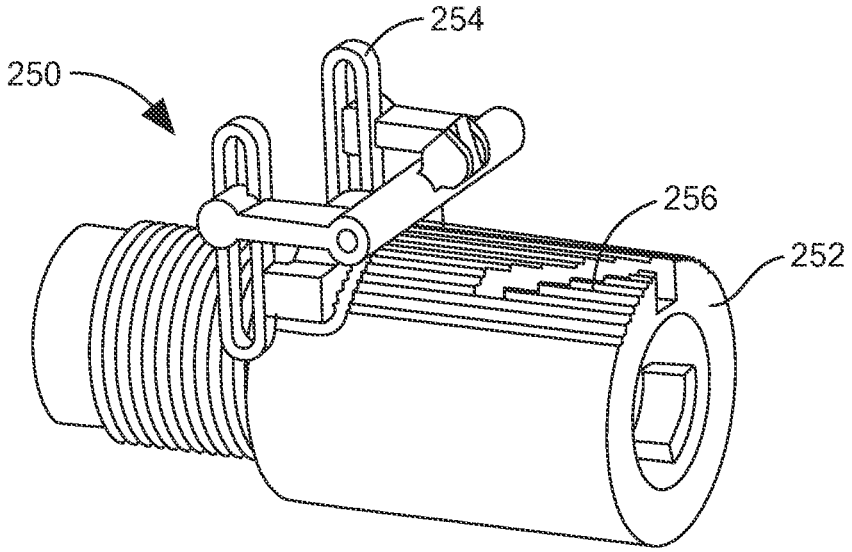
Figure 53:
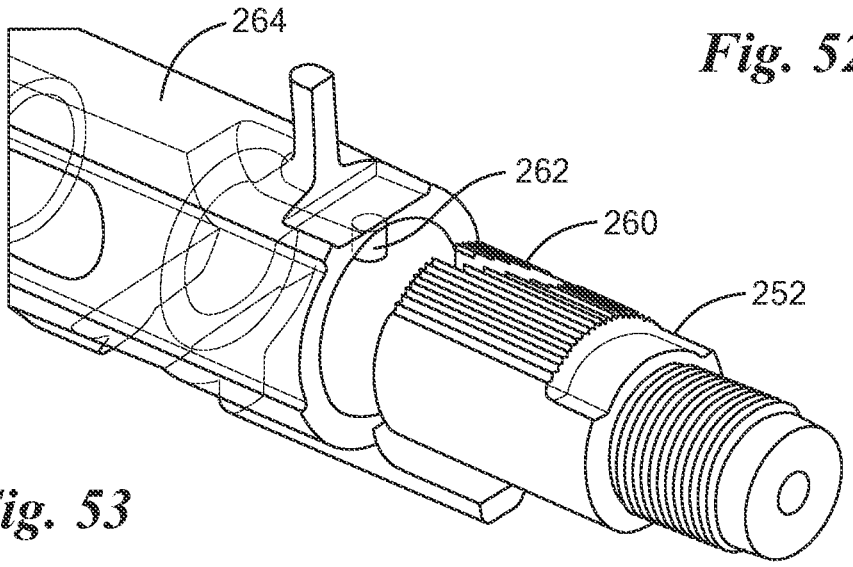
Figure 54:
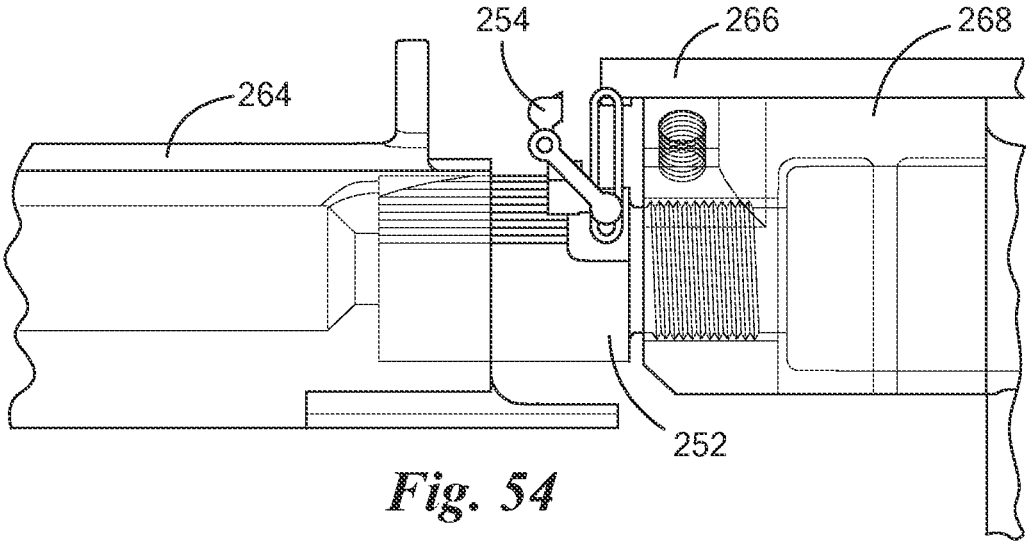

FIGS. 51-58 illustrate a second headspace reduction technique, which employs a ratchet mechanism 250 including a rotatable breech 252 and a latching clamp 254. As shown, the breech 252 includes outer teeth 256 that mate with corresponding teeth of the clamp 254. These teeth are mutually configured to permit clockwise rotation of the breech 252 (into the barrel extension) while preventing counter-clockwise rotation (out of the barrel extension), while the clamp 254 is closed and the teeth engaged. The clamp 254 pivots to open and close FIG. 51 shows the closed position and FIG. 52 shows the open position. As shown in FIG. 53, the breech 252 has an arcuate groove 260 that mates with a corresponding inward-facing roller 262 on the carrier 264, forming a camming arrangement by which the breech 252 is rotated by linear movement of the carrier 264. It will be appreciated that FIGS. 51-52 show the ratchet mechanism 250 facing in the direction opposite that shown in FIGS. 53-58.

Figure 55:
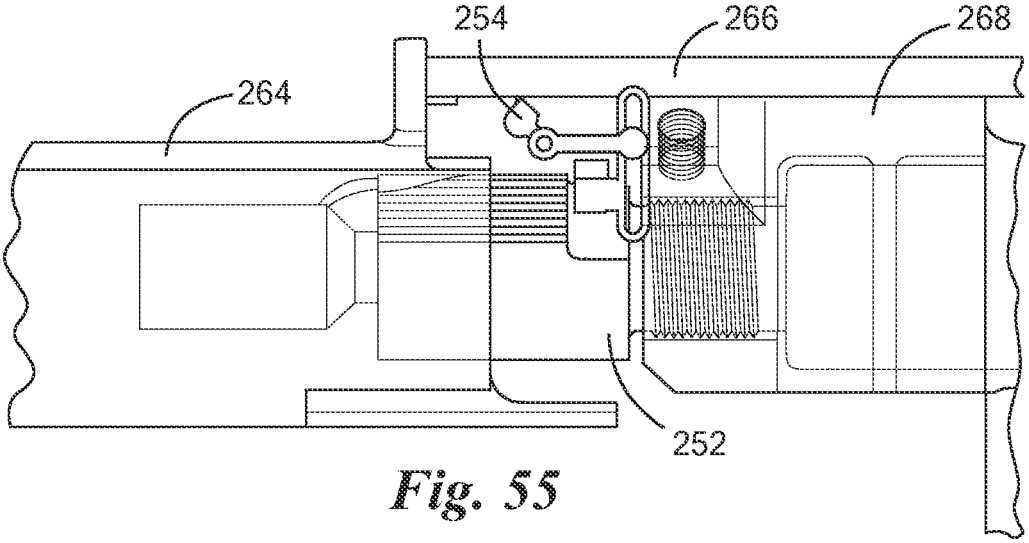
Figure 56:
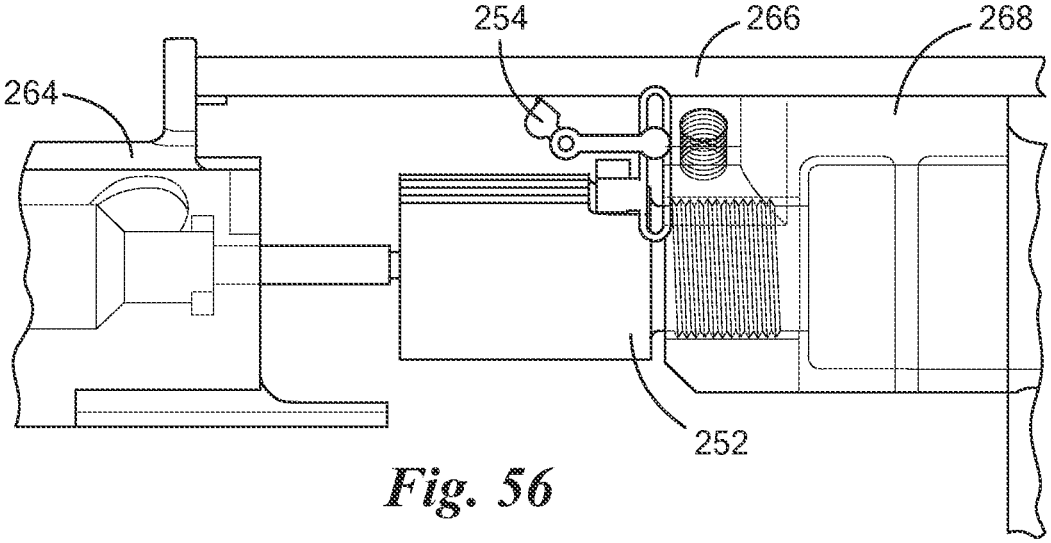
Figure 57:
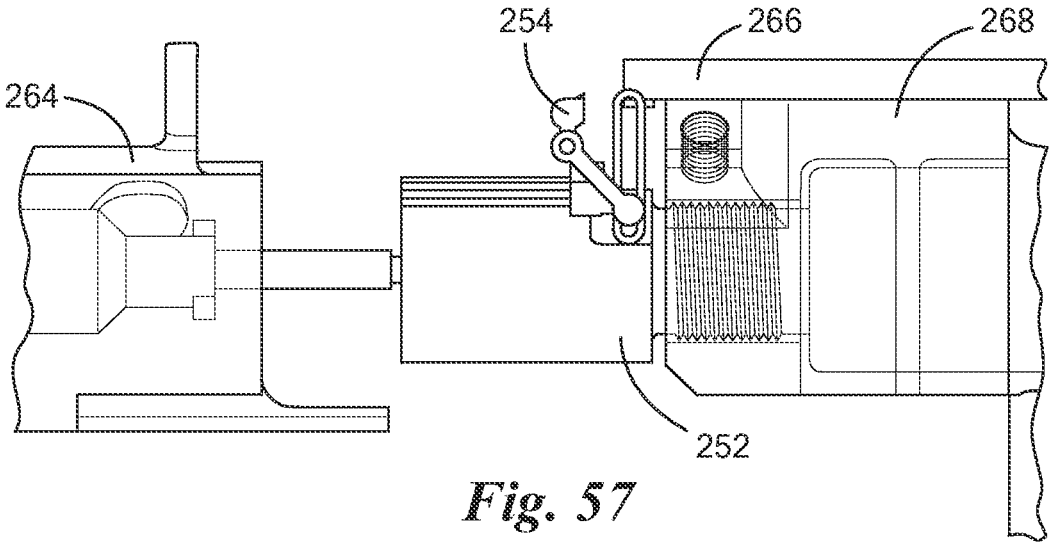
Figure 58:
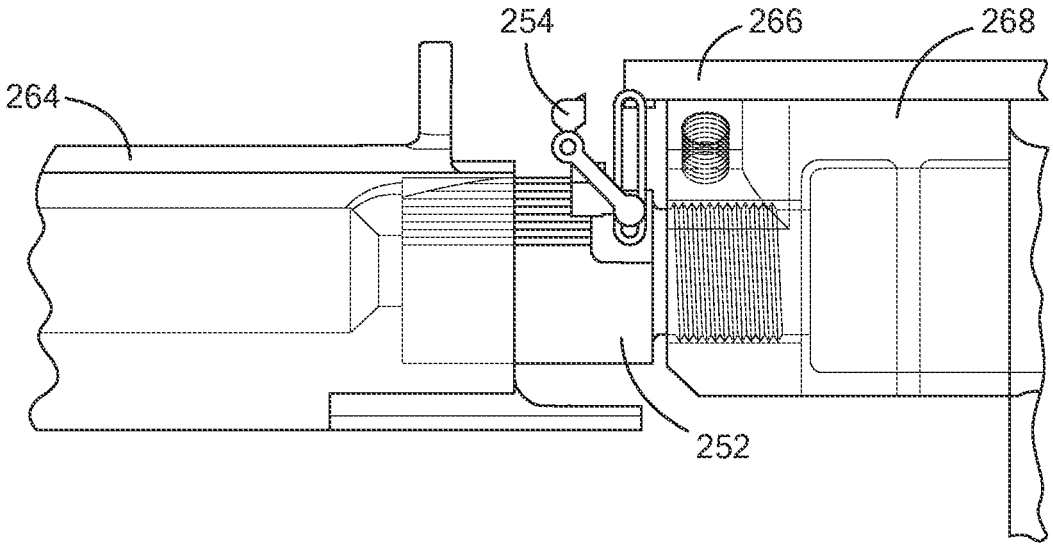
Figure 59:
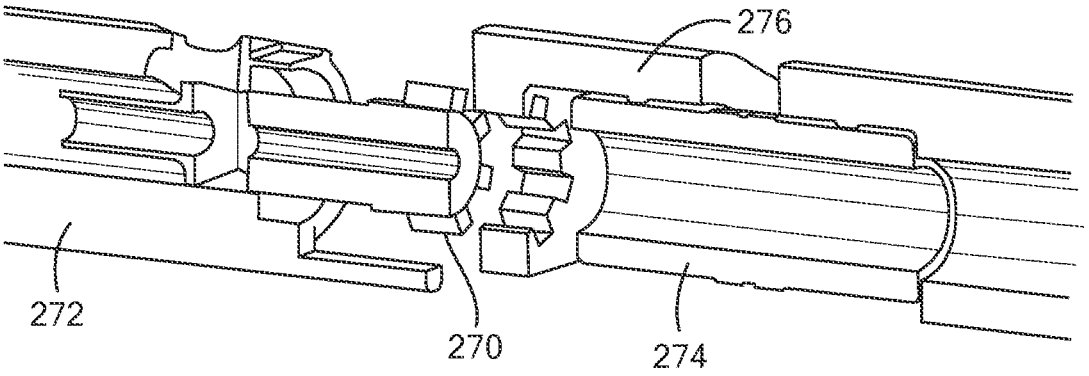
FIGS. 59-62 are views illustrating a third headspace reduction technique.
Figure 60:
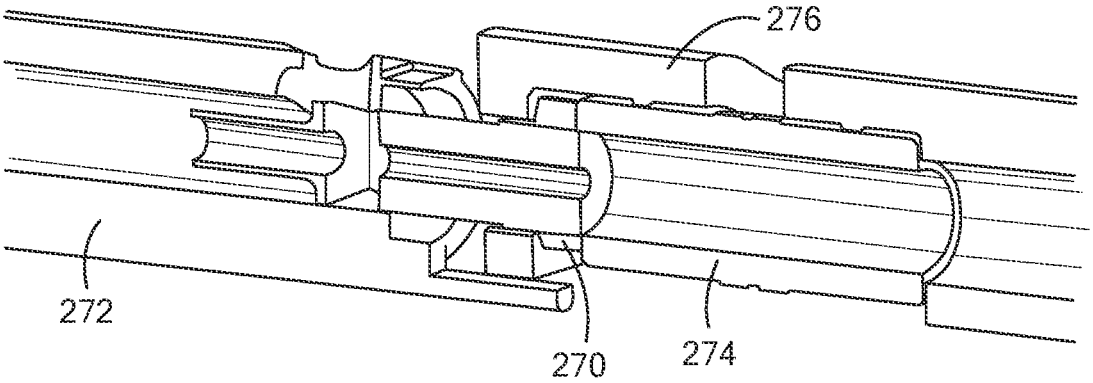

FIGS. 54-58 show operation, beginning with the carrier 264 in the battery position and the clamp 254 set, preventing the breech 252 from rotating CCW. FIGS. 55-56 illustrate recoil, in which the gas piston 266 slides across the upper part of the clamp 254, causing it to open by lifting its toothed portion away from the breech 252 as shown. FIG. 56 shows the end of recoil, in which the rearward movement of the carrier 264 has caused the breech 252 to rotate counter-clockwise (CCW) slightly out of the barrel extension 268. FIGS. 57-58 illustrate counter-recoil, which begins with both the gas piston 266 and clamp 254 being reset into the illustrated positions, re-setting the clamp 252 so that the teeth of the clamp 254 and breech 252 re-engage with each other. FIG. 58 shows the end of counter-recoil, in which the breech 252 has been rotated slightly CW into the barrel extension 268, closing up headspace around the chambered cartridge.

Figure 61:
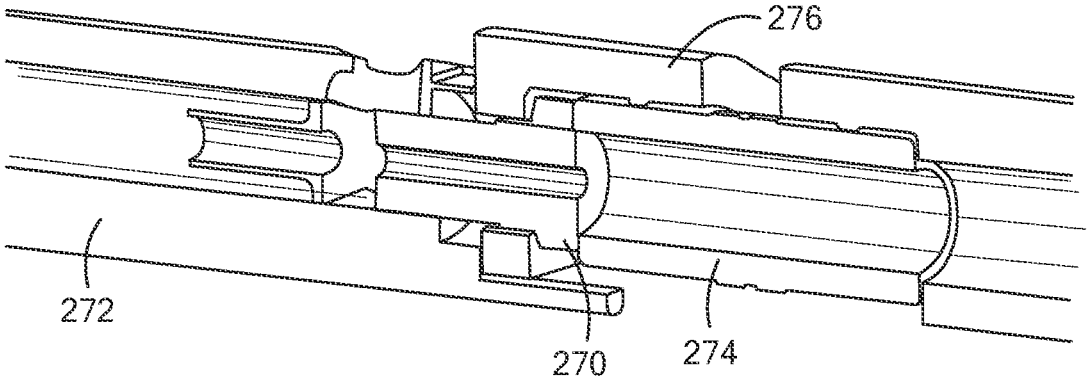
Figure 62:
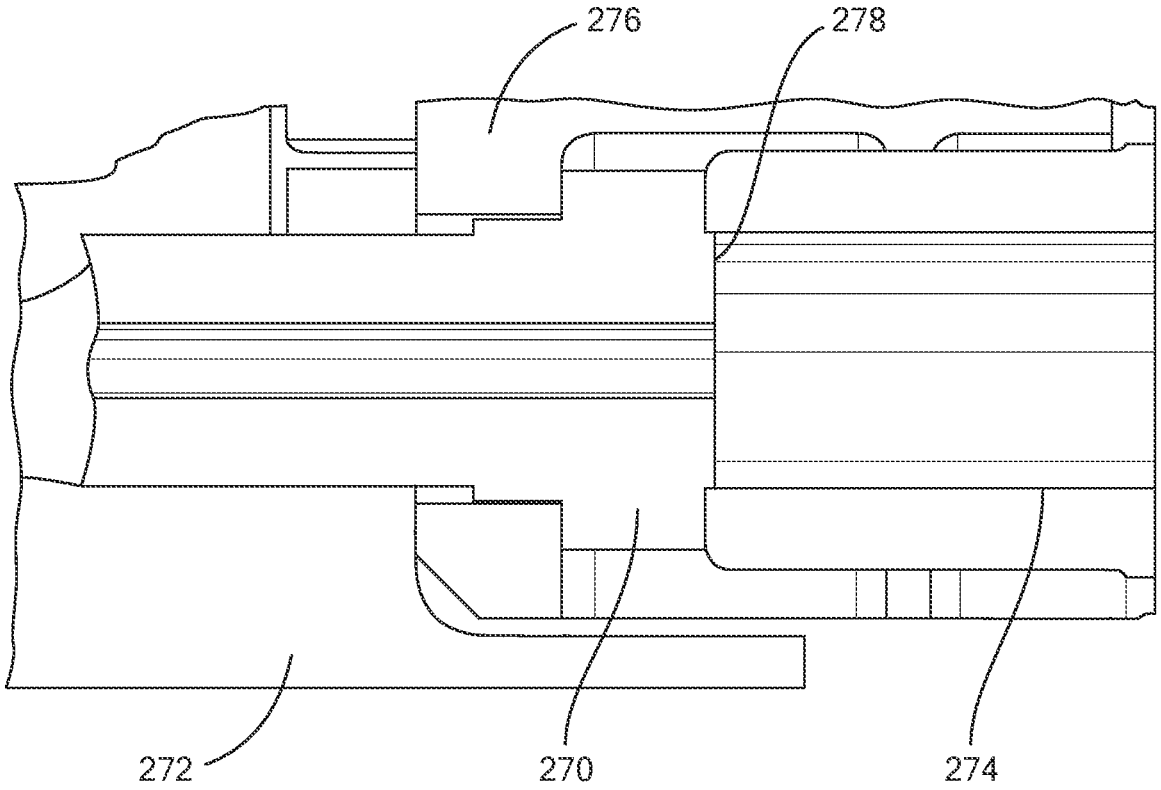
Figure 63R:
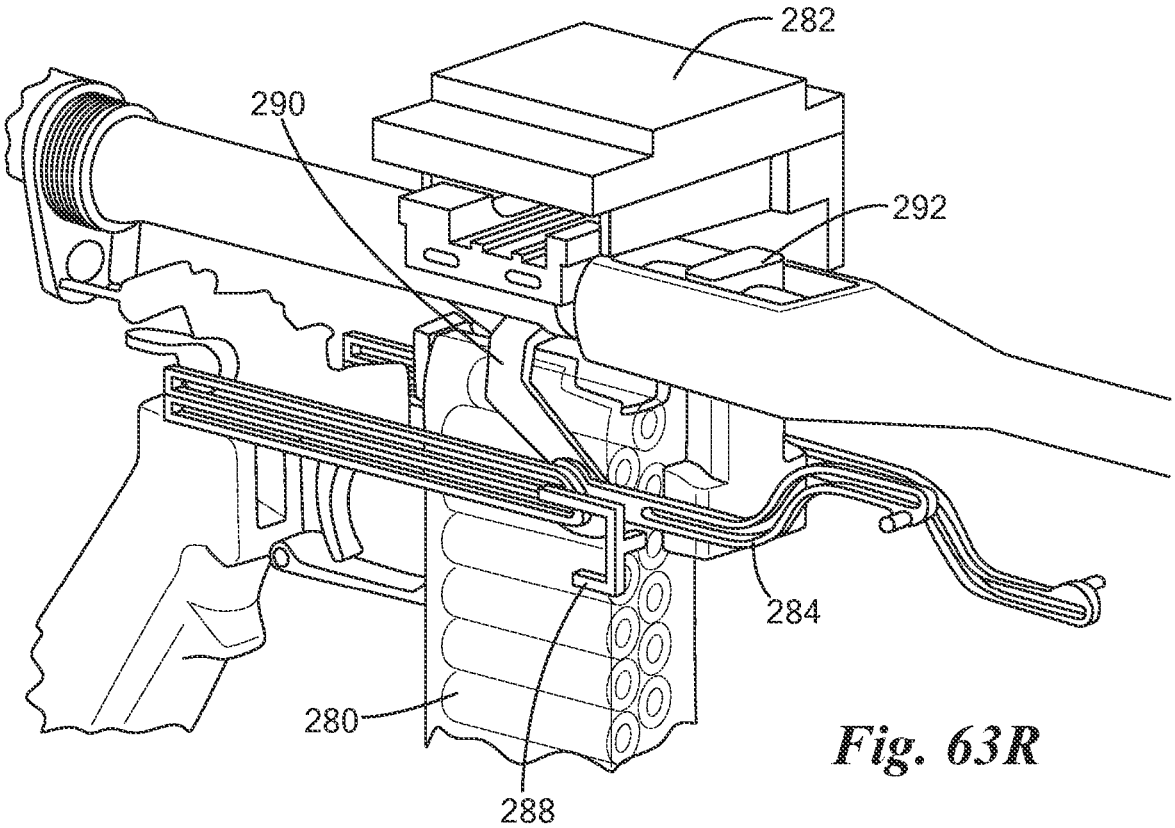
FIGS. 63R-68L are views illustrating a first dual feed mechanism.
Figure 63L:
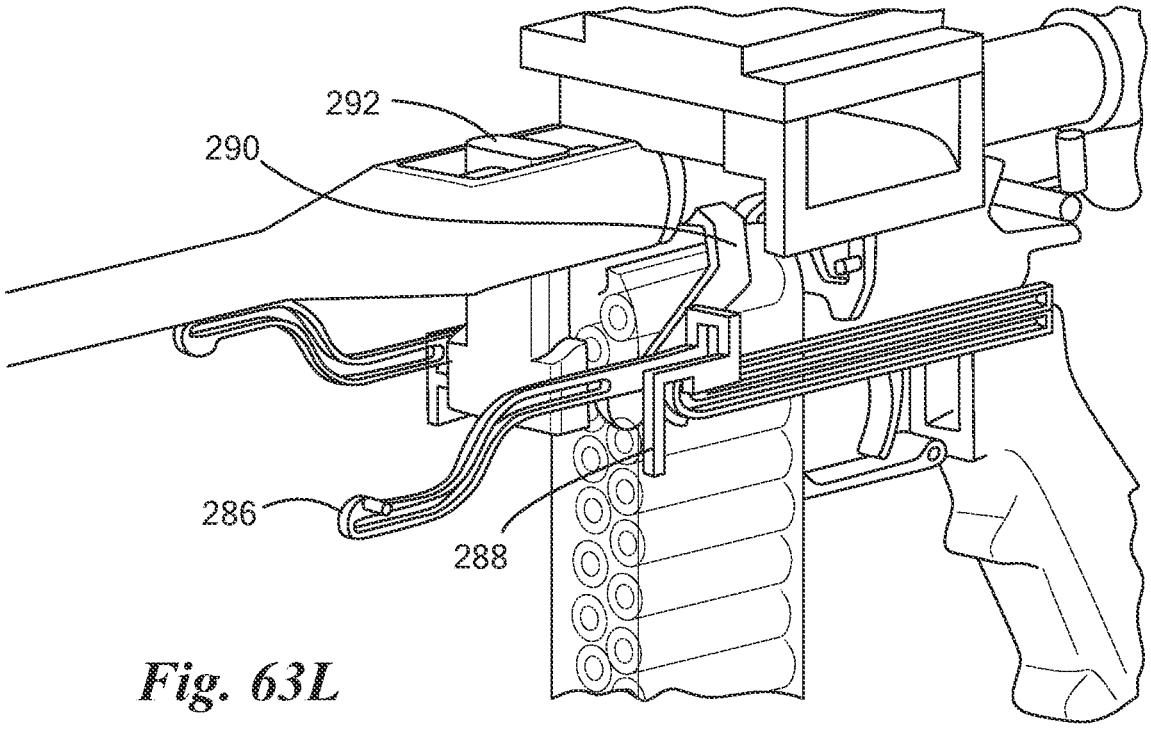
Figure 64R:
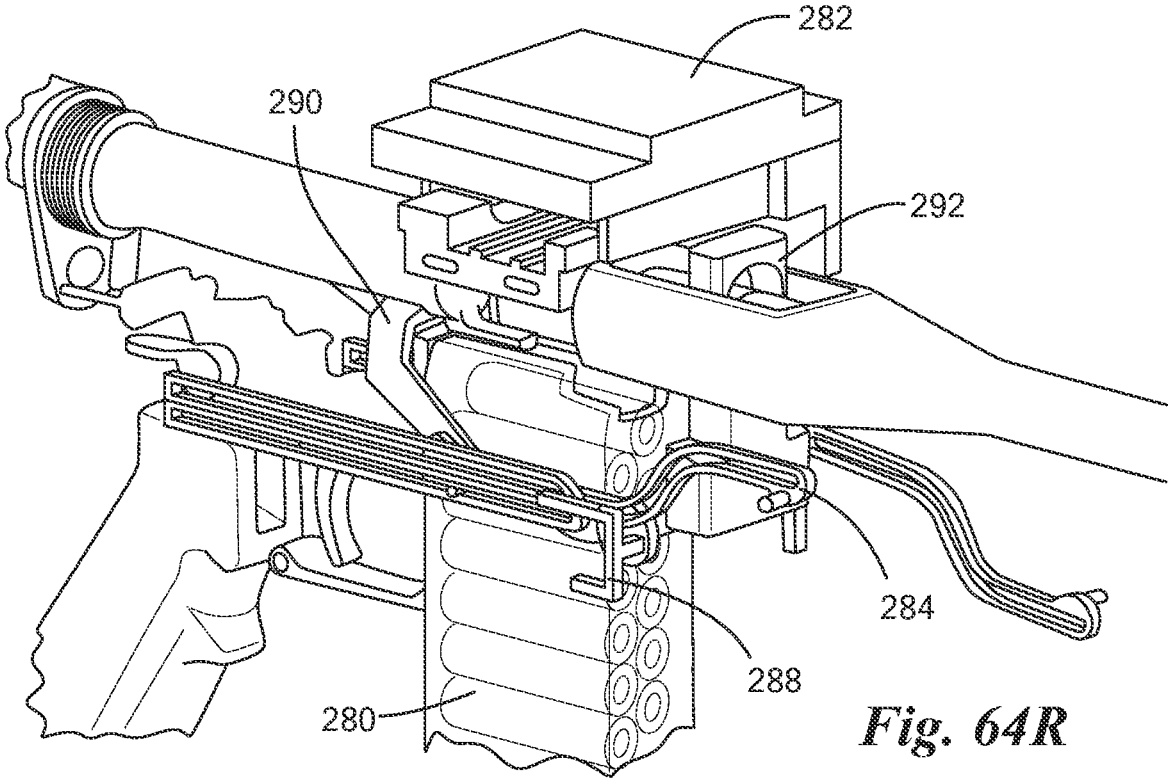
Figure 64L:
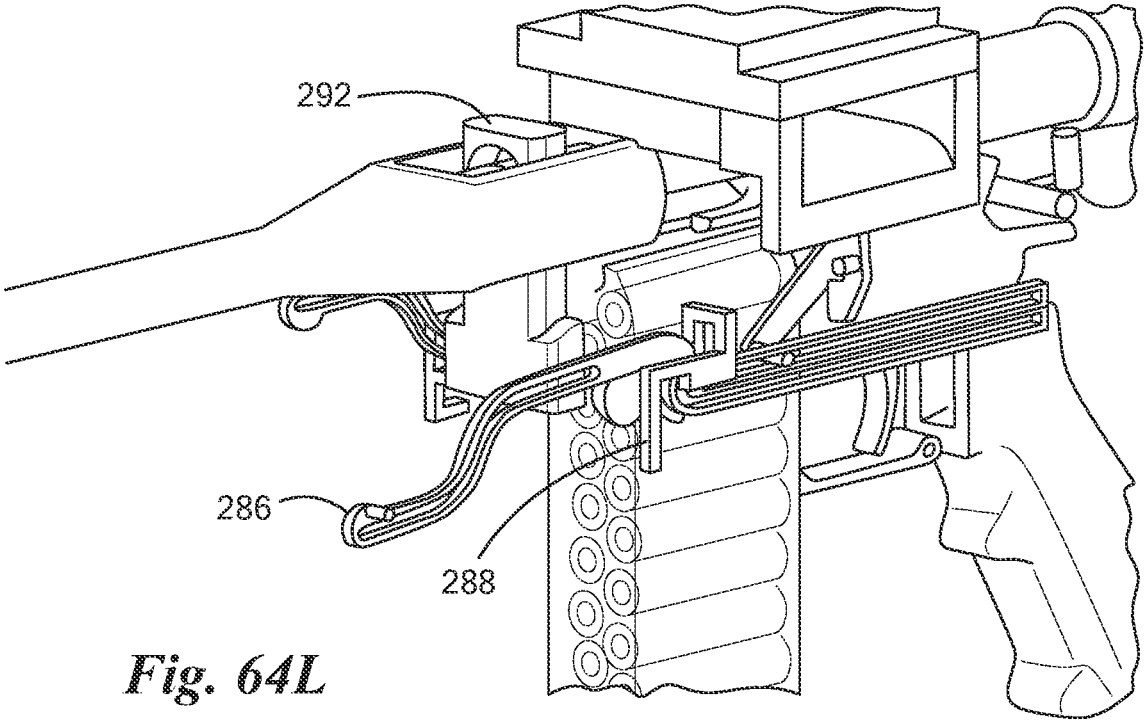
Figure 65R:
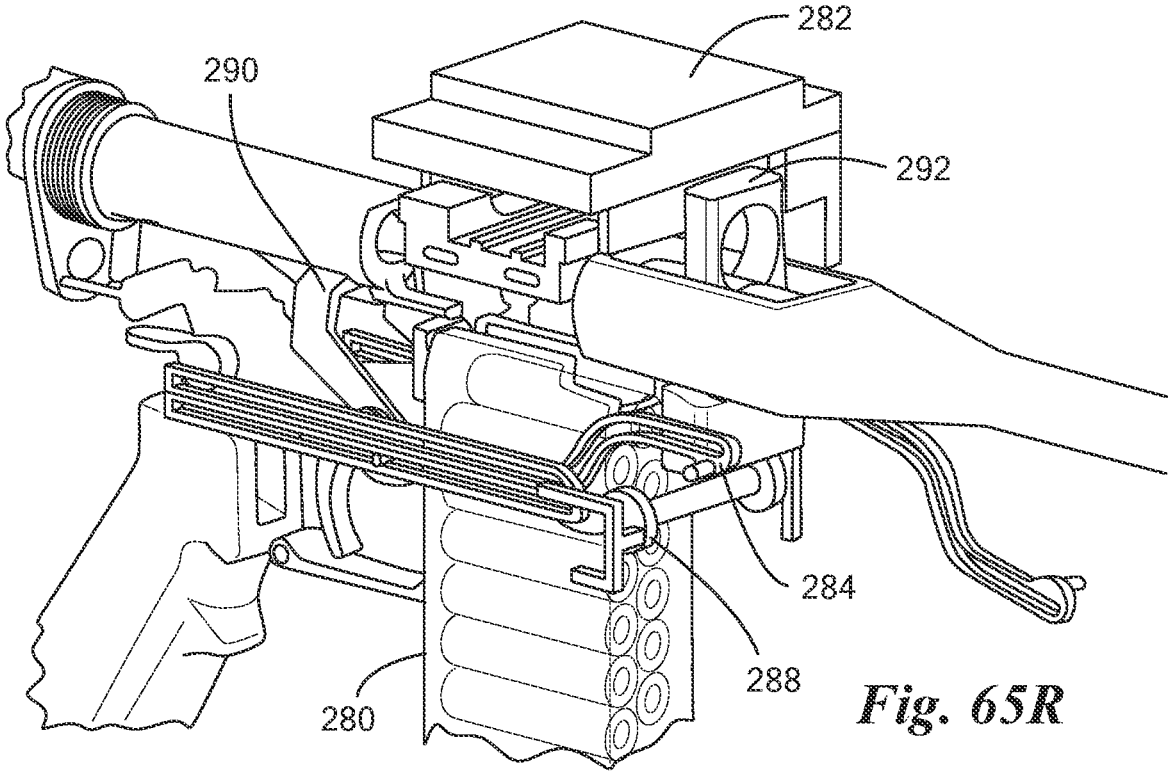
Figure 65L:
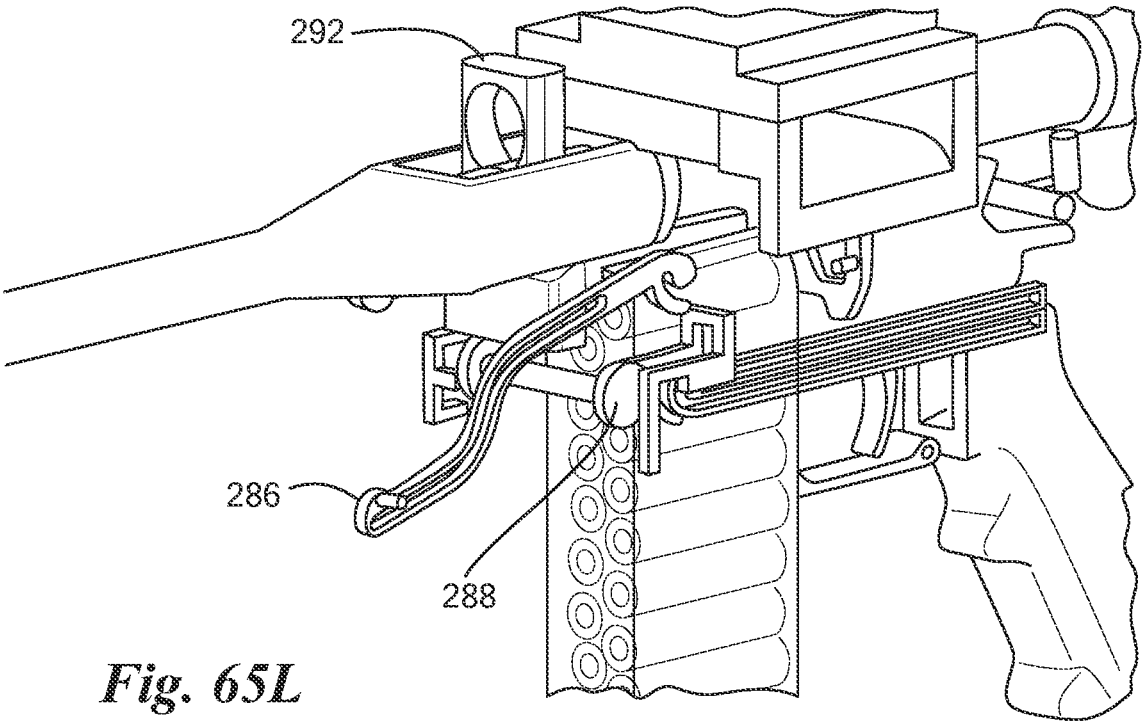
Figure 66:
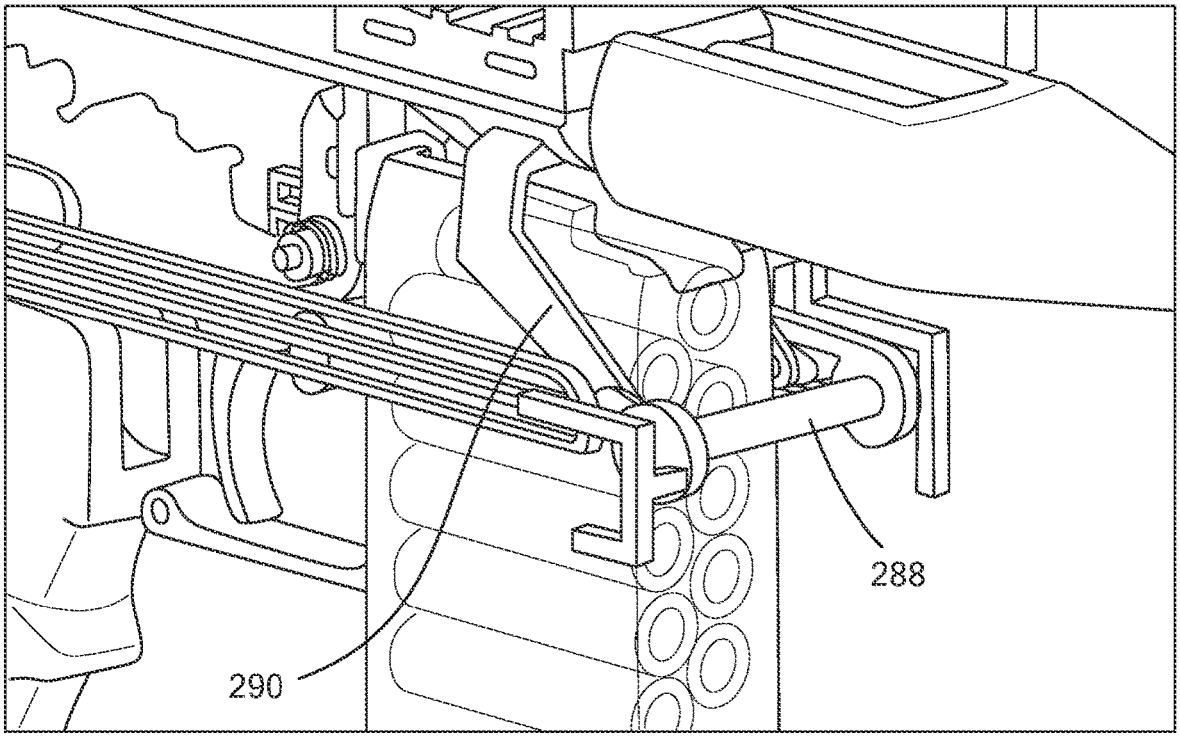
Figure 67R:
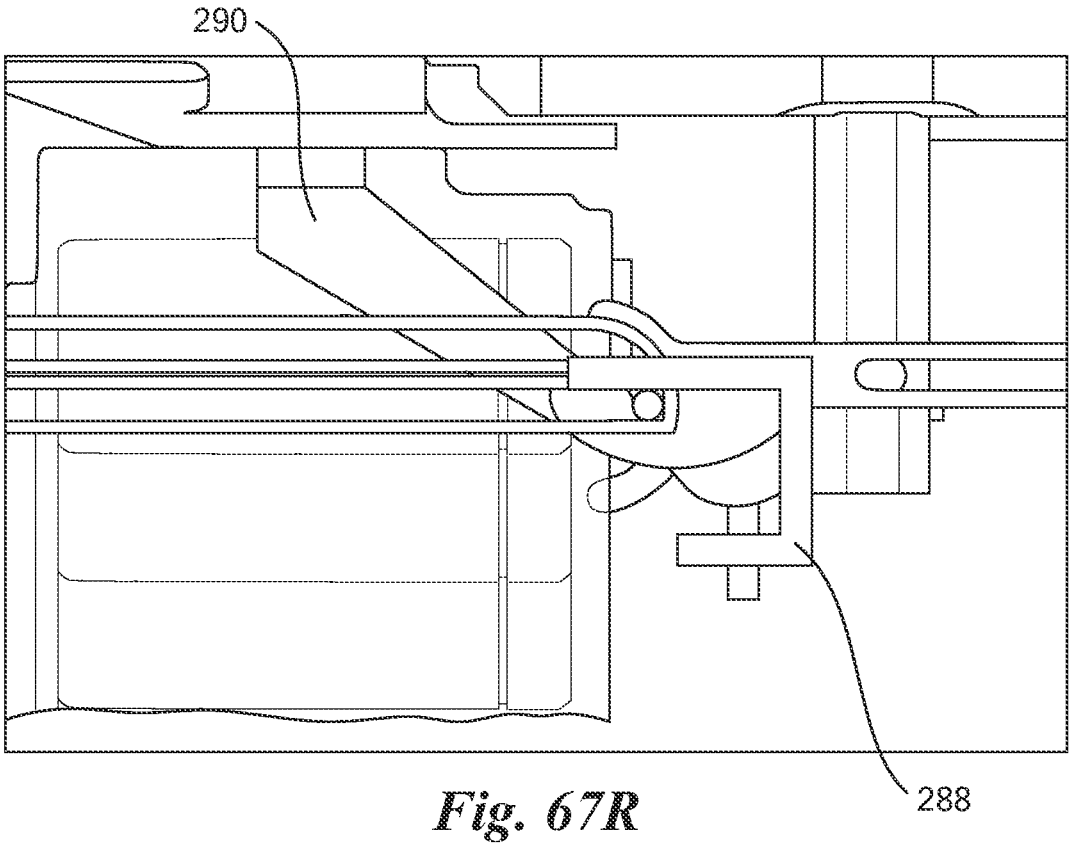
Figure 67L:
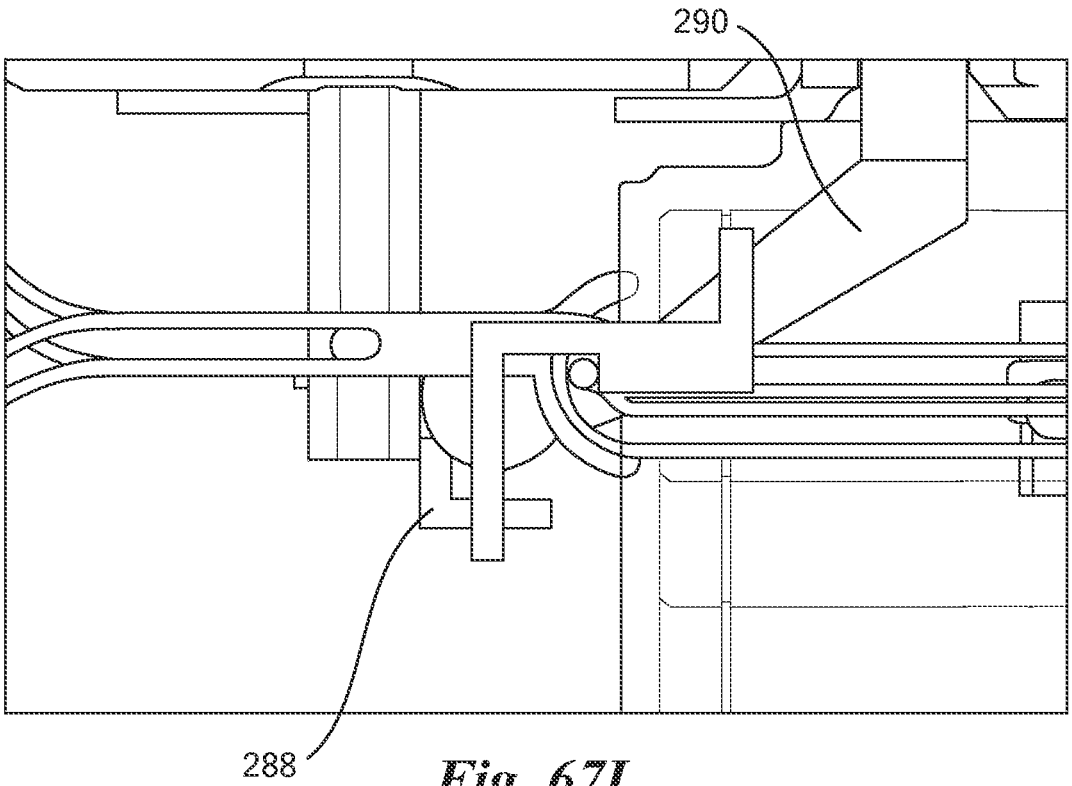

FIGS. 59-62 shows a third headspace reduction technique. A bolt 270 carried by a carrier 272 is moving forward within the firearm towards a chamber 274 during automatic loading of a CT cartridge (not shown) into the chamber 274. The bolt 270 moves forward such that its bolt lugs come into engagement with chamber lugs of the barrel extension 276. FIG. 61 shows the bolt 270 moved further into the barrel extension 276 and rotated such that bolt 270 is locked, e.g. at a time a CT cartridge (not shown) loaded in the chamber 274 is fired. FIG. 62 is a cross-sectional side view showing the locked bolt 270 and an example of a compression distance which is an amount that the bolt face 278 extends within the chamber 274 to compress a CT cartridge (not shown) that is located in the chamber 274, prior to firing the CT cartridge, in order to reduce and/or eliminate headspace.

Figure 68R:
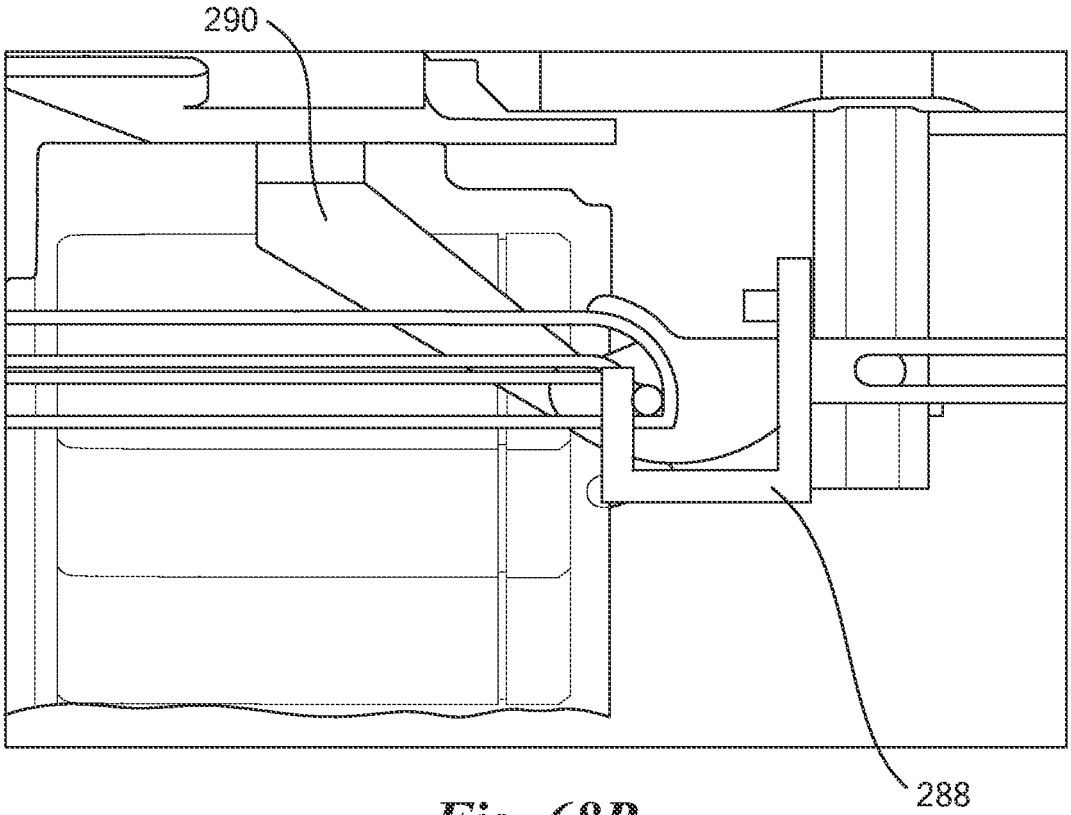
Figure 68L:
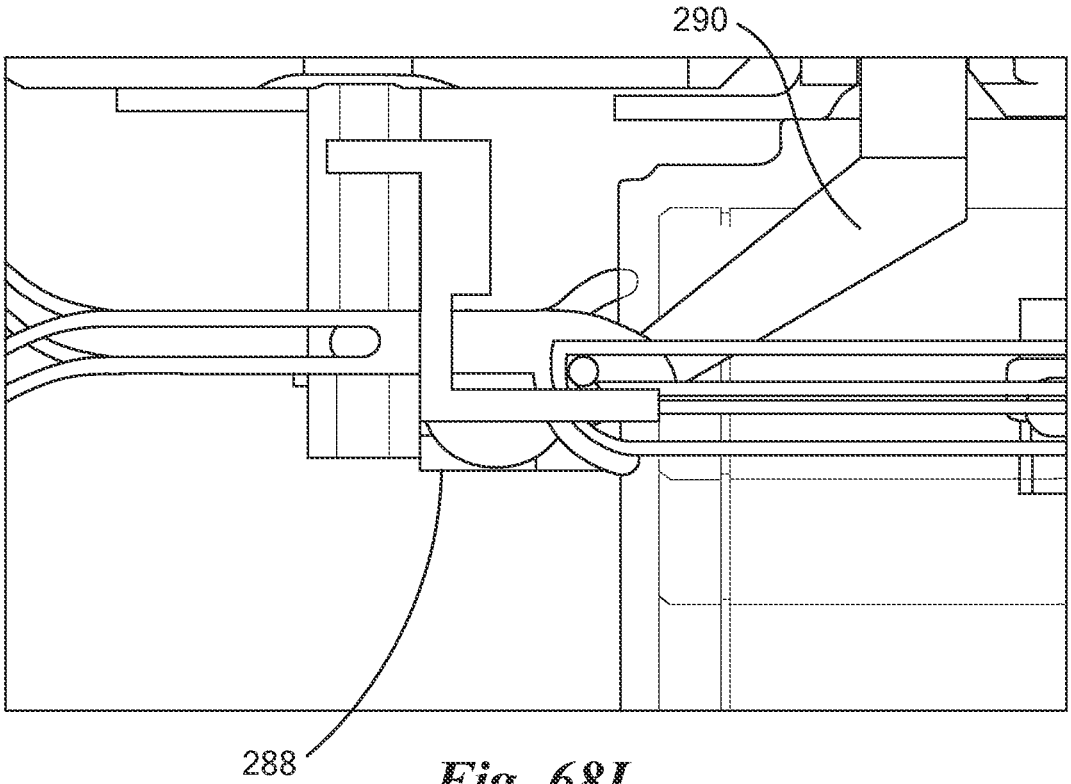

FIGS. 63R-68L illustrate a dual-feed technique enabling a weapon to be fed with ammunition either from a magazine 280 or from a belt via a belt feed tray 282. Structure includes a belt feed cam 284, a magazine feed cam 286, and feed mode lock 288. FIGS. 63R, 64R, 65R, 67R, and 68R depict the structure on the shooter's right side of the weapon, while FIGS. 63L, 64L, 65L, 67L, and 68L depict the structure on the shooter's left side of the weapon. In magazine feed mode the magazine feed cam 286 is engaged with the slide 290 and moves the chamber carrier 292 downward from the firing position (FIGS. 63R-63) to the ejection/loading position, similar to the operation described above. In the illustrated belt feed mode, the belt feed cam 284 is engaged with the slide 290 to move chamber carrier 292 upward to the ejection/loading position (FIGS. 65R-65L). The feed mode lock 288 is rotated 90 degrees for mode selection, causing the slide 290 to engage either the belt feed cam 284 or the magazine feed cam 286. FIGS. 67R-67L shows belt feed mode locked, and FIGS. 68R-68L show magazine feed mode locked.

Figure 69:
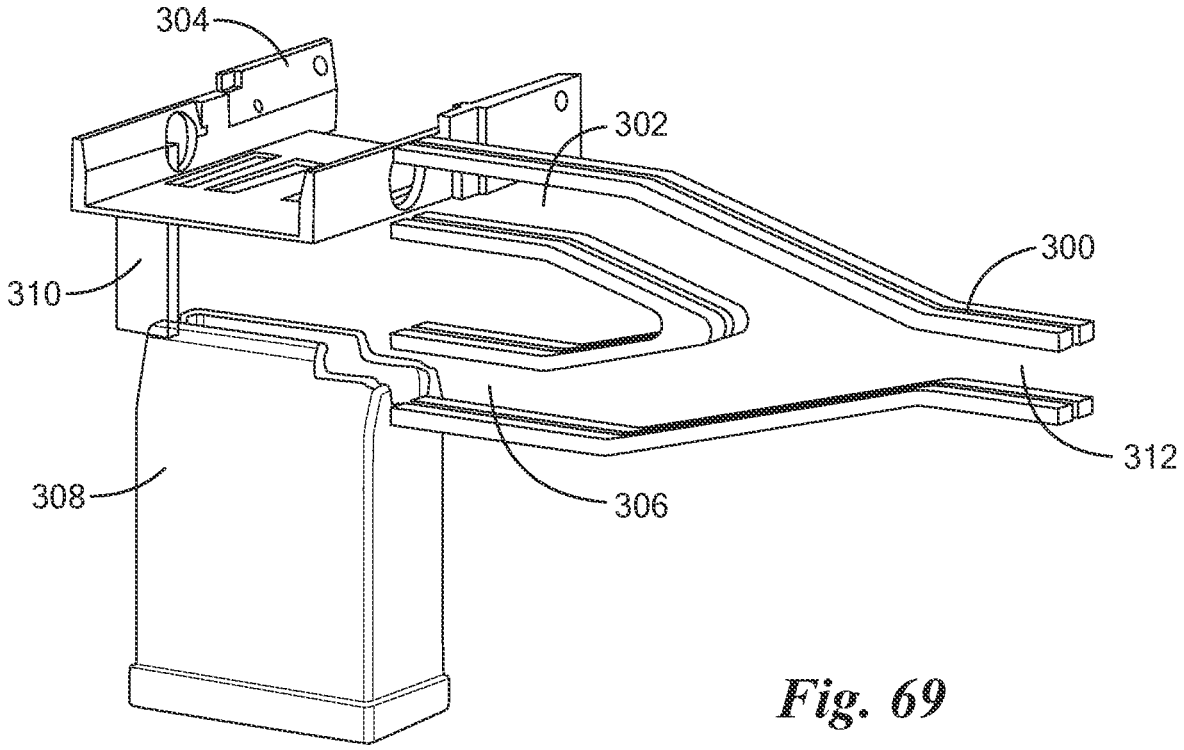
FIGS. 69-71 are views illustrating a second dual feed mechanism.
Figure 70:
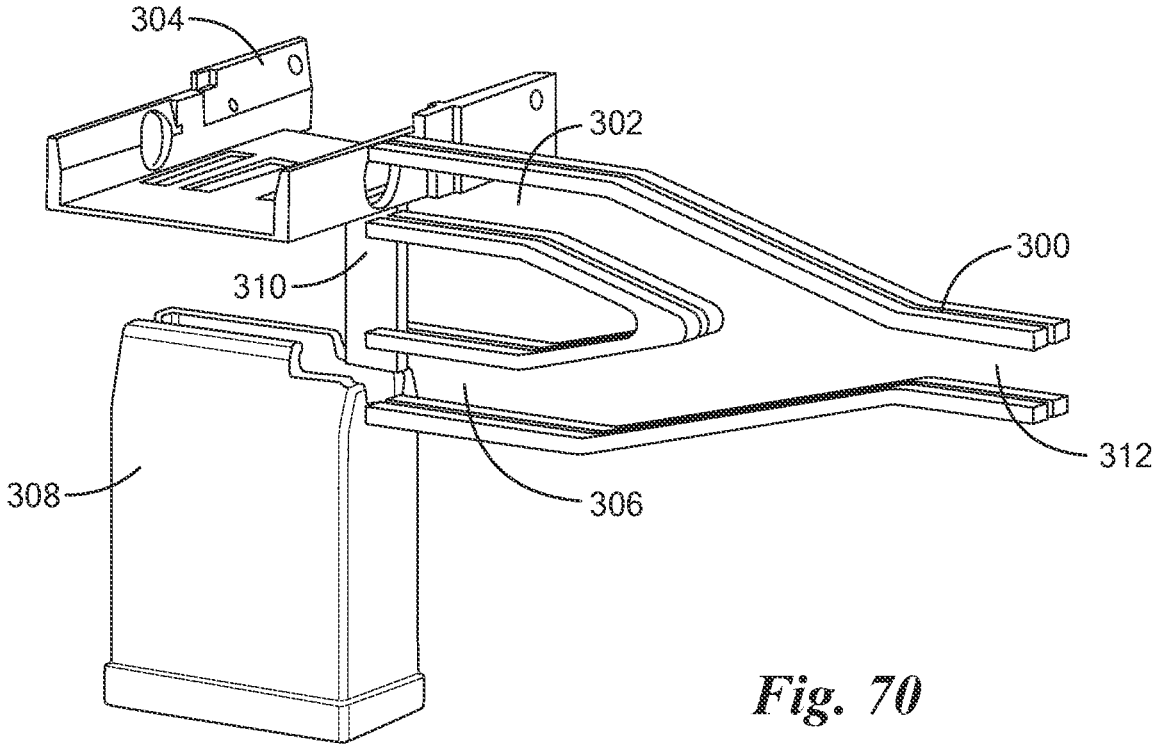
Figure 71:
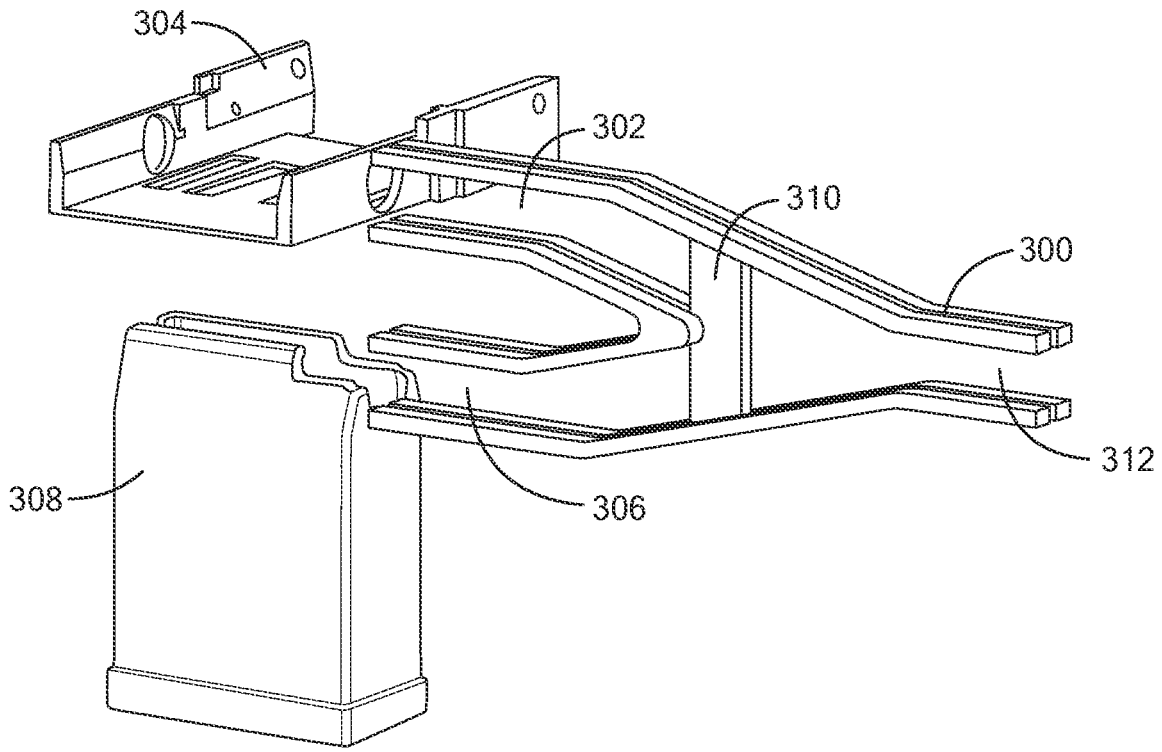

FIGS. 69-71 illustrate an alternative dual feed technique employing a Y-shaped ramp member 300. An upper ramp channel 302 is adjacent a belt feeder 304, and a lower ramp channel 306 is adjacent a feed area of a magazine 308. In operation, a vertical ramming member 310 moves forward during counter-recoil, for example by action of a carrier (not shown), pushing a cartridge (not shown) from either the magazine 308 or a belt (not shown), whichever is loaded, along a corresponding ramp channel 306 or 302. As the round is pushed forward, it travels a respective sloped area and then into the single exit channel 312 of the ramp member 310, into a chamber (not shown).

Figure 72:
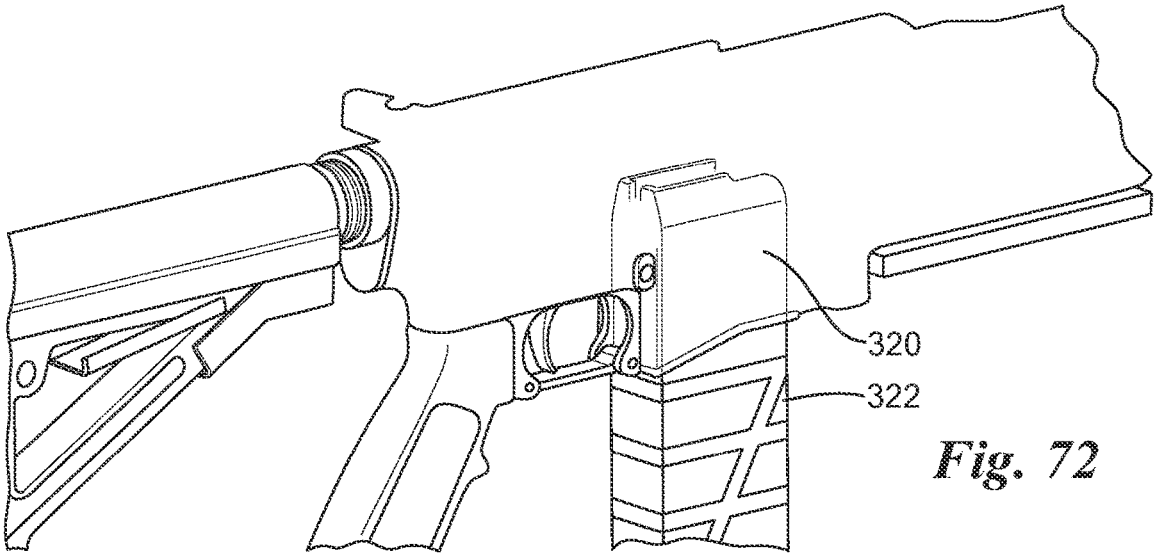
FIGS. 72-74 are views illustrating a third dual feed mechanism.
Figure 73:
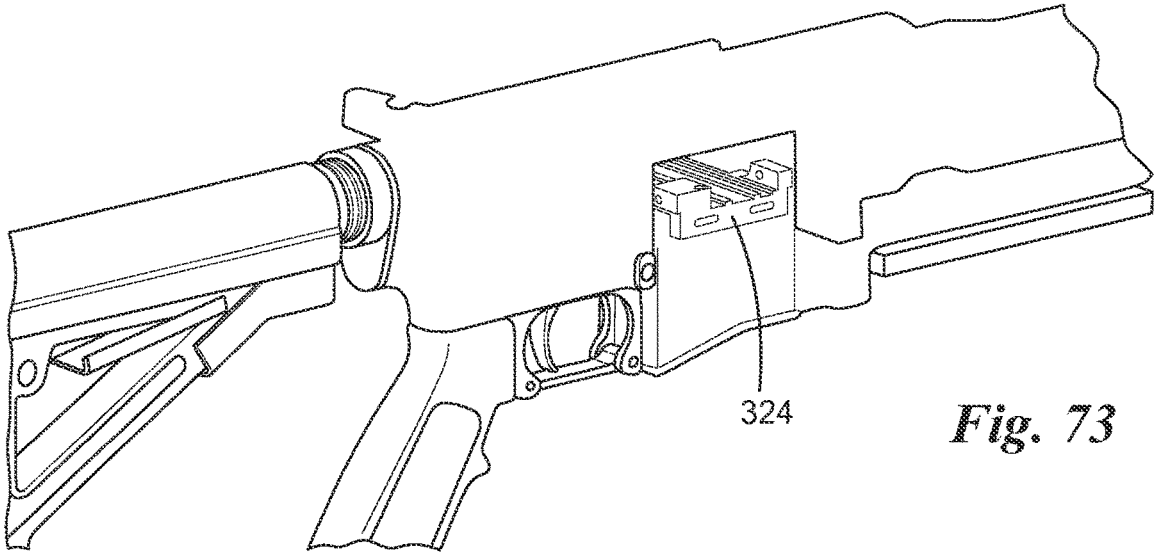
Figure 74:
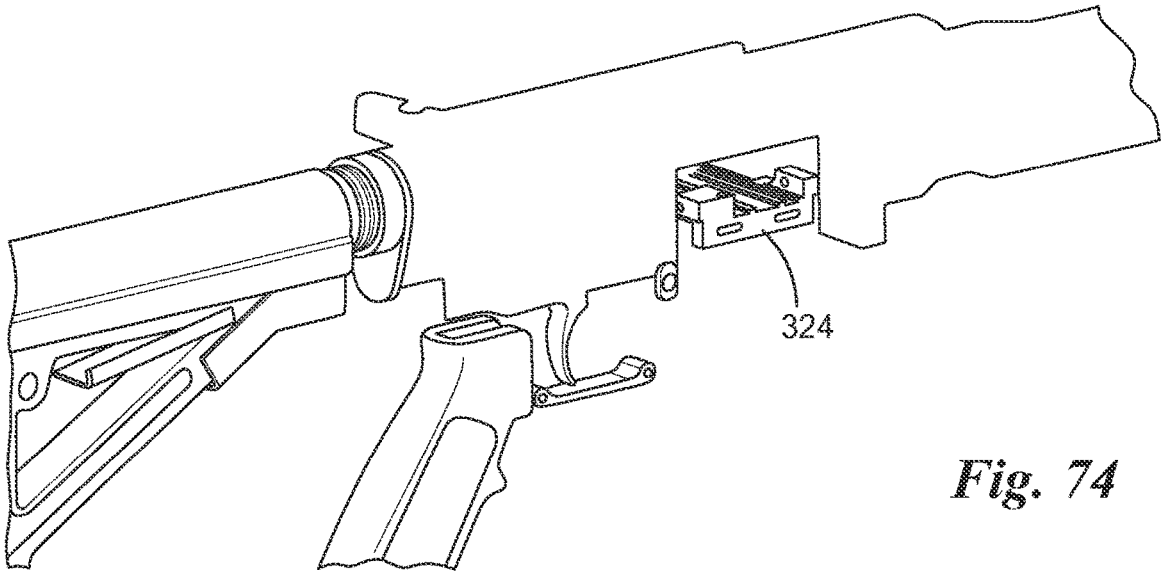
Figure 75S:
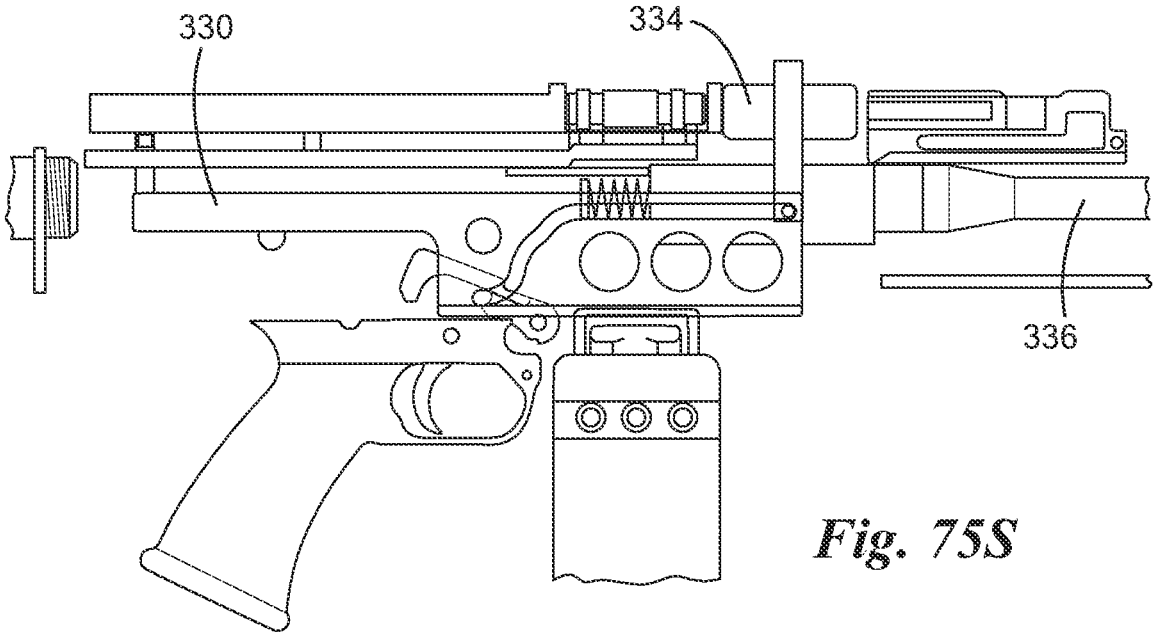
FIGS. 75S-82T are views illustrating a carbine with belt feed.
Figure 75T:
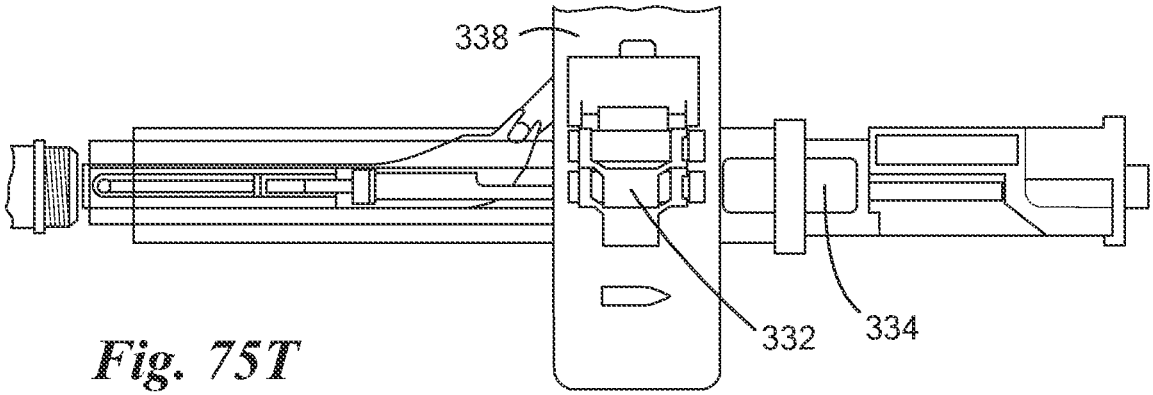
Figure 76S:
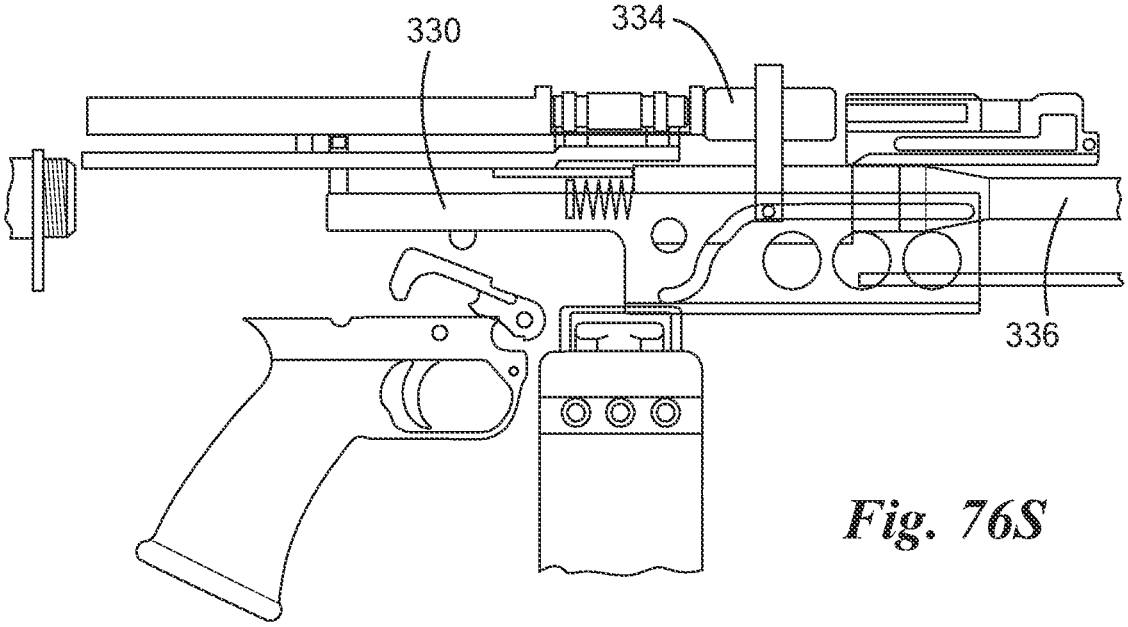
Figure 76T:
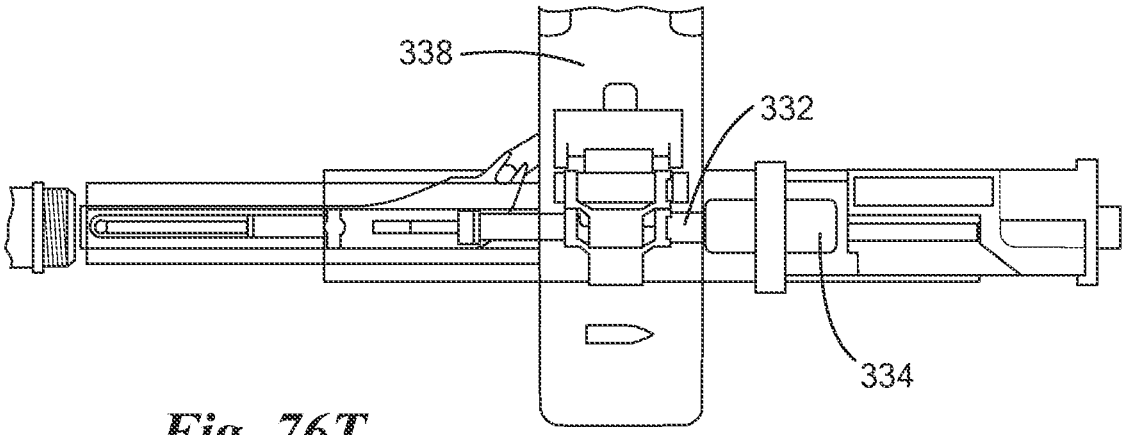
Figure 77S:
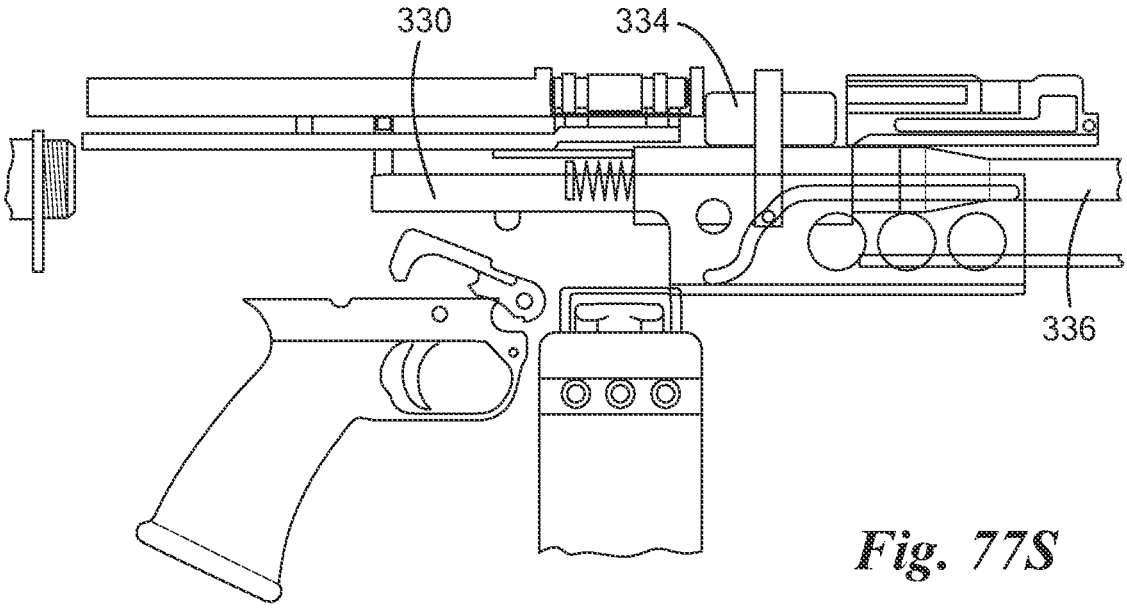
Figure 77T:
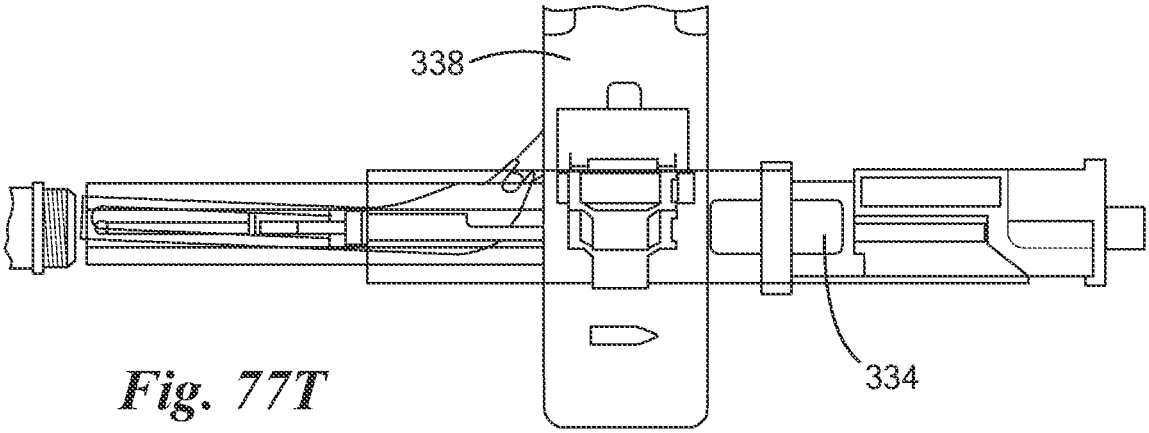
Figure 78S:
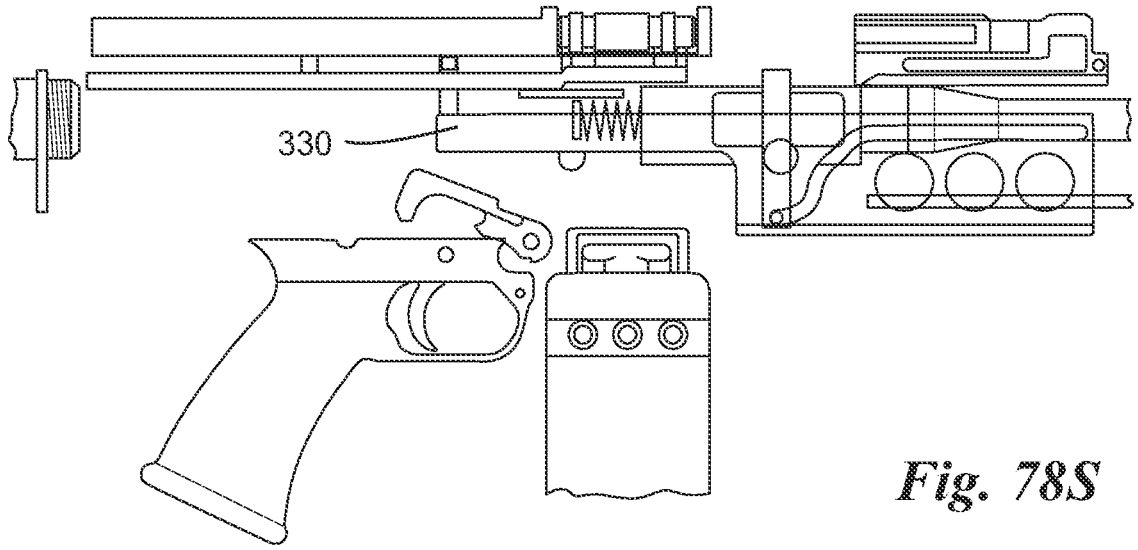
Figure 78T:
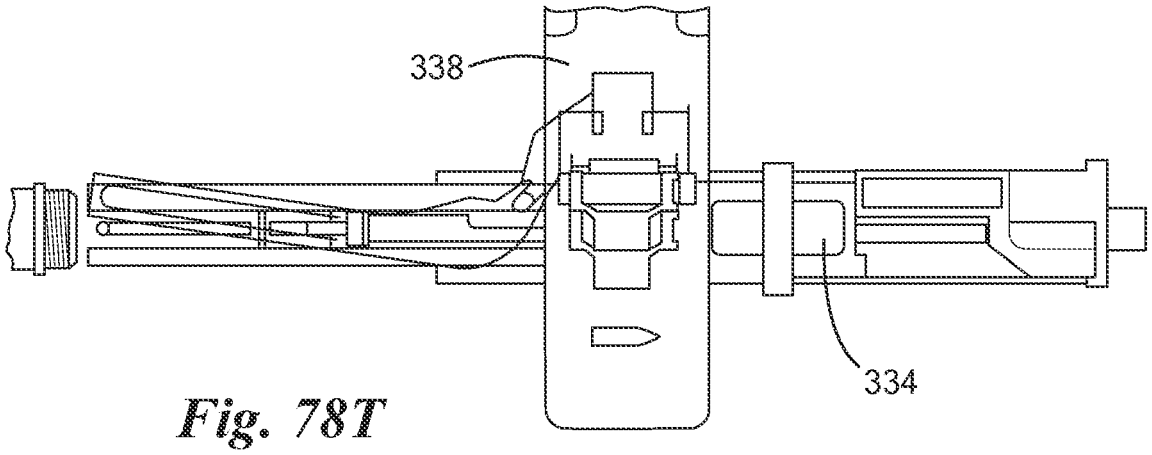
Figure 79S:
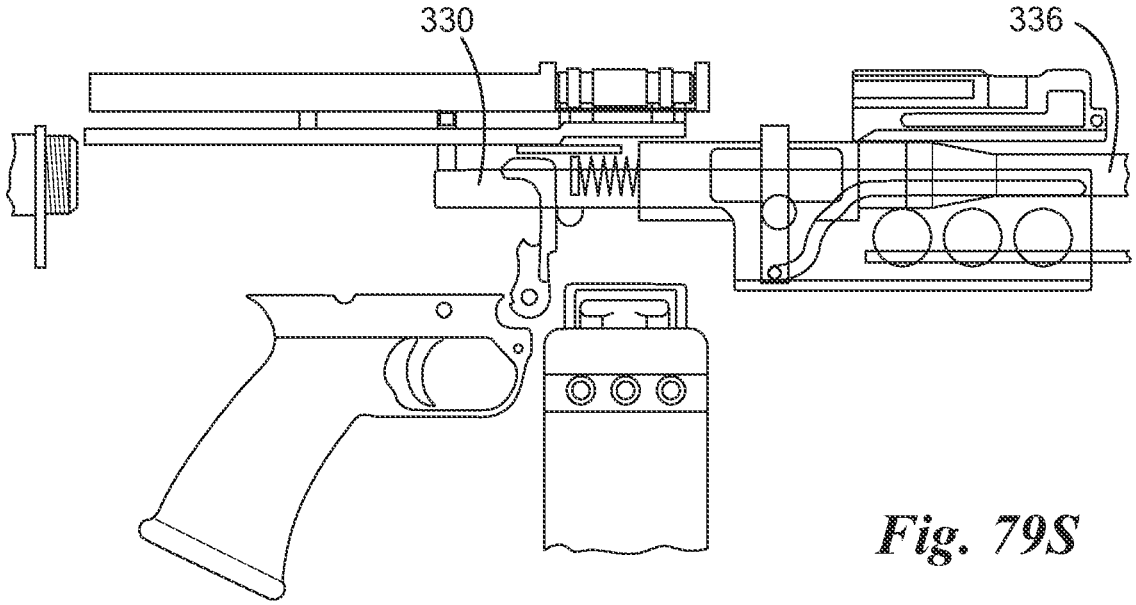
Figure 79T:
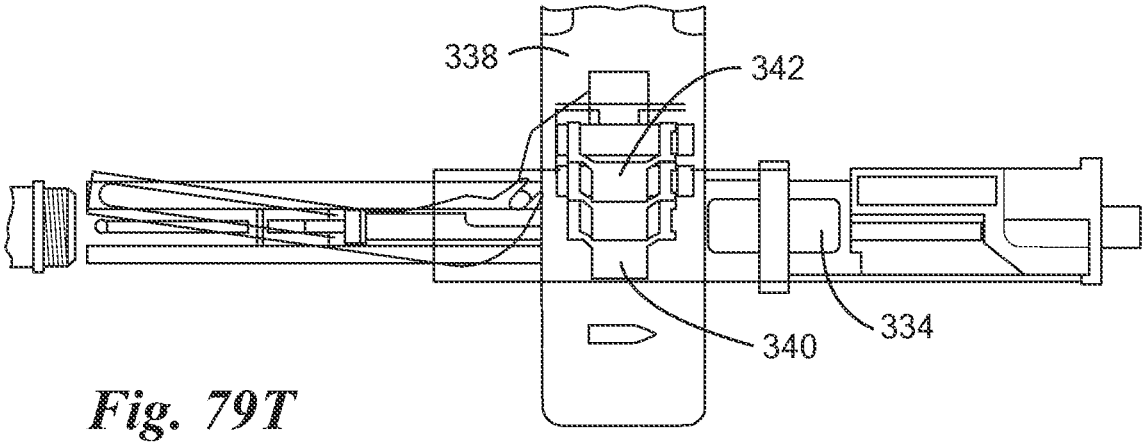
Figure 80S:
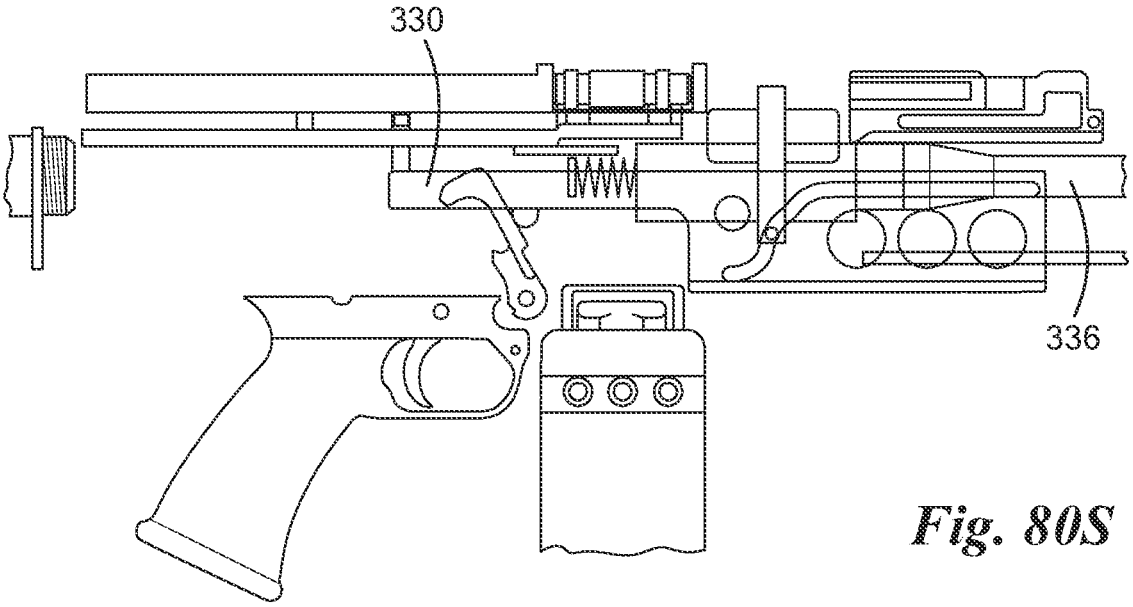
Figure 80T:
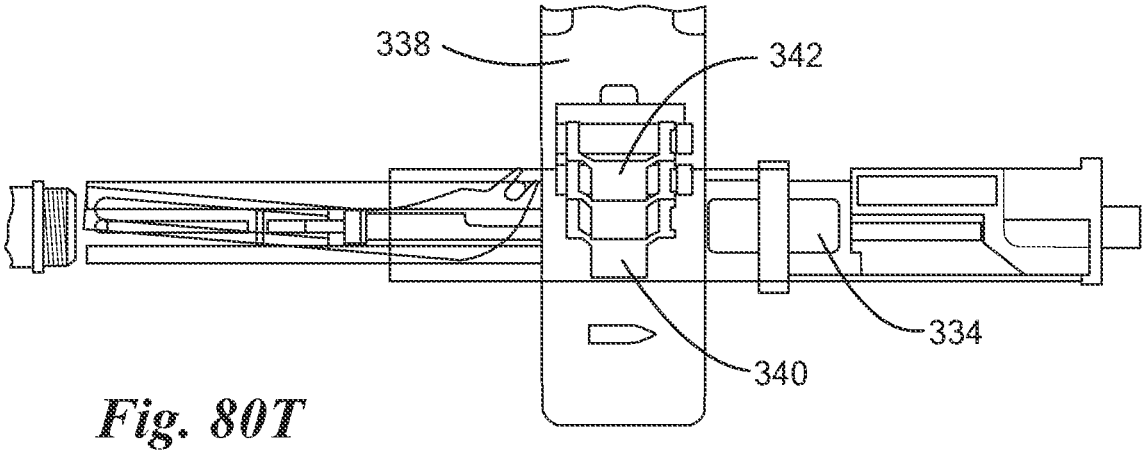
Figure 81S:
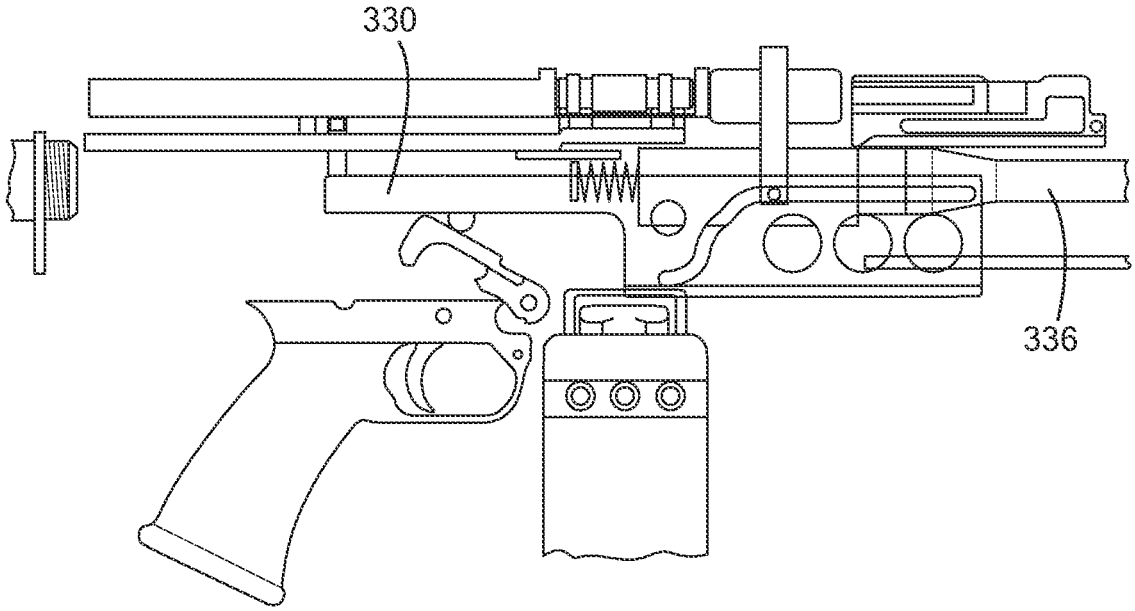
Figure 81T:
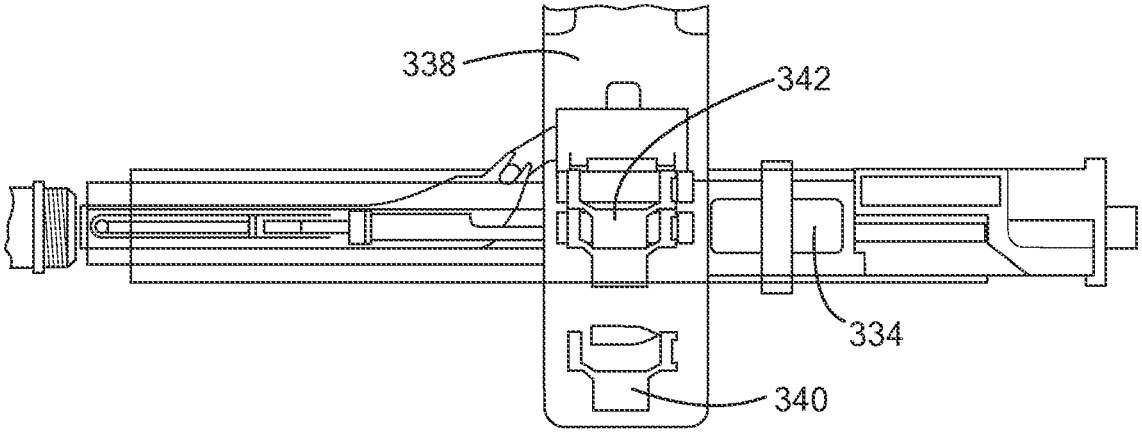
Figure 82S:
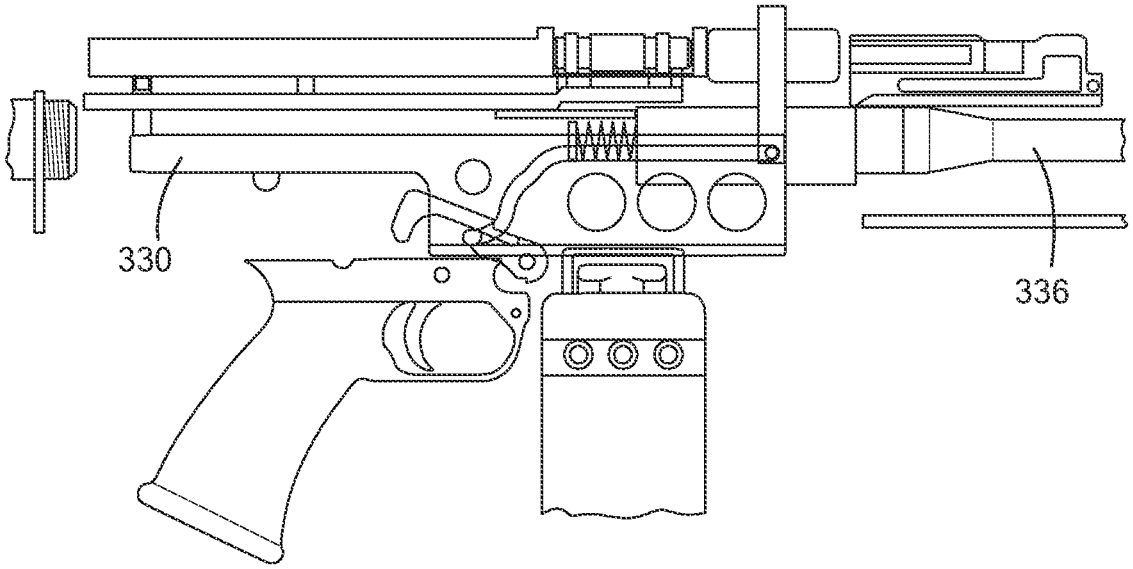
Figure 82T:
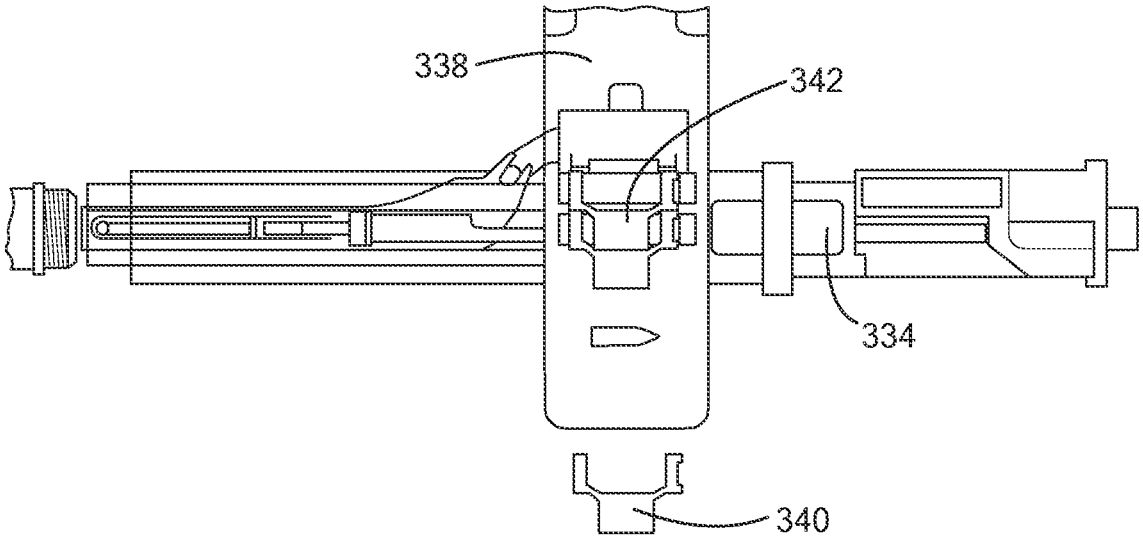

FIGS. 72-74 show an alternative dual feed technique in which the magazine well 320 is configured to receive either a magazine 322 (FIG. 72) or a belt feeder 324 (FIGS. 73-74). In FIG. 74 the lower receiver is made invisible to reveal detail of the belt feeder 324. FIGS. 75S-82T illustrate structure and functionality for a belt-fed carbine. Those Figures whose numbers end in "S" are side views, while those ending in "T" are corresponding top views, each at the same time as the corresponding "S" figure. Thus FIGS. 75S and 75T depict the same instant in time, etc. FIGS. 75S-78T depict feeding during counter-recoil, during which a slide 330 moves forward, ramming a cartridge 332 into a chamber of a chamber member 334 and then lowering the chamber member 334 into a firing position aligned with the barrel 336. FIGS. 79S-82T depict recoil, during which the slide 330 moves rearward, indexing the belt feeder 338 to eject a spent link 340 and move a next cartridge 342 into the ramming position for ramming in the subsequent counter-recoil movement. The rammer is a disconnecting rammer, locked in to the bolt on counter recoil. A latch is cammed up after a cartridge is fed, allowing the rammer to be pulled rearward by a spring.

FIGS. 83-105 show several alternative carbines having respective mechanical/functional arrangements. Generally, these all include rearward feed, also referred to as "aft feed", which contributes to reducing weapon length. Specific aspects and advantages of each variation are described.

Figure 83:
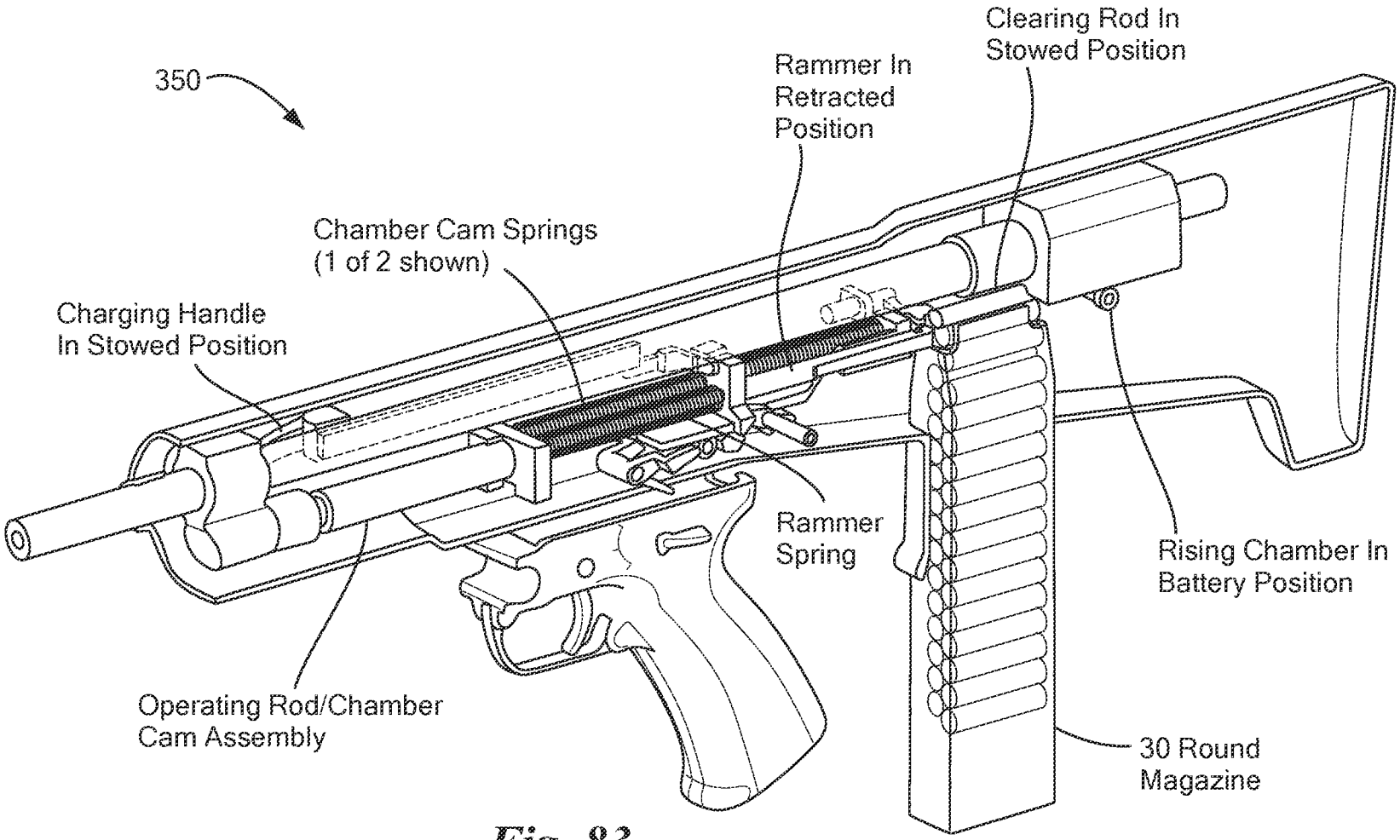
FIGS. 83-105 are views illustrating alternative carbine layouts generally involving rearward (aft) feed and other variations.
Figure 84:
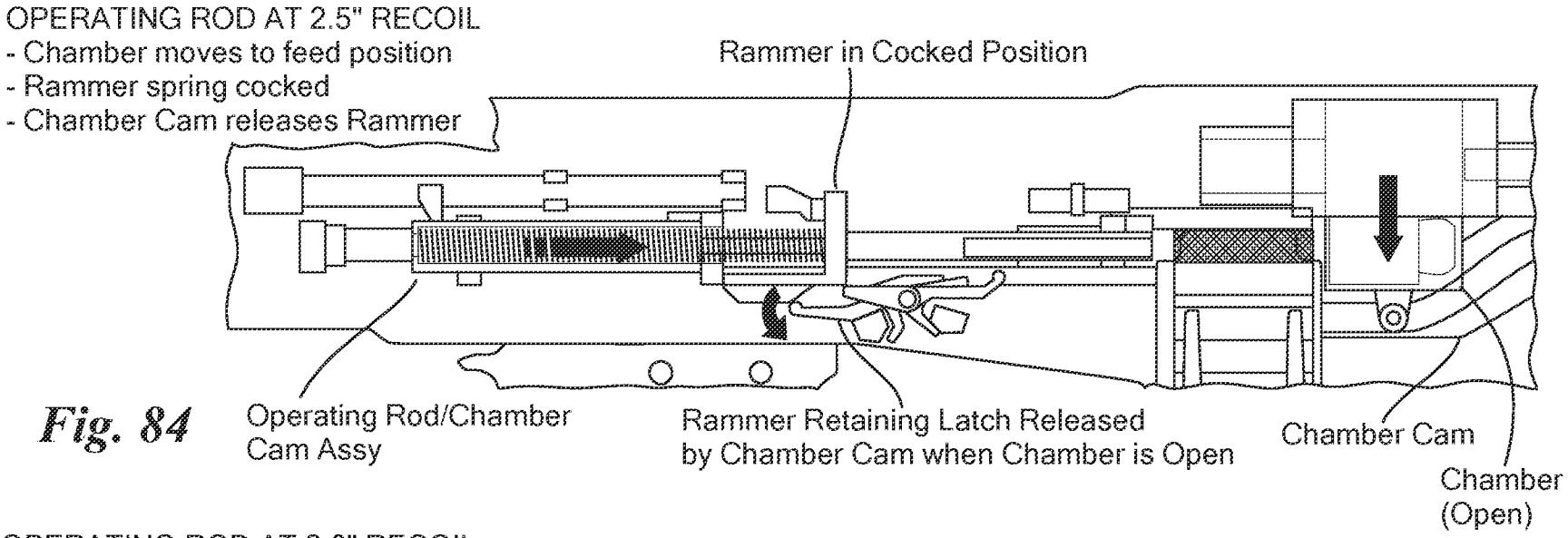
Figure 85:
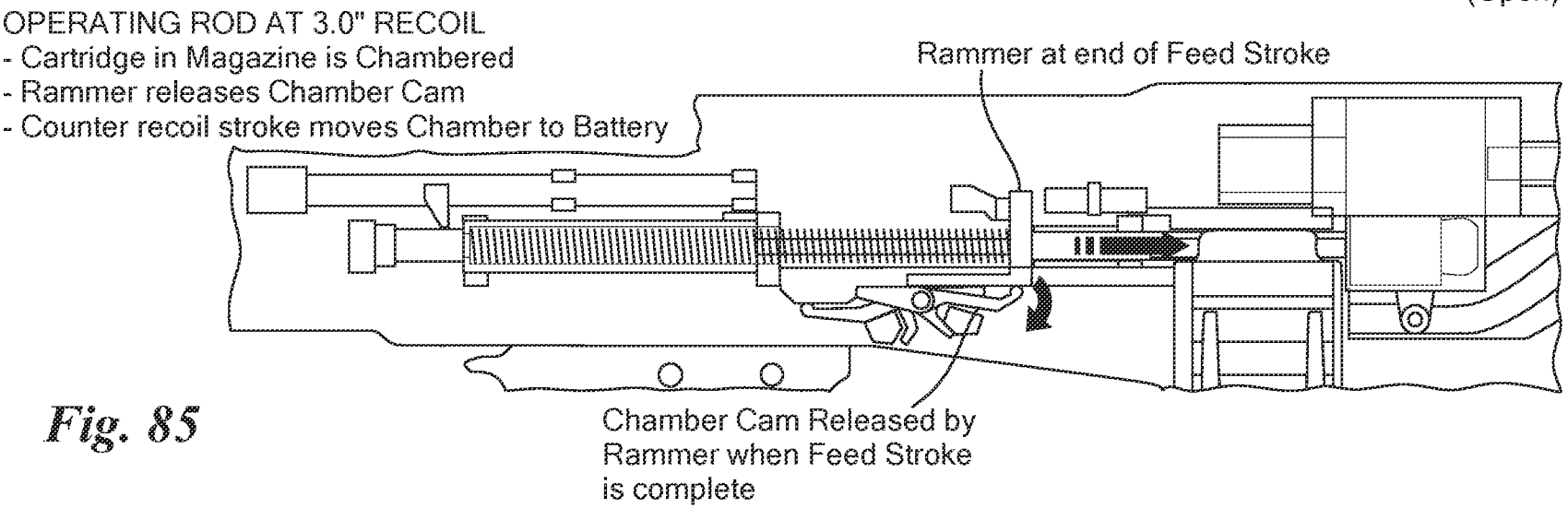
Figure 86:
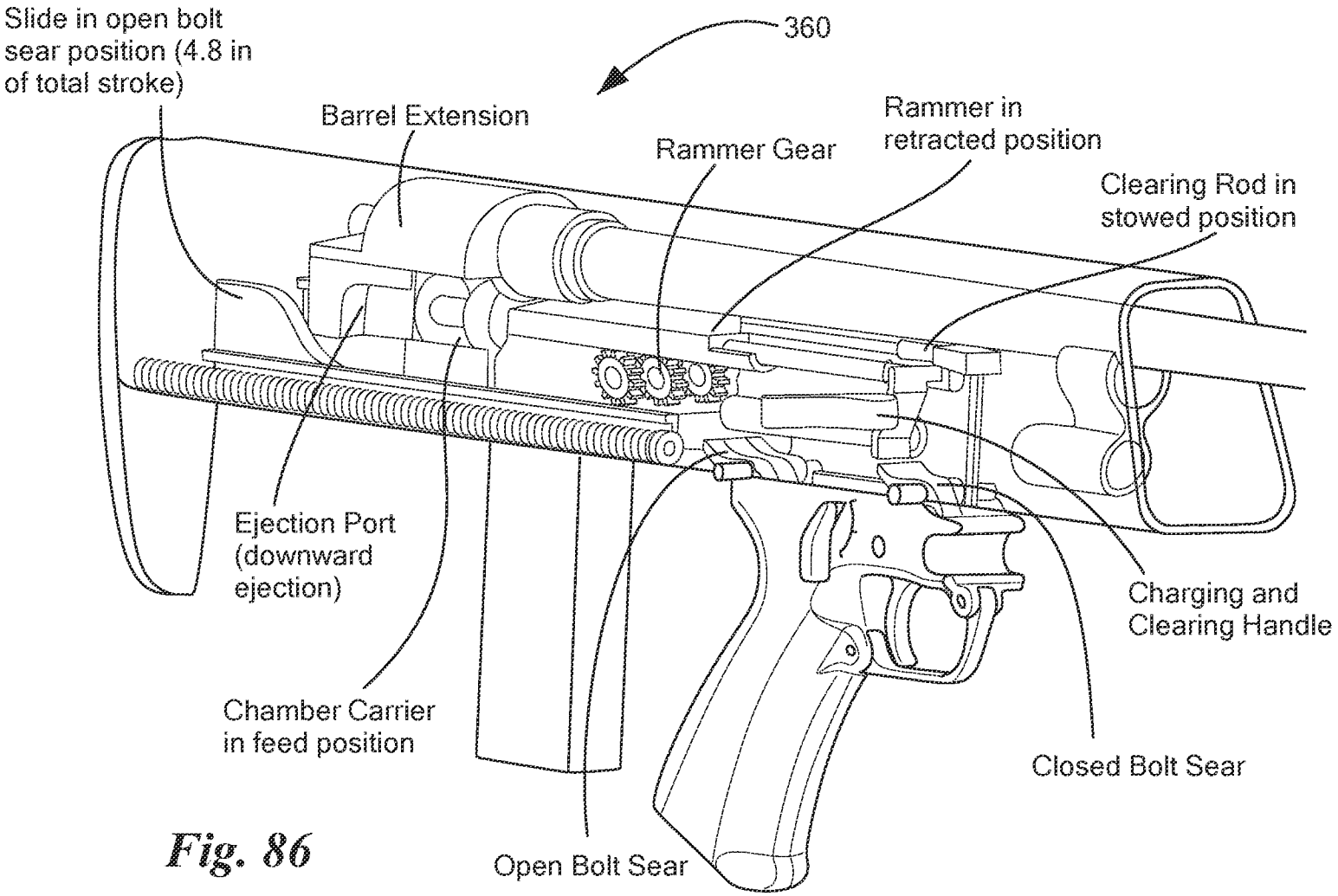
Figure 87:
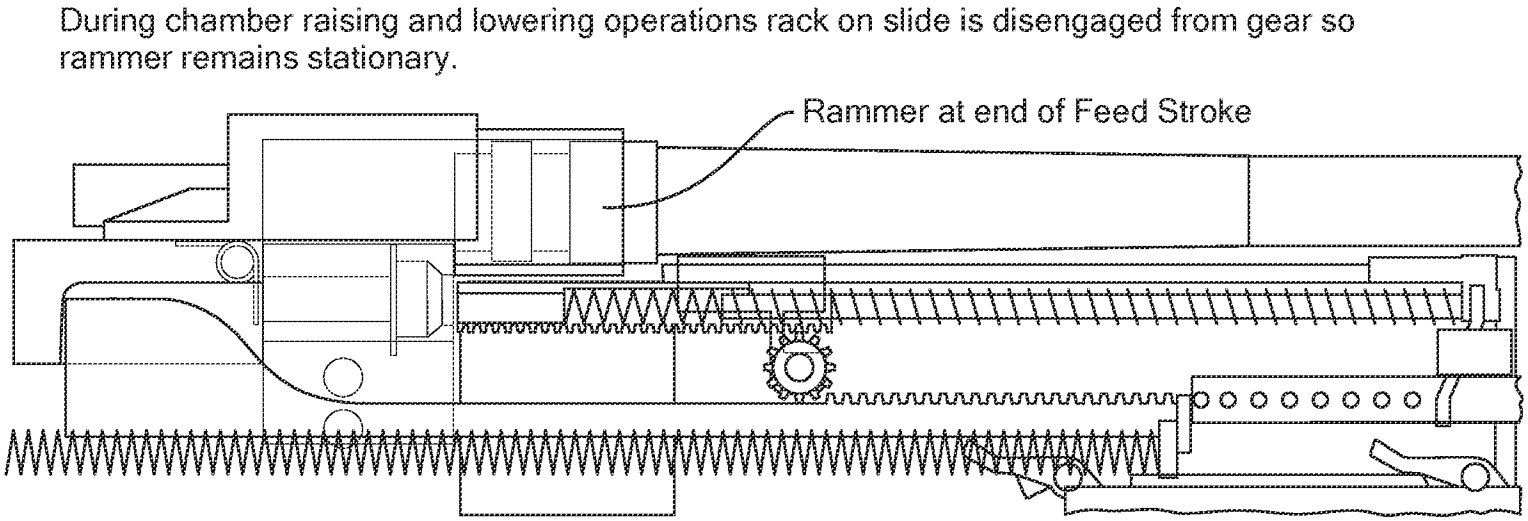
Figure 88:
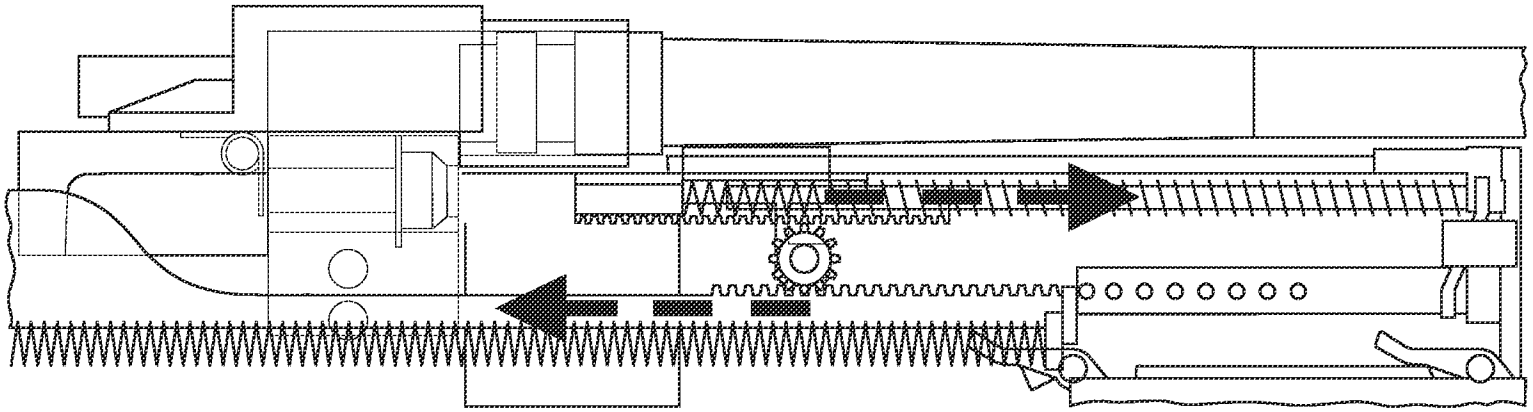
Figure 89:
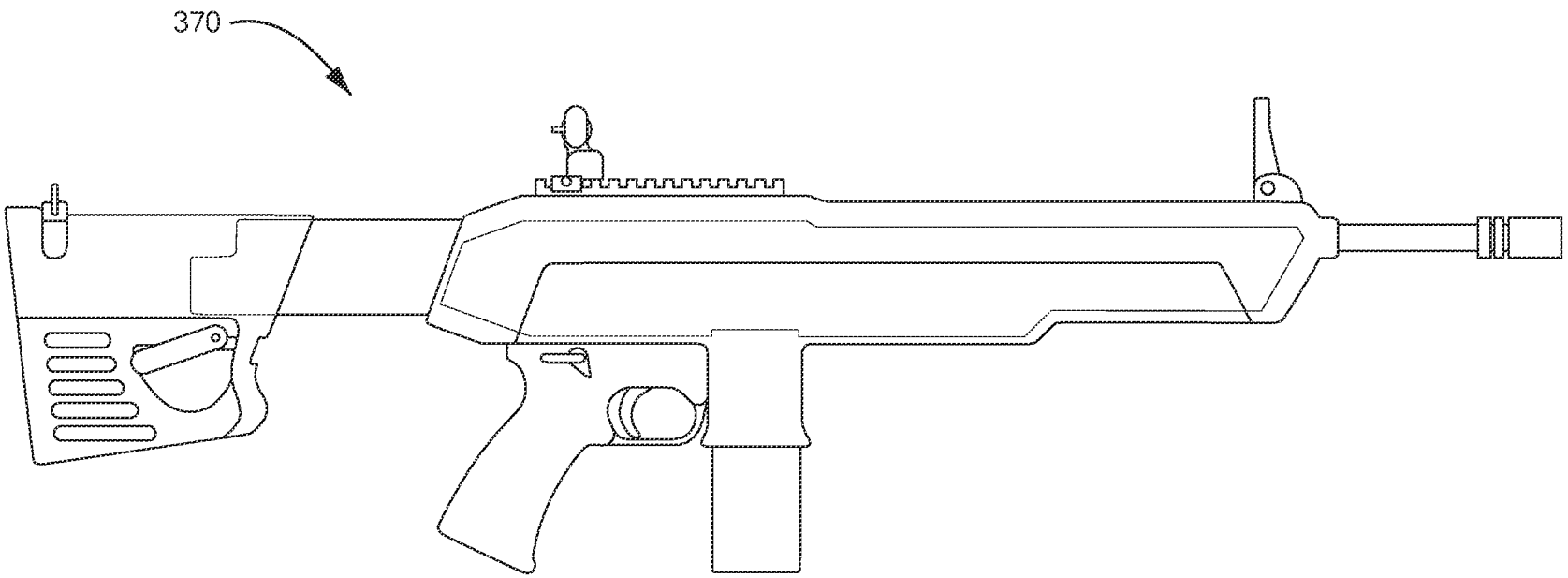
Figure 90:
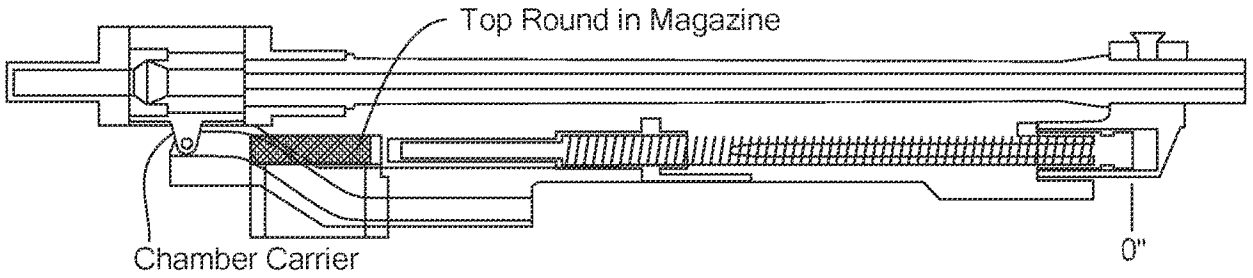
Figure 91:
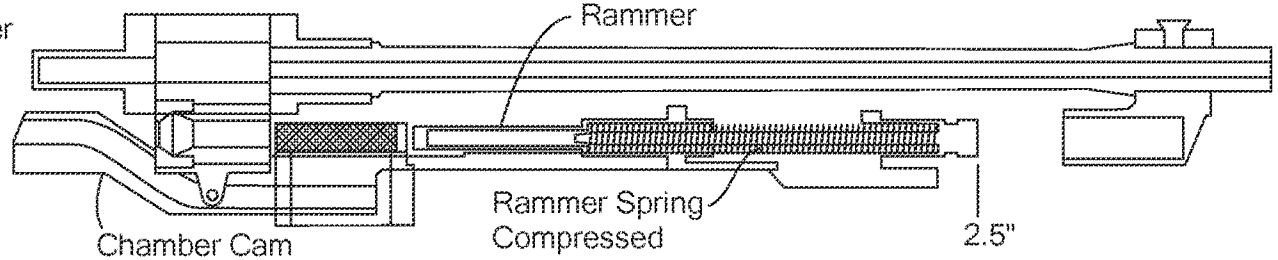
Figure 92:
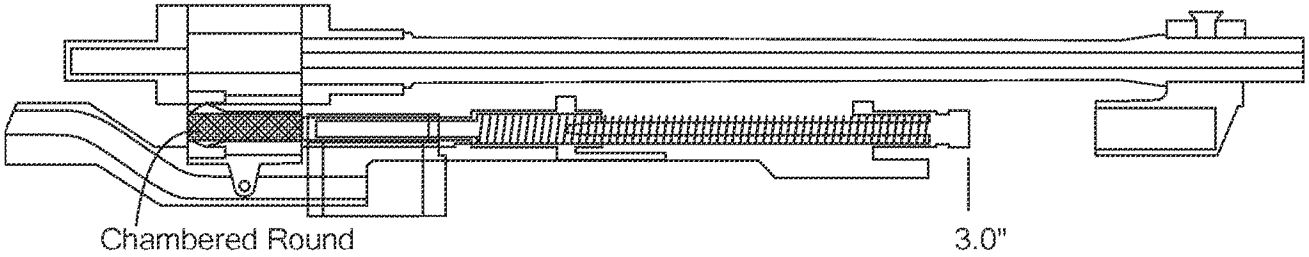
Figure 93:
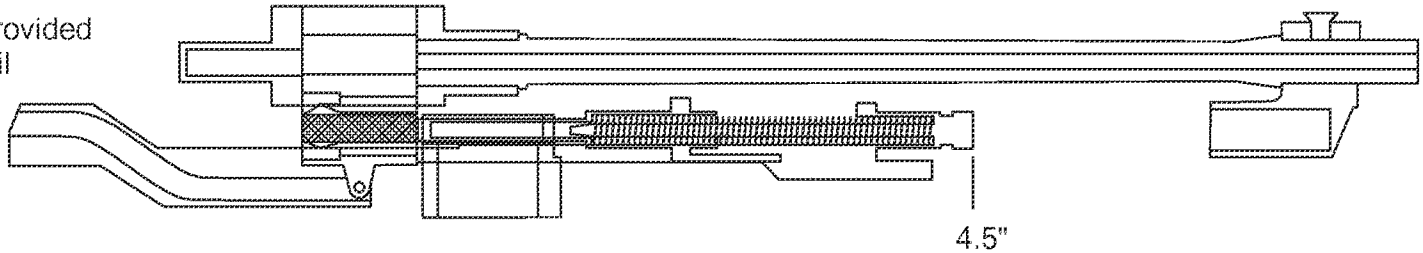
Figure 94:
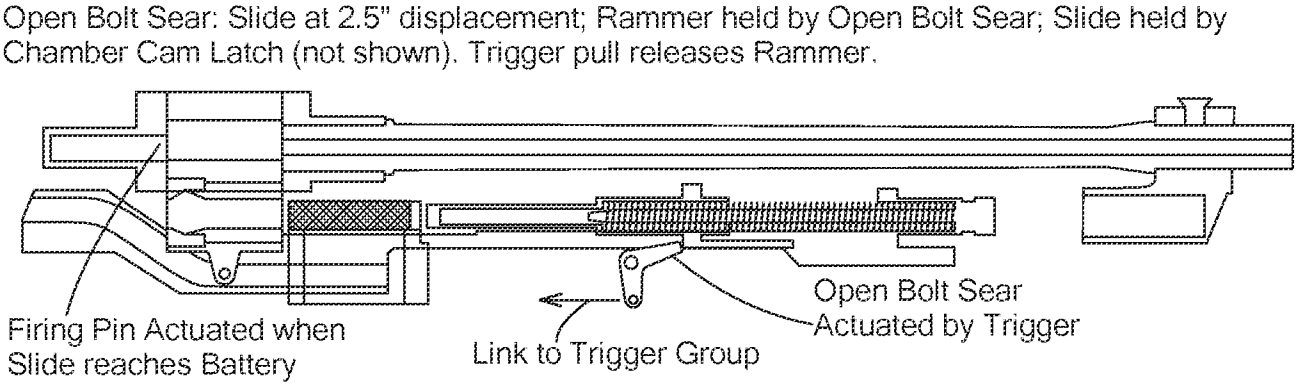
Figure 95:
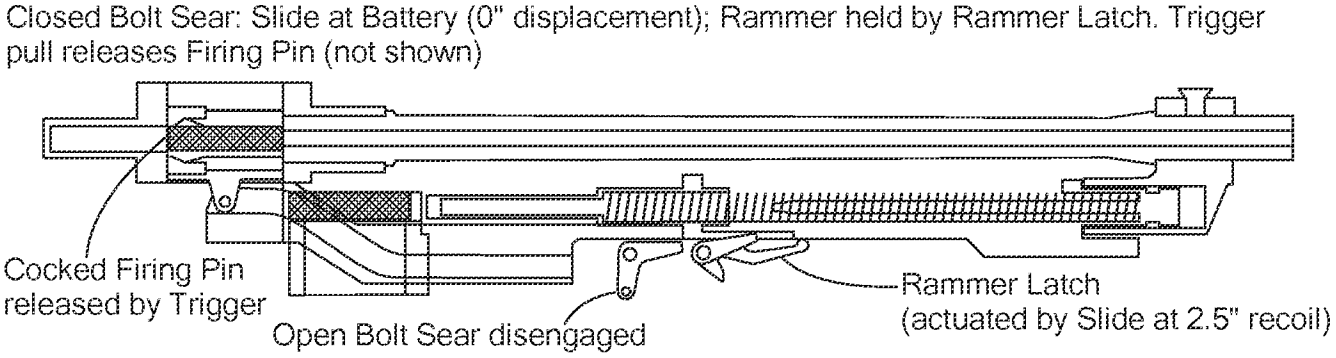
Figure 96:
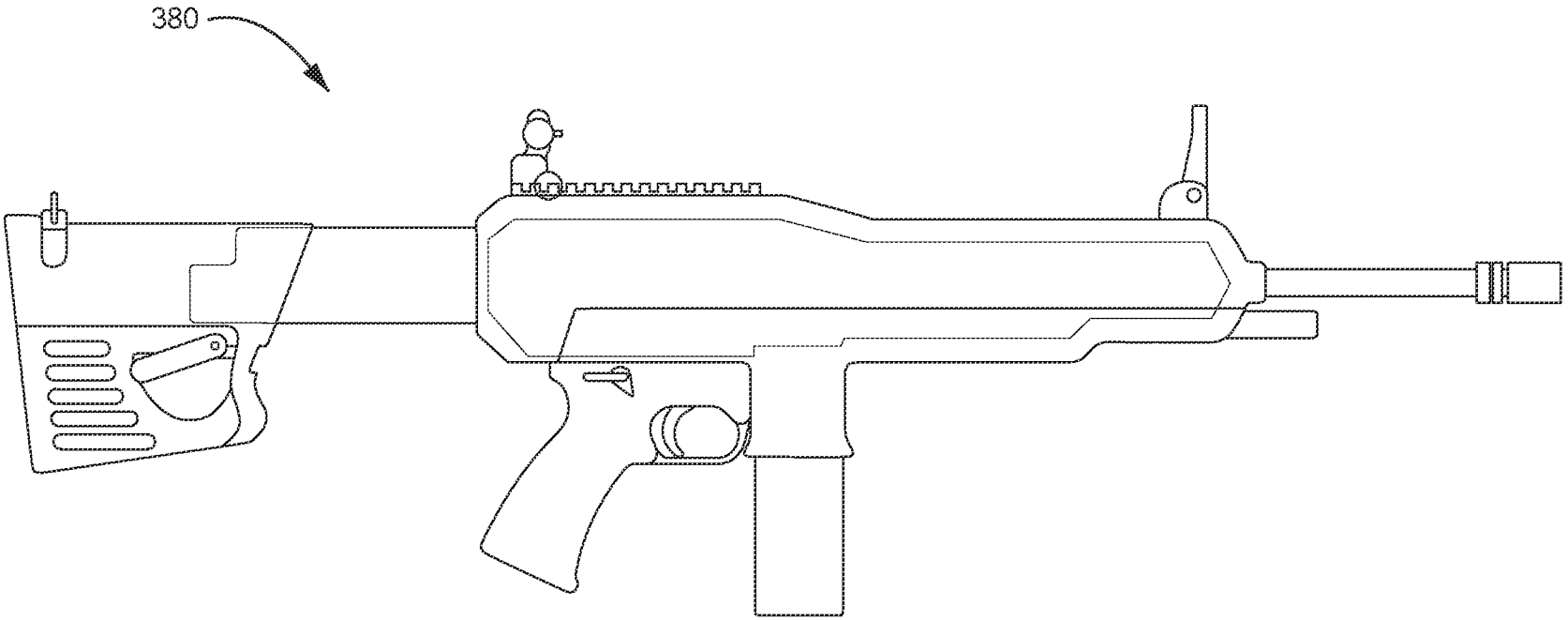
Figure 97:
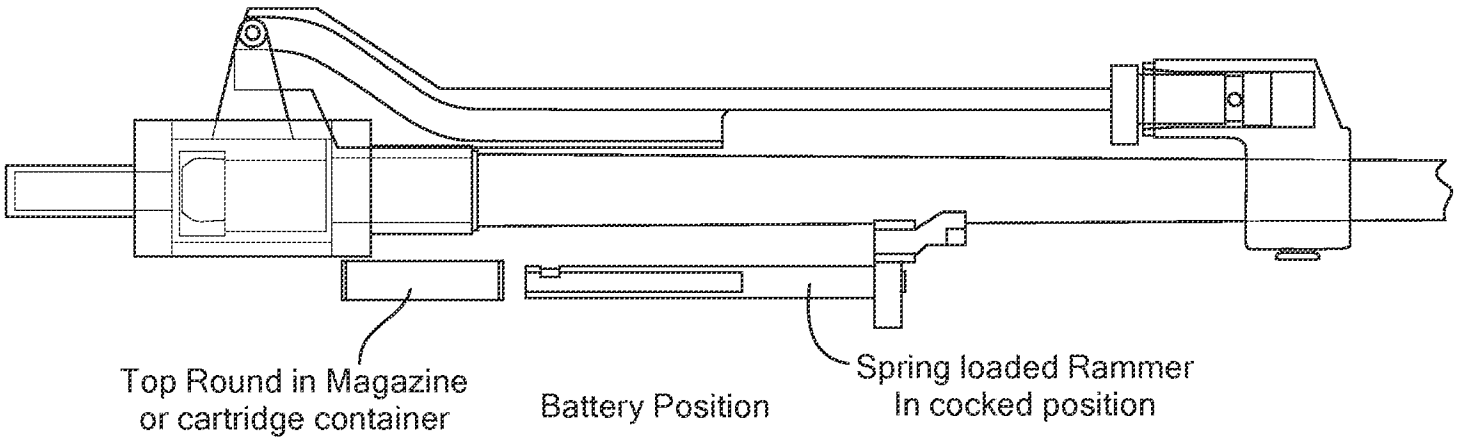
Figure 98:
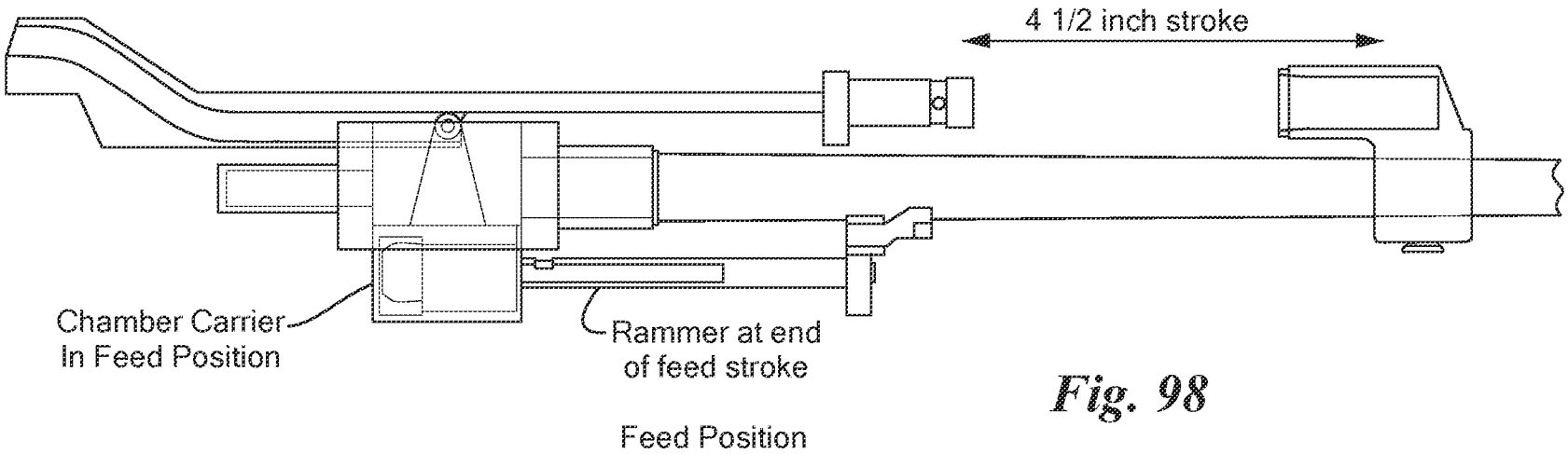
Figures 99, 100:
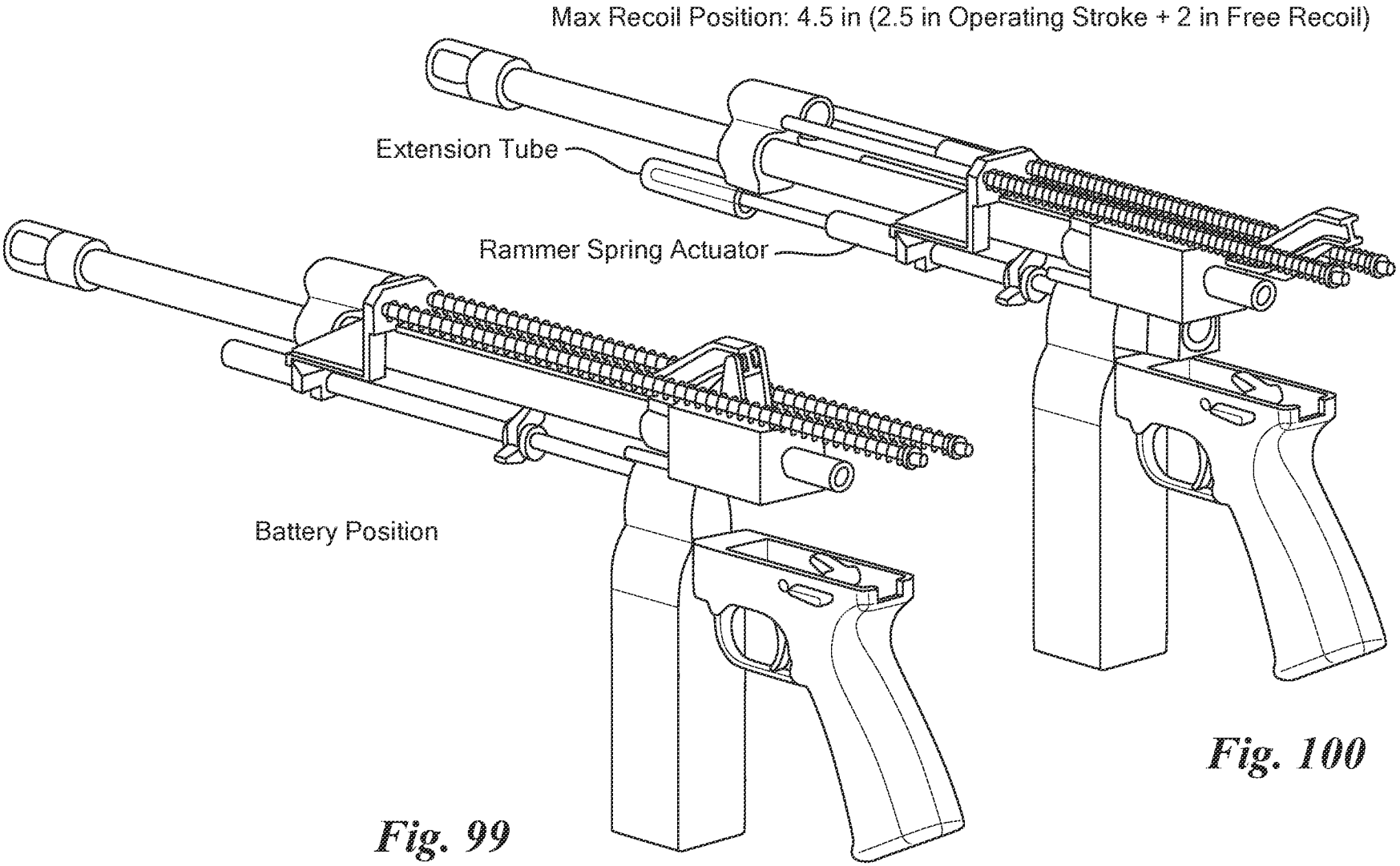
Figure 101:
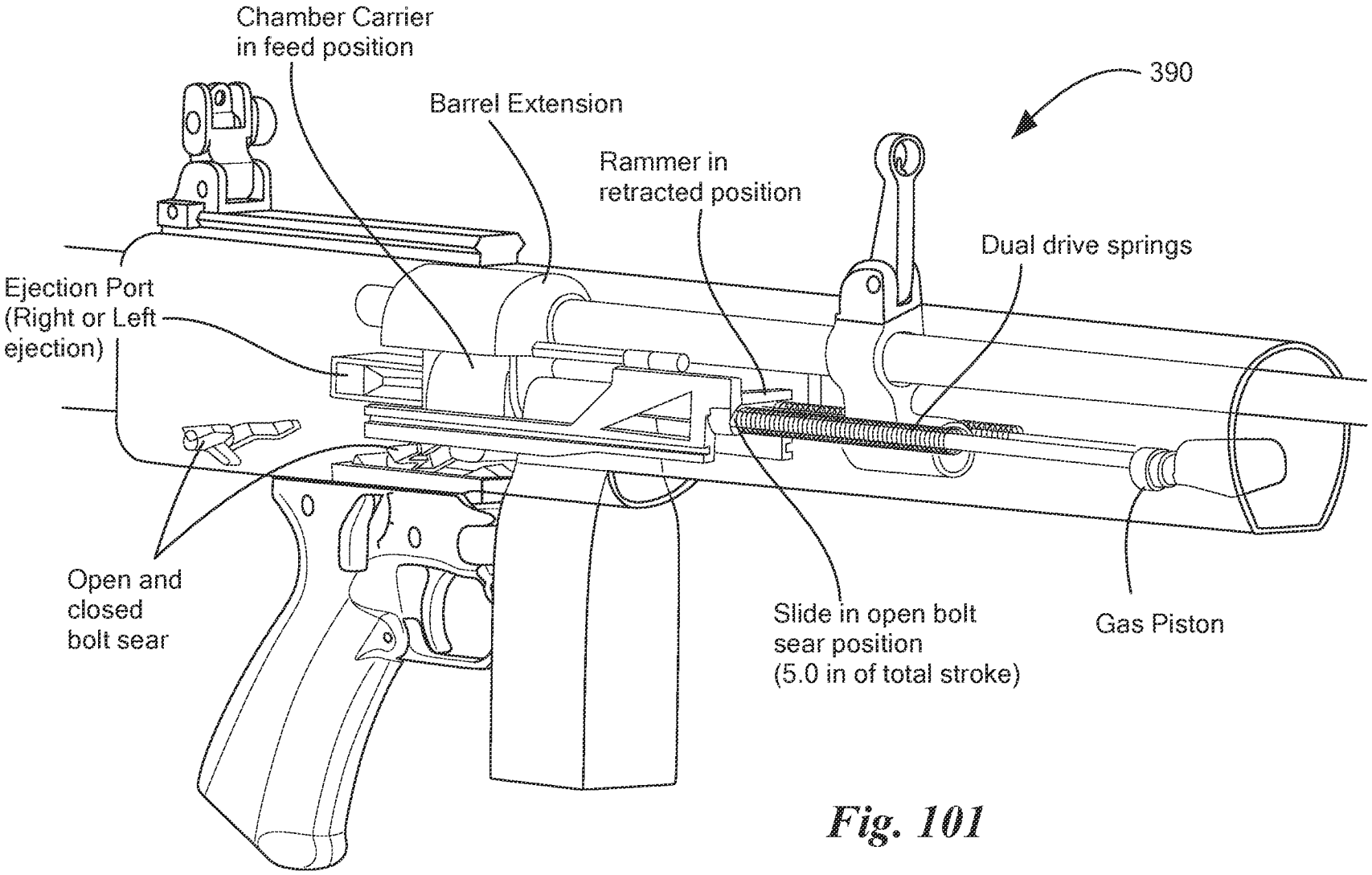
Figure 102:
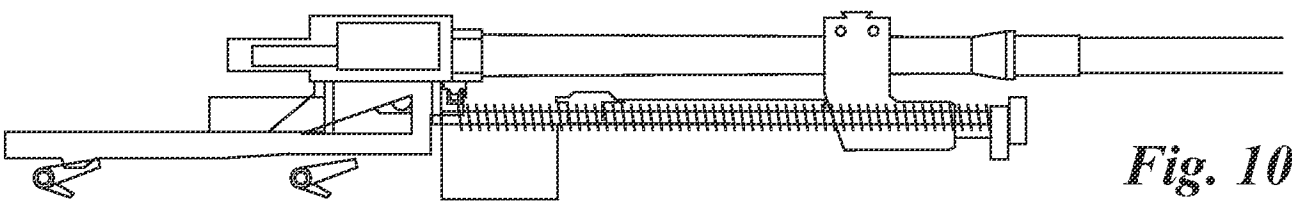
Figure 103:
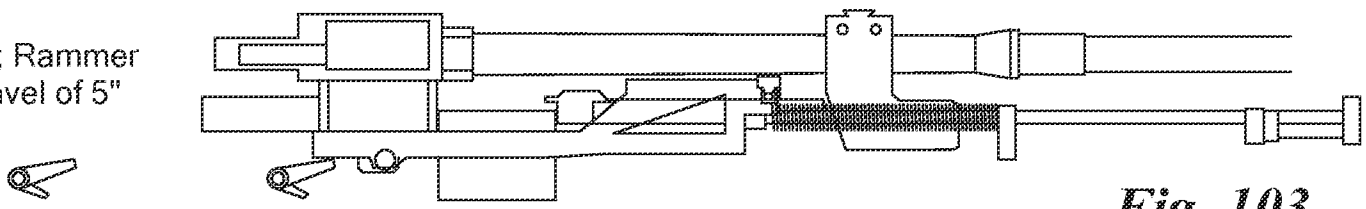
Figure 104:
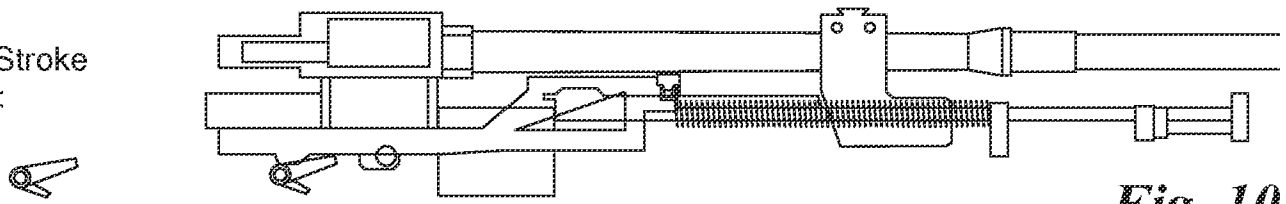
Figure 105:
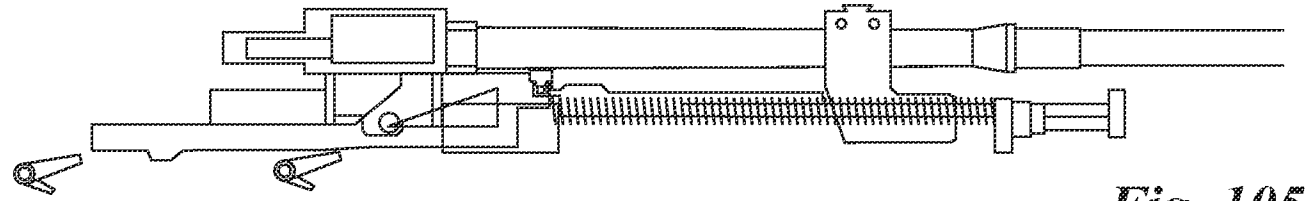

FIGS. 83-85 show a first alternative carbine 350 with the following characteristics:

Translating Chamber
Gas Cylinder Below Barrel
Chamber Index Cam Below Barrel
Separate Rammer Operation
Magazine Position Forward of Chamber
Pistol Grip Forward of Magazine The carbine 350 has the following advantages:

Reduced Overall Weapon Length
Entire operating stroke used to index chamber
Feed Jam can be cleared by pulling charging handle FIGS. 86-88 show a second alternative carbine 360 with the following characteristics:

Reverse Feed
Trigger group ahead of magazine
Rising chamber
Dual drive springs
Guided rammer
Downward Ejection The carbine 360 has the following advantages:

Short weapon length while including full-length barrel
Clearing of weapon done in same action as charging FIGS. 89-95 a third alternative carbine 370 with the following characteristics:

Aft feed, operating rod under barrel
Translating Chamber
Gas Cylinder Below Barrel
Chamber Index Cam Below Barrel
Spring Loaded Rammer The carbine 370 has the following advantages, which also apply to fourth and fifth carbines 380, 390 described further below:

Aft feeding allows for length savings over traditional forward feeding weapons
Gas piston above barrel allows room for large capacity ammo container
Clearing can be performed on pull stroke of charging handle FIGS. 94-95 show open & closed bolt sear for the carbine 370.

Figure 106:
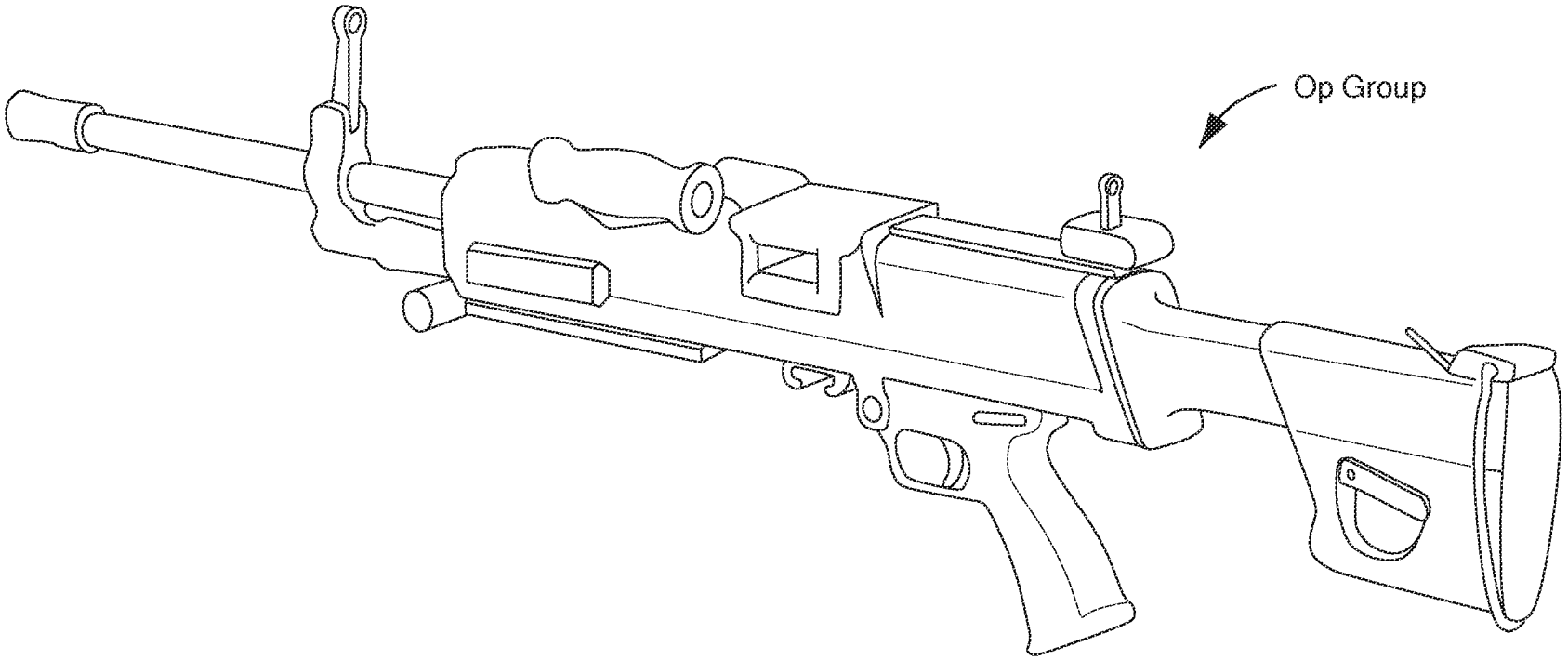
FIGS. 106-107 are perspective views of a CT ammunition machine gun, fully assembled and exploded respectively.
Figure 107:
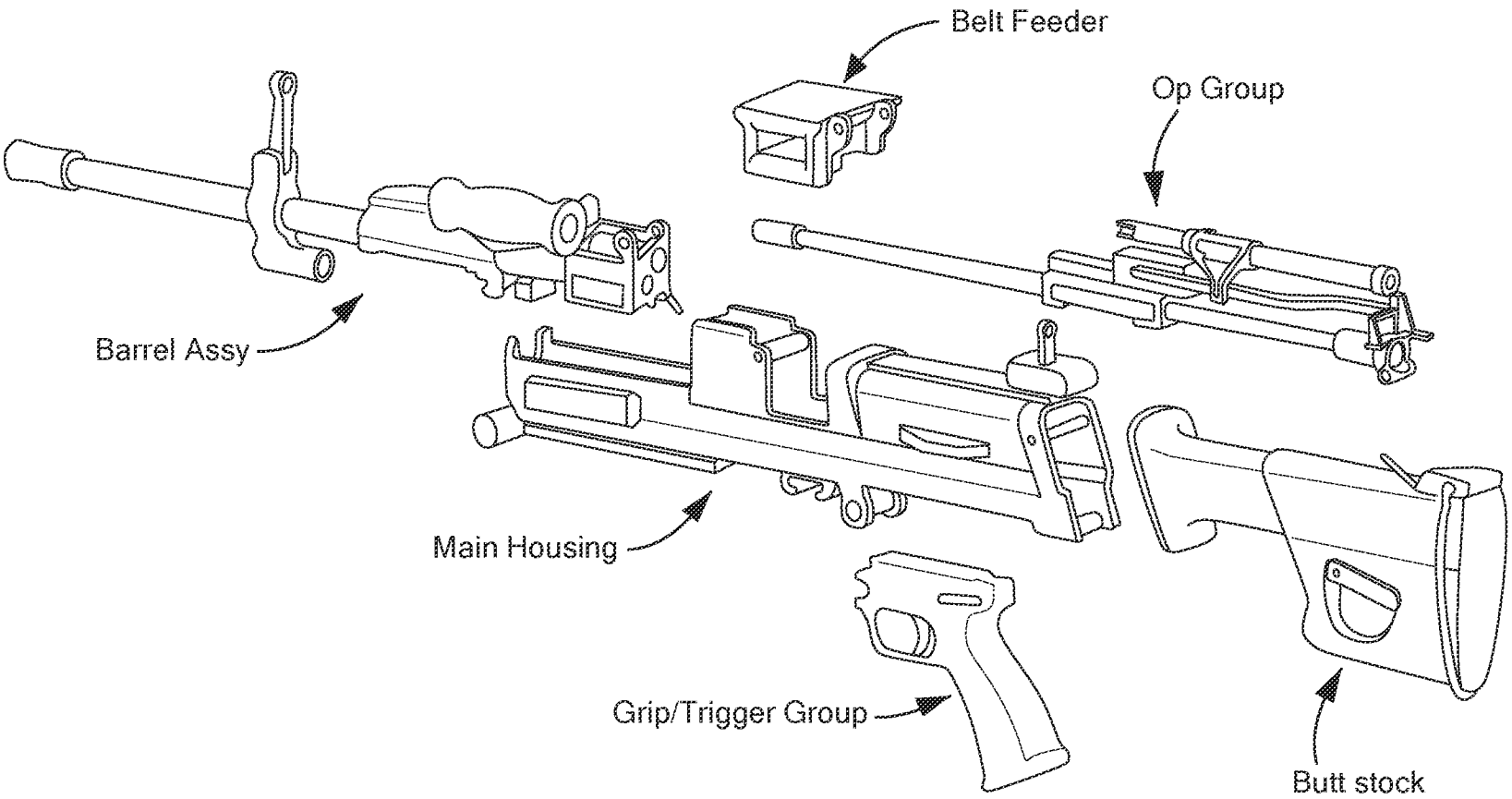

FIGS. 96-100 show a fourth alternative carbine 380 with the following characteristics:

Aft feed, operating rod above barrel
Translating Chamber
Gas Cylinder Above Barrel
Chamber Index Cam Above Barrel
Spring Loaded Rammer The carbine 380 has the following advantages:

Chamber Cam above Chamber allows room for large capacity magazine or belt feeder mechanism
Gas Block can be located farther aft which allows use of M4 barrel without other modifications FIGS. 101-105 show a fifth alternative carbine 390 with the following characteristics:

Aft feed, linked rammer, forward-acting gas piston
Translating Chamber
Gas Cylinder Below Barrel
Chamber Index Cam Below Barrel
Linked Rammer Operation
Magazine Position Forward of Chamber
Pistol Grip Behind Magazine The carbine 390 has the following advantages:

Aft feed via slide driven rammer without need to reverse actuation direction
Buffer contact forces will counteract recoil FIGS. 106 and 107 show a firearm 410, in assembled form in FIG. 106 and in exploded view in FIG. 107. The firearm 410 includes the following major components:

Main housing 412 Barrel assembly 414
Belt feeder 416
Operating group 418
Buttstock 420
Grip and trigger group 422

All components attach to the main housing 412 to form the fully assembled firearm 410 as shown in FIG. 106.

FIGS. 108 through 116 show particular details for a weapon 500 in accordance with certain embodiments. The weapon 500 utilizes a non-rotating carrier body that controls the weapon chamber's position between firing and an ejecting/loading thus ensuring proper positioning of the chamber as the carrier body translates during recoil and counter-recoil.

It should be understood that certain features, characteristics, details, etc. that applied to the earlier-described weapons and/or componentry (e.g., also see FIGS. 1 through 107) may also apply to the weapon 500, and may not be further addressed, may be hidden from view, and/or may be referred to in simplified form for ease of explanation with respect to the weapon 500. Similarly, certain aspects that are provided for this weapon 500 may also apply to the earlier-described weapons and/or componentry.

Figure 108:
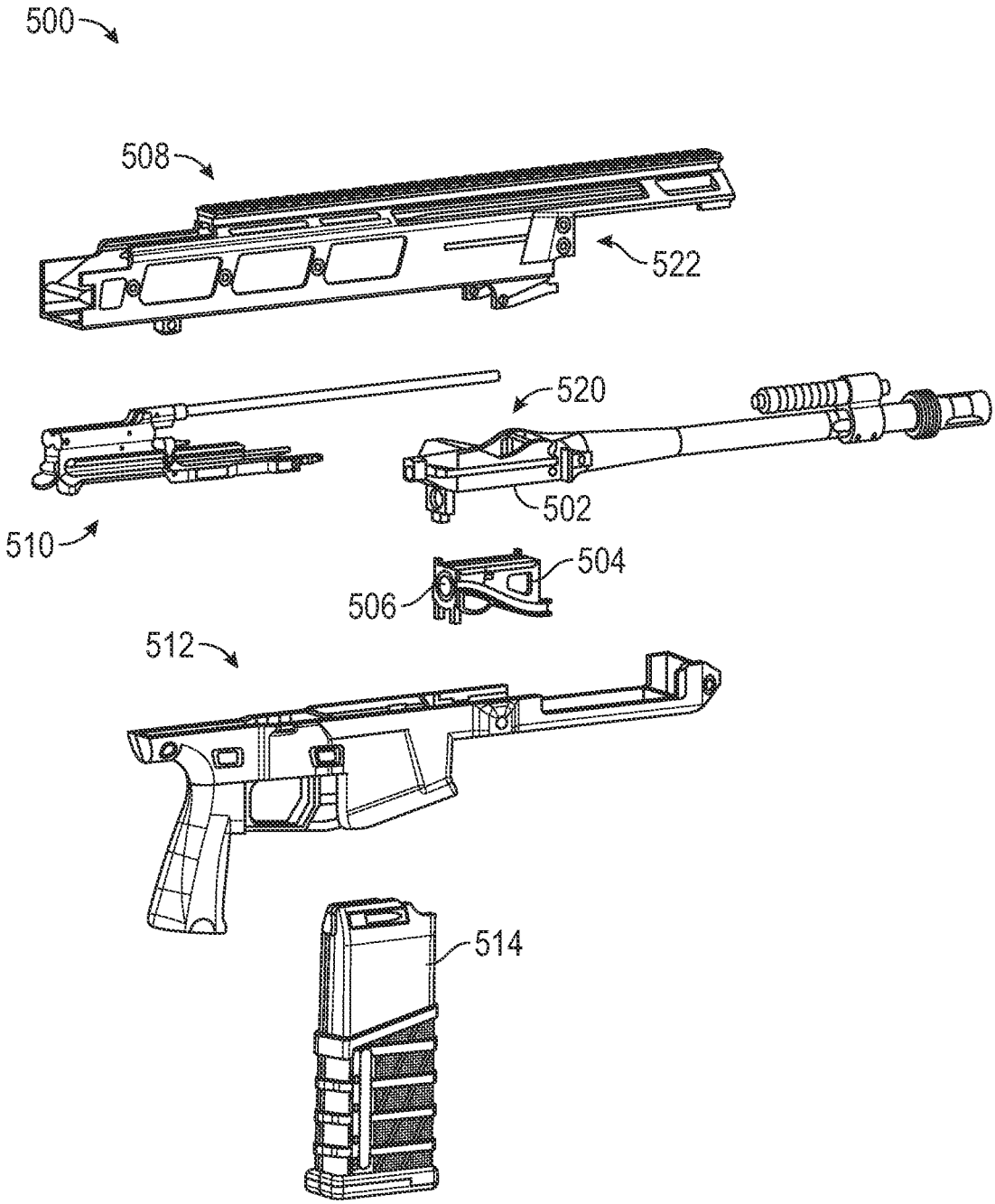
FIGS. 108-116 are views of certain weapon details for cased telescoped weapon action feeding from a magazine in accordance with certain embodiments.

As shown in the partially exploded view of FIG. 108, the weapon 500 includes a barrel extension 502, a chamber carrier 504, a chamber member 506, an upper receiver 508, a carrier assembly 510, a lower receiver 512, and a magazine 514. Other components and their related details (e.g., the buttstock, the barrel, the ejector assembly, etc.) are not shown in FIG. 108 for simplicity.

The chamber member 506 defines a chamber for holding a round. Each round may be loaded into the chamber through the back end and ejected from the chamber through the front end.

In accordance with certain embodiments, the chamber is cylindrically-shaped and sized to accommodate various types of ammunition. Suitable ammunition includes 6.5 CT cartridges, 6.8 mm Next Generation Squad Weapon (NGSW) cartridges, as well as other cartridges and types of ammunition.

The chamber carrier 504 is constructed and arranged to robustly and reliably manage the chamber member 506. Along these lines, the chamber carrier 504 precisely controls positioning of the chamber member 506 as the chamber member 506 is moved between the firing position and the ejection/loading position. In some arrangements, the chamber carrier 504 and the chamber member 506 are pressed together to essentially form one piece/component (e.g., a unitary member).

In accordance with certain embodiments, the chamber carrier 504 is substantially block-shaped enabling the chamber carrier 504 to accommodate and add structural reinforcement to the chamber member 506, and thus enabling the weapon 500 to handle relatively high pressures and forces associated with more powerful cartridges such as the 6.8 mm NGSW cartridge. Additionally, the block-shape lends itself well to defining certain linkage features (e.g., guide grooves, ramped surfaces, etc.) for enhanced interfacing with the carrier assembly 510 during weapon operation.

As further shown in FIG. 108, the barrel extension 502 defines a chamber cavity 520 for receiving the chamber carrier 504 and the chamber member 506. When the chamber carrier 504 resides fully within the chamber cavity 520, the chamber carrier 504 holds the chamber member 506 in the firing position. Here, the bores of the chamber member 506 and the barrel extension 502 are aligned to enable a projectile to be expelled from the front of a cartridge in the chamber of the chamber member 506 through the barrel.

The barrel extension 502 is further configured to align with a carrier channel 522 defined by the upper receiver 508. That is, when the weapon 500 is fully assembled, the barrel extension 502 resides in front of the carrier channel 522 along a carrier translation axis thus enabling a pin on the carrier assembly 510 to access the chamber of the chamber member 506 for cartridge firing. In some arrangements, a ring in the rear guides the cartridge's position between the magazine and the chamber alignment.

The carrier assembly 510 is constructed and arranged to translate forward and backward within the carrier channel 522 along the carrier translation axis without rotating. During such translation, the carrier assembly 510 moves the chamber carrier 504 up and down, i.e., vertically and perpendicularly with respect to the translation axis. In turn, the chamber member 506 which is held by the chamber carrier 504 moves between the firing position within the barrel extension 502 and the ejection/loading position within the lower receiver 512.

Figure 109:
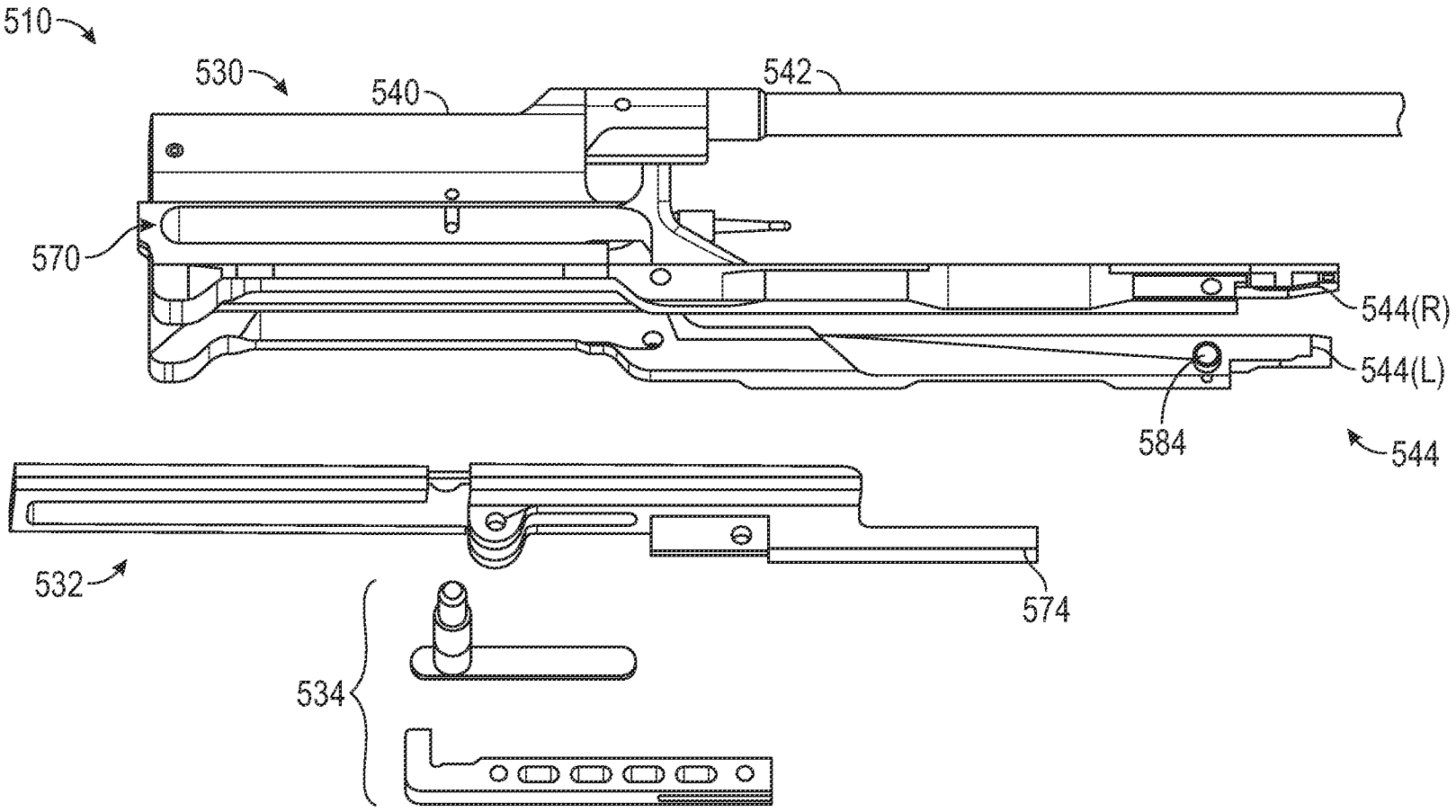
Figure 110:
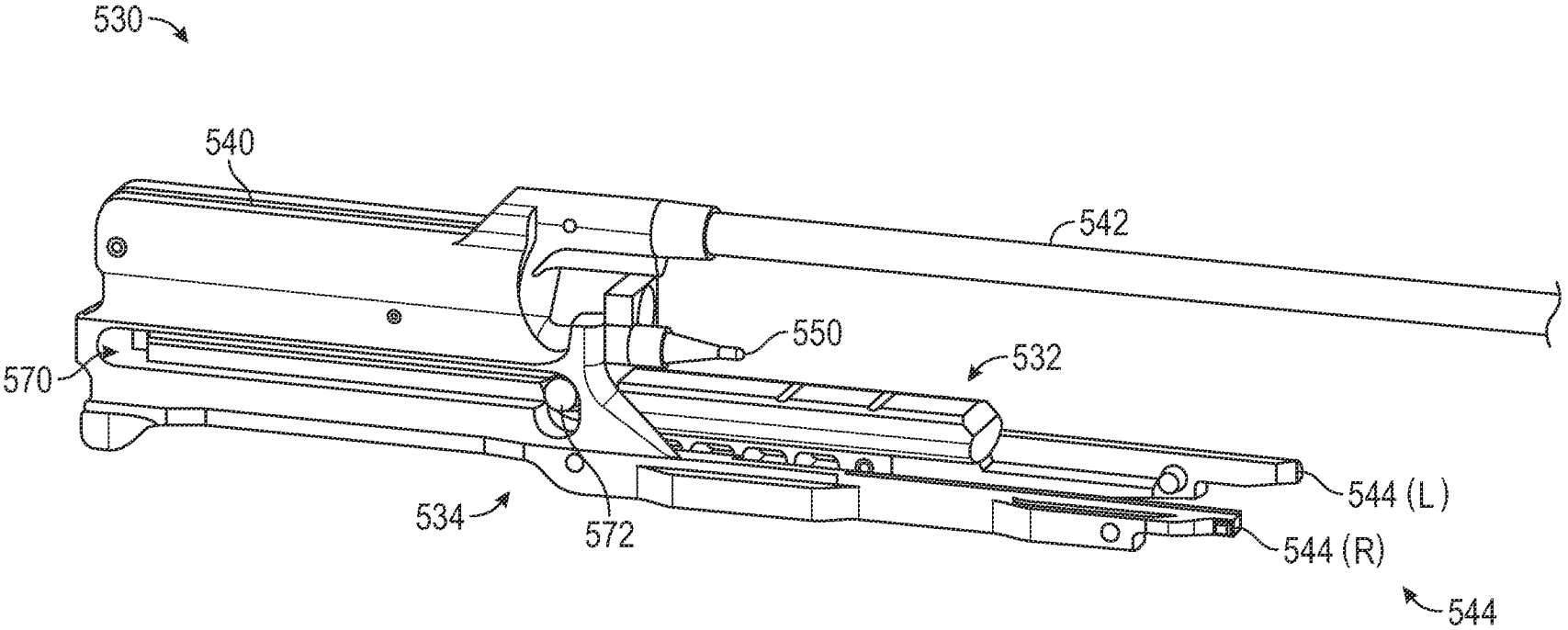
Figure 111:
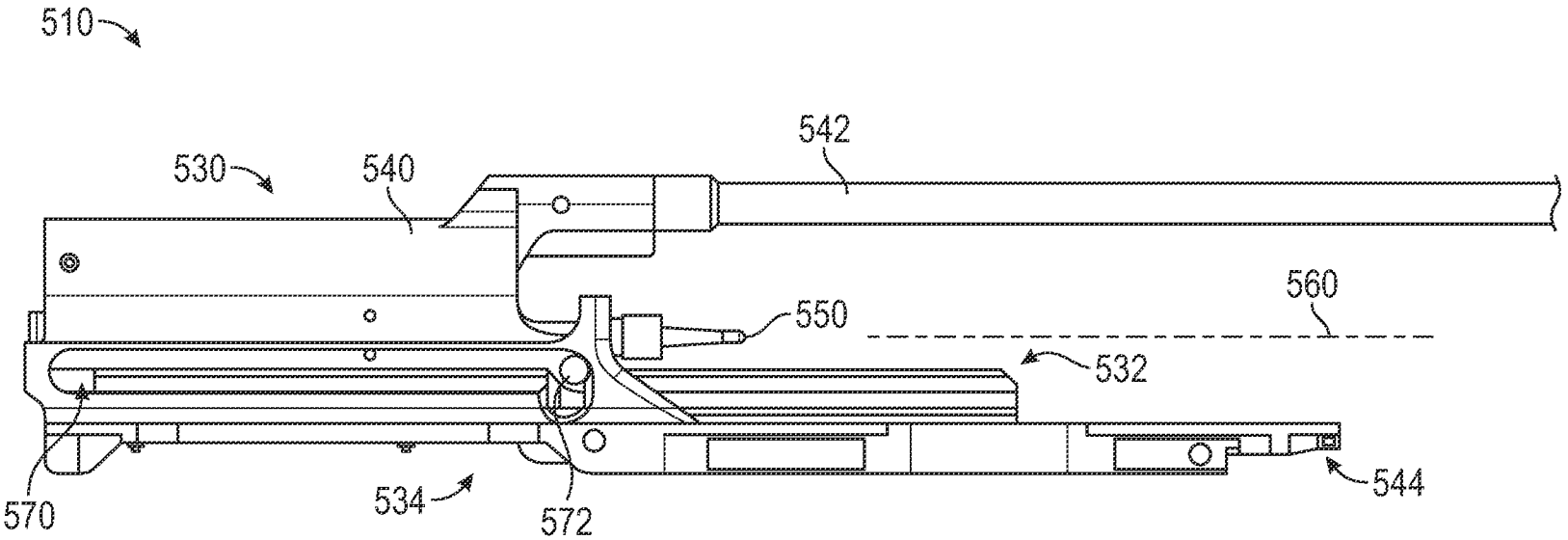

FIGS. 109 through 111 show certain details of the carrier assembly 510 in accordance with certain embodiments. FIG. 109 shows a partially exploded view. FIG. 110 show a perspective view. FIG. 111 show a side view.

As shown, the carrier assembly 510 includes a carrier body 530, a rammer 532 and additional hardware (e.g., additional linkage features, etc.) 534. The carrier assembly 510 is elongated in shape and is constructed and arranged to move within the carrier channel 522 (FIG. 108) during recoil and counter-recoil.

In some arrangements, rollers are configured to cam the carrier assembly 510. Furthermore, bosses on the inside of the carrier are a closer fit than the rollers to align the chamber carrier to the barrel's bore.

The carrier body 530 includes a mid-section 540, a rod 542, a right rail 544(R), and a left rail 544(L). The mid-section 530 couples together the rod 542, and the right and left rails 544(R), 544(L) (collectively, rails 544). Additionally, as best seen in FIGS. 110 and 111, the mid-section 530 supports a firing pin 550 for firing a cartridge within the chamber of the chamber member 506 (FIG. 108).

The rod 542 of the carrier body 530 is constructed and arranged to slide within a track in the upper receiver 508. Accordingly, the carrier body 530 is restricted to front/back translation along an axis 560 (FIG. 111) as well as prevented from rotating within the carrier channel 522 (FIG. 108). In some arrangements, the rod 542 may form a portion of, or make contact with, the piston 36 (FIG. 4) that pushes the carrier assembly 510 rearward during weapon firing.

The rails 544 of the carrier body 530 are constructed and arranged to control movement of the rammer 532 and the chamber carrier 504 (FIG. 108). In particular, a rear portion of each rail 544 defines a J-shaped slot 570. The rammer 532 defines guides 572 (e.g., tabs, detents, etc.) that enable the rammer 532 to move with the carrier body 530 during certain portions of the firing cycle, and disconnect from its original position within the carrier body 530 during other portions of the firing cycle. Further operational details of this disconnecting rammer 532 will be provided shortly. As best seen in FIG. 109, the rammer 532 further defines an interface 574 for pushing a new round from the magazine 514 into the chamber of the chamber member 506 when the chamber member 506 is in the ejection/loading position (also see FIGS. 23 through 25).

Figure 112:
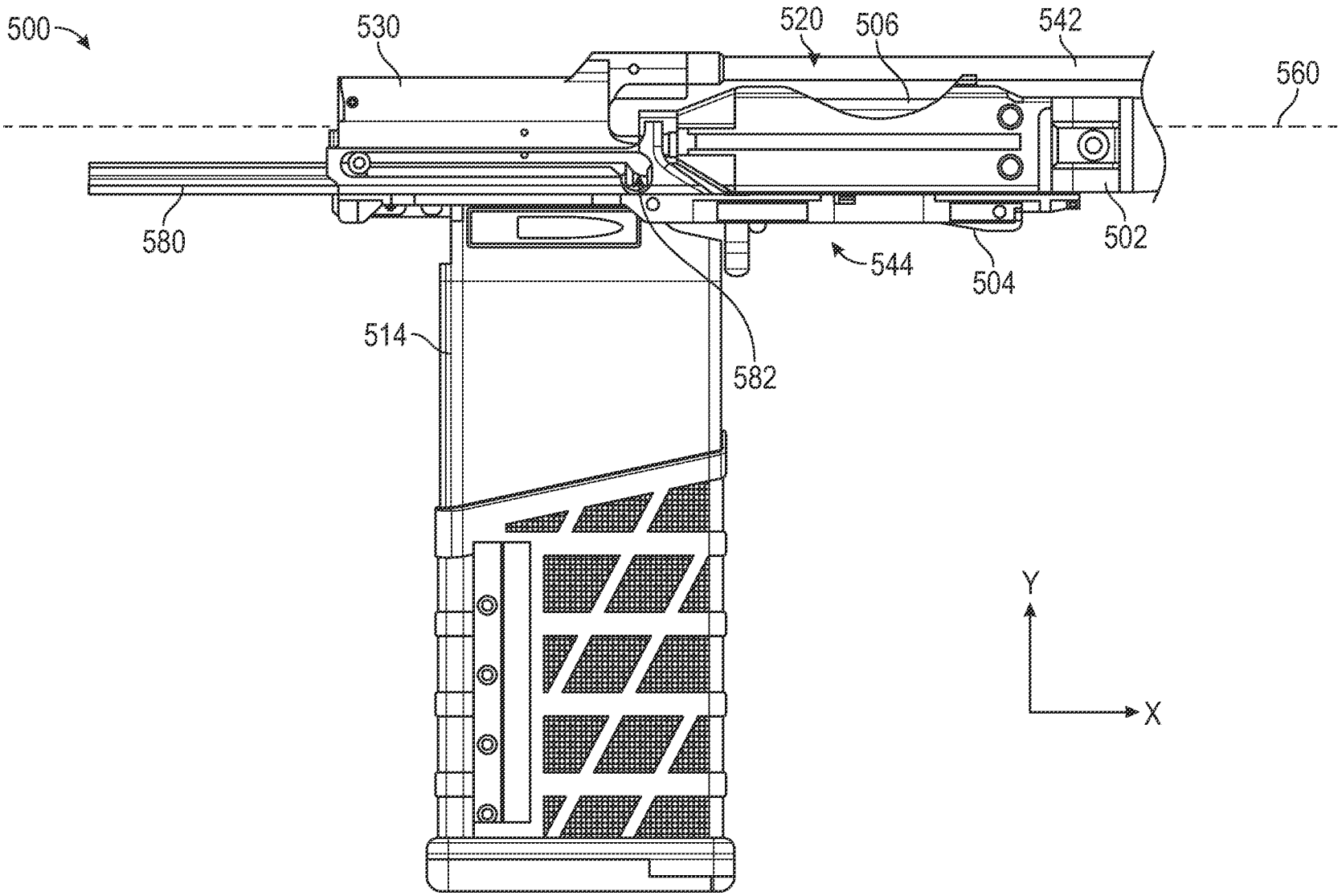
Figure 113:
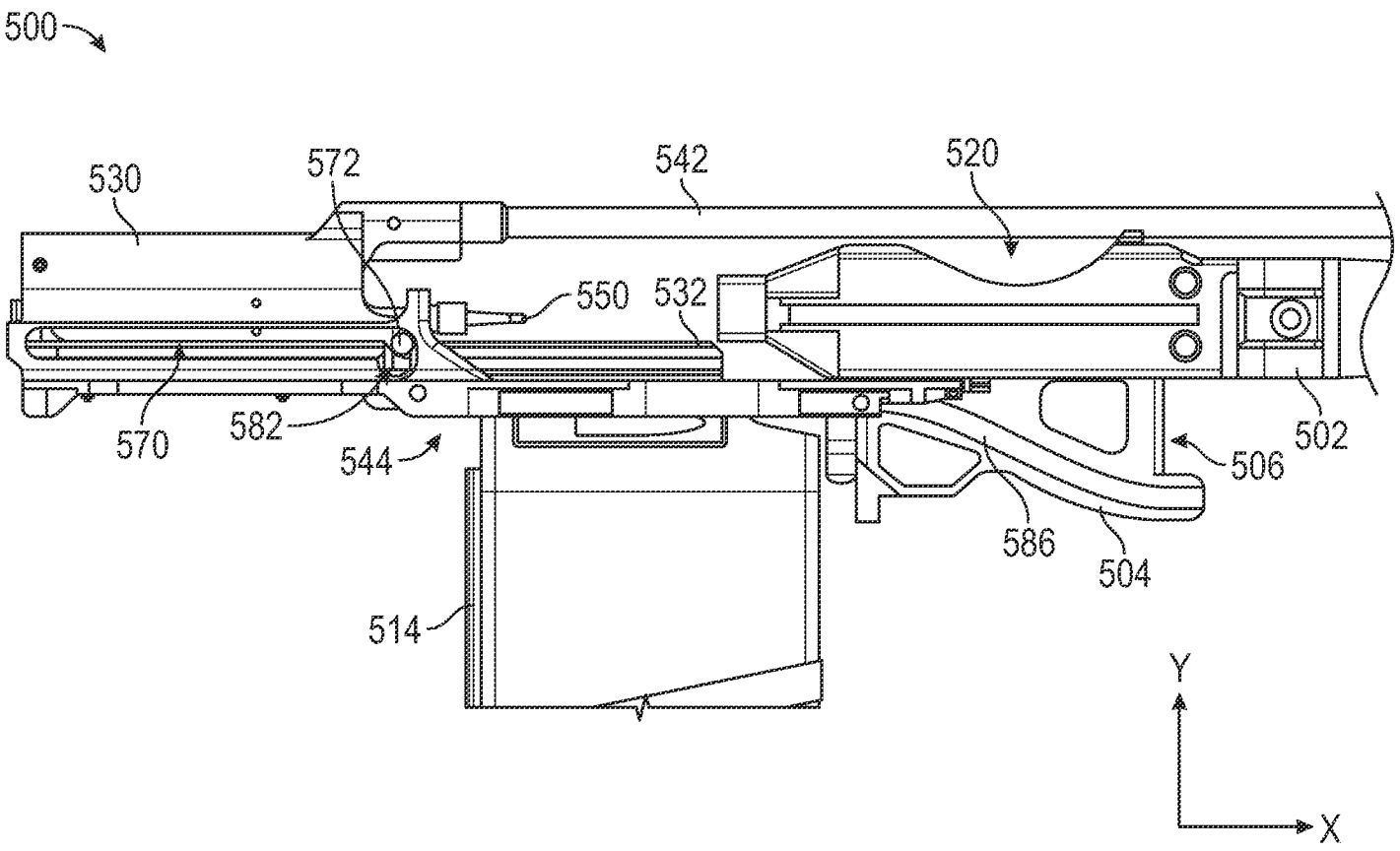
Figure 114:
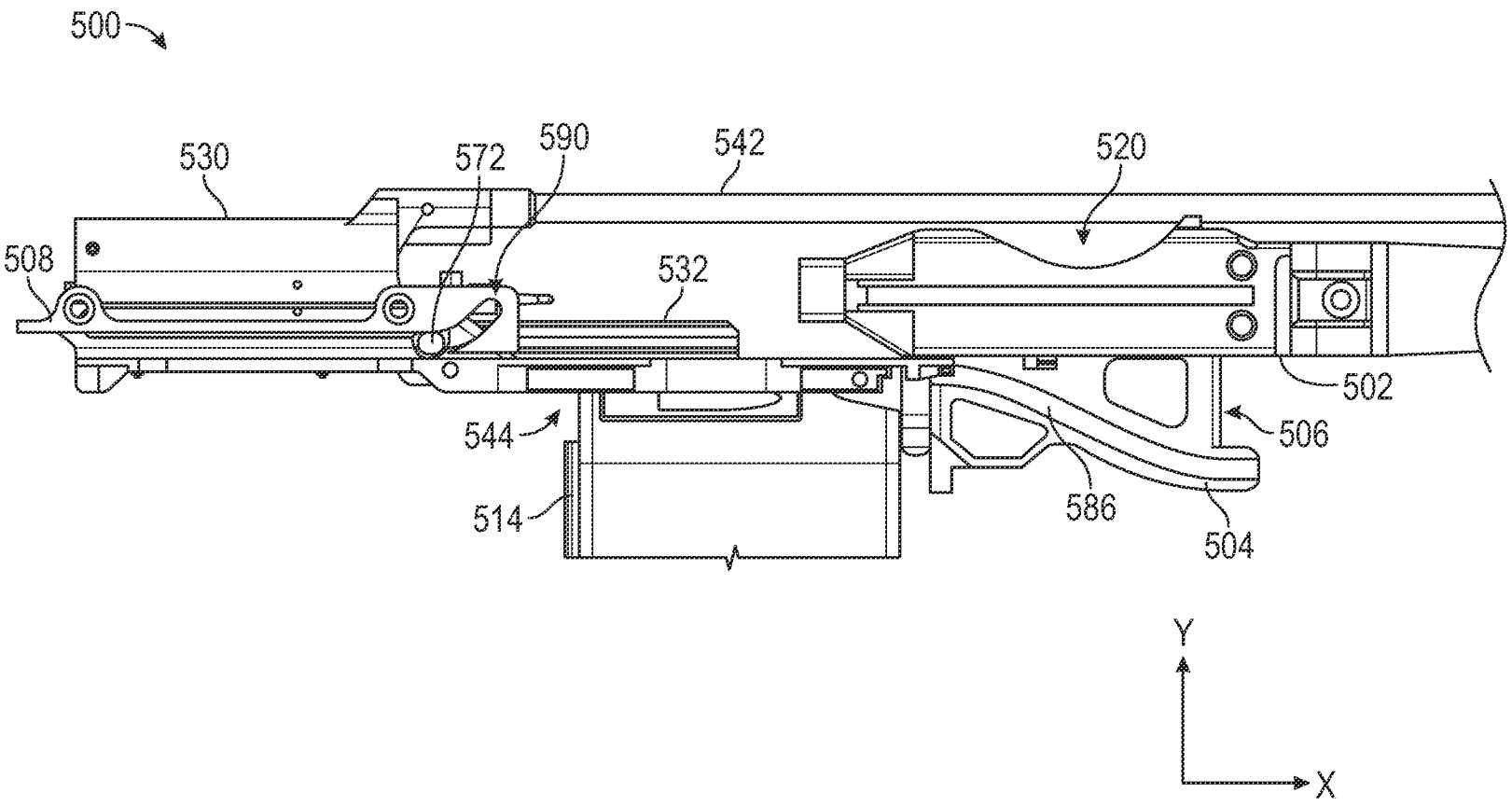
Figure 115:
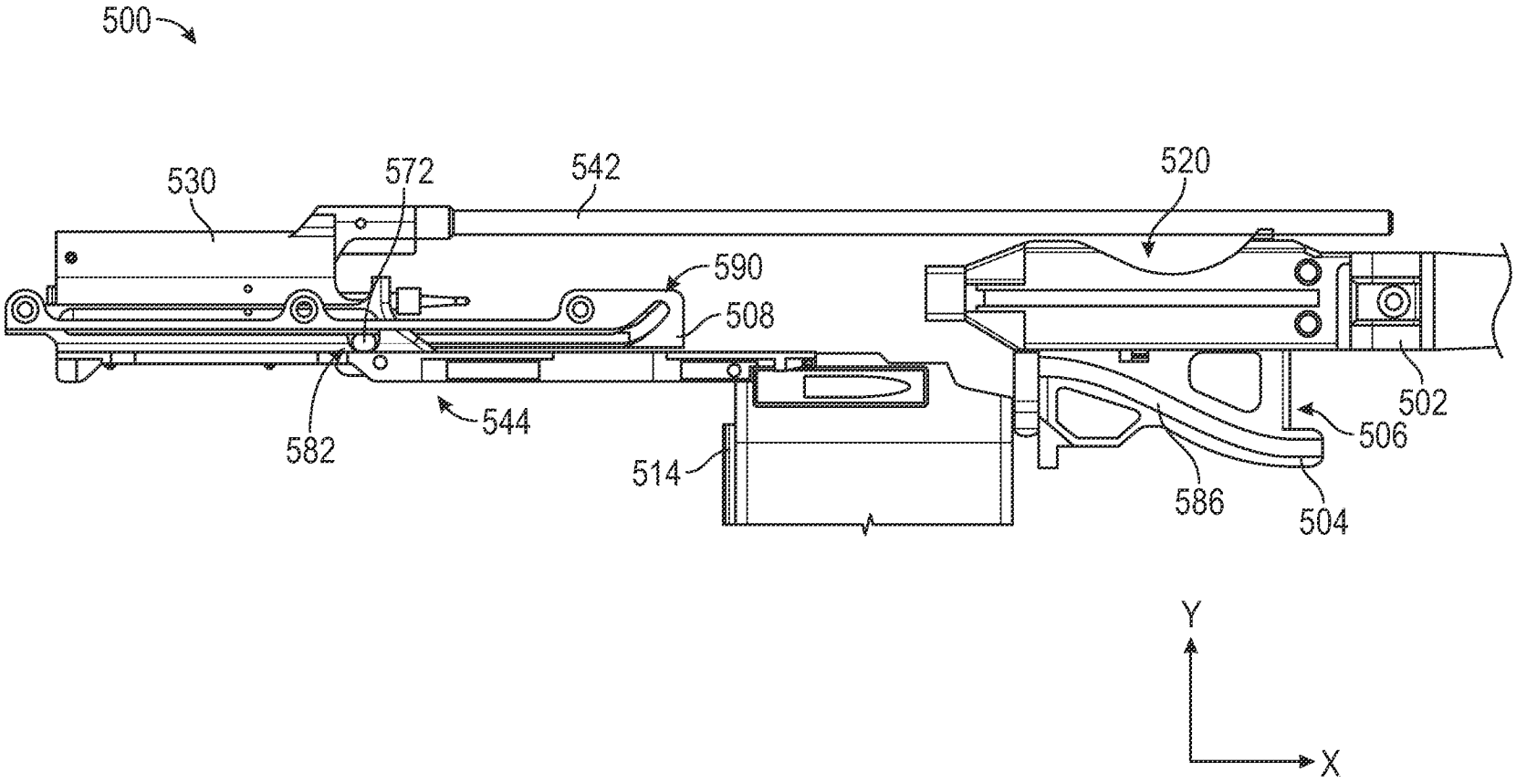
Figure 116:
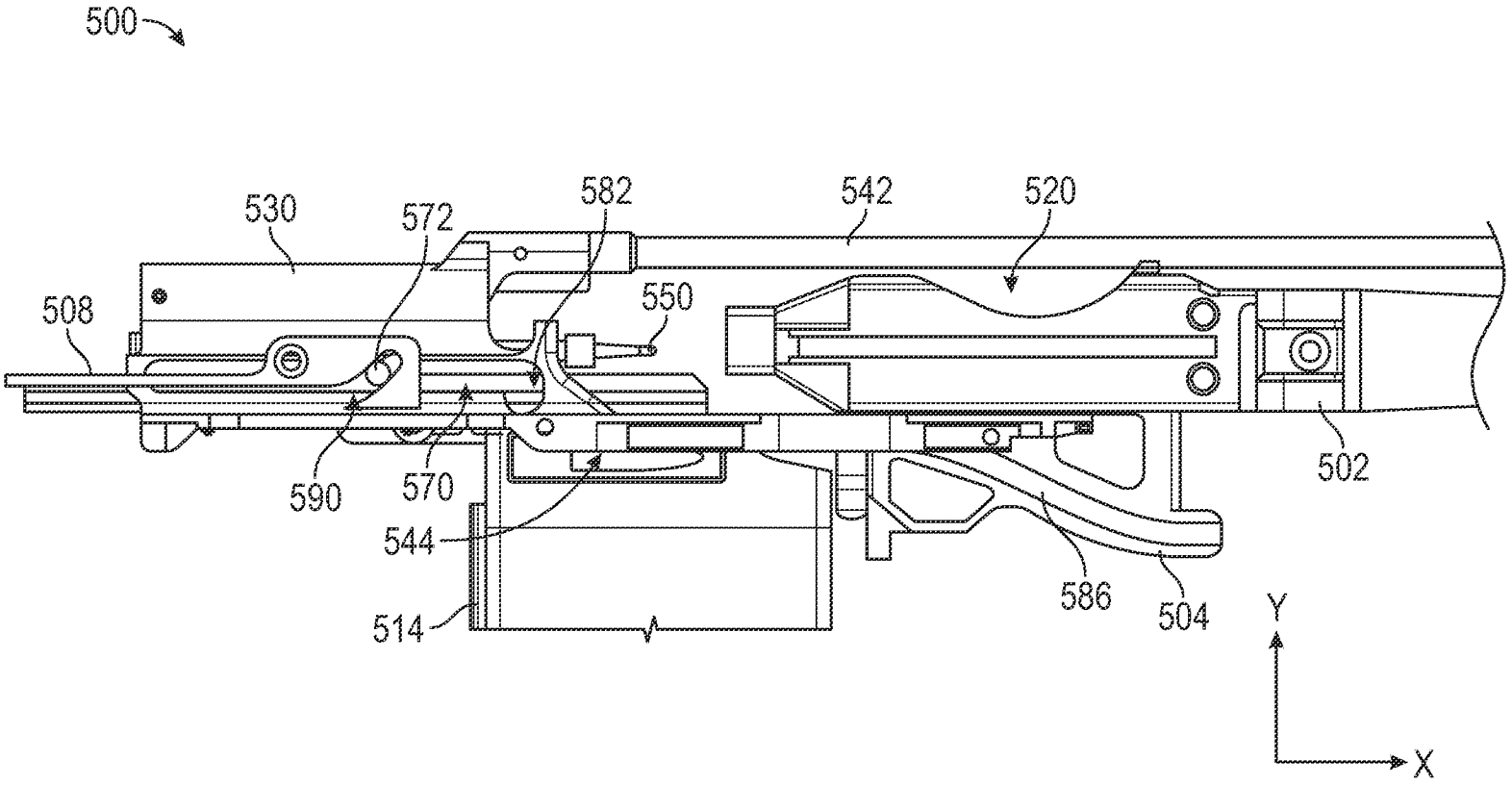

FIGS. 112 through 116 show certain firing cycle details of the weapon 500. FIG. 112 shows a portion of the assembled weapon 500 at a first time during a firing cycle. FIG. 113 shows the weapon 500 at a second time during the firing cycle. FIG. 114 shows the weapon 500 at a third time during the firing cycle. FIG. 115 shows the weapon 500 at a fourth time during the firing cycle. FIG. 116 shows the weapon 500 at a fifth time during the firing cycle.

Starting with FIG. 112, the weapon 500 is currently in a firing state in which the chamber member 506 fully resides within the chamber cavity 520 of the barrel extension 502 (also see FIG. 108). In particular, the rails 544 of the carrier body 530 have a connection with the chamber carrier 504 in order to push and maintain the chamber carrier 504, which in turn holds the chamber member 506, in the positive Y-direction. To this end, it should be understood that features on the rails 544 of the carrier body 530 constantly engage with features on the chamber carrier 504 (e.g., bosses on the rails 544 that push the chamber carrier 504 up from below). Accordingly, the chamber of the chamber member 506 is properly aligned with the bore of the barrel, and the firing pin 550 (FIGS. 110 and 111) fires a cartridge within the chamber. As mentioned earlier, the particular geometry of the chamber member 506 and the chamber carrier 504 provide enhanced reinforcement enabling the weapon 500 to easily handle pressures and forces associated with high power ballistics such as NGSW cartridges.

As the projectile passes through the barrel in the positive X-direction, expelled gases actuate a piston 36 (e.g., also see FIG. 4) that urges the carrier body 530 in the recoil direction, i.e., the negative X-direction, toward the back of the weapon 500. In response and as shown in FIG. 113, the carrier body 530 of the carrier assembly 510 moves away from the barrel. The rod 542 of the carrier body 530 and a set of features 580 of the upper receiver 508 (e.g., a guide rail, grooves, etc.) may perform a variety of operations such as restrict movement of the carrier body 530 along the carrier translation axis 560, prevent rotation of the carrier body 530 within the carrier channel 522, prevent the rod 542 from buckling, align the piston with the rod 542, combinations thereof, and so on (also see FIG. 108).

As the carrier body 530 moves away from the barrel, rollers on the carrier assembly provide downward forces on the chamber carrier 504. Along these lines, surfaces on the front portions of the rails 544 (e.g., tabs, protrusions, rollers, etc.) engage with features on the chamber carrier 504 to move the chamber carrier 504 downward. Accordingly, the chamber carrier 504 moves in the negative Y-direction to lower the chamber member 506 from the firing position into the lower receiver 512.

Eventually, as best seen in FIGS. 113 and 114, the chamber carrier 504 resides fully in the ejection/loading position within the lower receiver 512. As mentioned before, spring loaded tabs and the lower receiver bottom control the position of the chamber in the Y direction. Z and X are controlled by the chamber.

At this point, the chamber of the chamber member 506 is aligned with a top portion of the magazine and with the ejector assembly for ejecting a spent round and loading a new round. Additionally, as the carrier body 530 moves away from the barrel, the carrier body 530 captures the disconnecting rammer 532. Along these lines, the guides 572 of the rammer 532 are no longer able to slide within the J-shaped slot 570 of the carrier body 530. Rather, the guides 572 reach the end of the range of travel thus causing the disconnecting rammer 532 to move in the disconnecting rammer 532 in the negative X-direction as well.

It should be understood that the curves of the J-shaped slots 570 force the guides 572 of the disconnecting rammer 532 in the negative Y-direction to engage wells 582 at the ends of the J-shaped slots 570. Such capturing of the guides 572 within the wells 582 now forces the rammer 532 to move in the negative X-direction with the carrier body 530.

Next, as shown in FIG. 115, the rammer 532 moves back far enough that the interface 574 of the rammer 532 clears a new cartridge at the top of the magazine 514. Accordingly, forward movement of the rammer 532 in the positive X-direction causes the interface 574 of the rammer 532 to push a new round from the magazine into the chamber of the chamber member 506. Along these lines, it should be understood that the carrier assembly 510 is spring loaded. Thus, a spring overcomes the recoil forces on the carrier body 530 and the carrier body 530 is now urged forward toward the barrel and the rammer 532 therefore loading a new round into the chamber. As the new round enters the chamber, the new round forces the spent round from the chamber where the ejection assembly clears the spent round from the weapon 500.

As shown in FIG. 116, the carrier body 530 continues moving forward in the positive X-direction toward the barrel. Geometry on the carrier rotates the chamber carrier's tabs, allowing it to move in the positive Y direction. Then, the rollers on the carrier body 530 force the chamber member 506 out of the ejection/loading position upward in the positive Y-direction. In accordance with certain embodiments, linkage features 584 on the front portions of the rails 544 (e.g., tabs) and corresponding linkage features 586 on the chamber carrier 504 (e.g., grooves, ramped surfaces, etc.) engage to move the chamber carrier 504 vertically and perpendicularly to the movement of the carrier body 530 thus urging the chamber member 506 back into the chamber cavity 520 defined by the barrel extension 502 (also see FIG. 108).

As best seen in FIGS. 115 and 116, the same guides 572 of the rammer 532 that had been captured within the wells 582 of the rails 544 also ride within slots 590 defined by a portion of the upper receiver 508 (also see FIGS. 108 and 115). The slots 590 have curved ends and, as the guides 572 of the rammer 532 enter the curved ends of the slots 590, the guides 572 are moved upward and out of the wells 582 (also see FIG. 116).

Accordingly, the rammer 532 disconnects from the carrier body 530. Such operation enables the rammer 532 to stop moving forward with the carrier body 530 since the cartridge is now properly within the chamber, but allows the carrier body 530 to continue moving forward.

Eventually, the carrier body 530 positions the chamber carrier 504 and the chamber member 506 fully into the firing position within the chamber cavity 520 of the barrel extension 502. The carrier body 530 then reaches end of its range of travel in the positive X-direction and the firing pin 550 fires the cartridge within the chamber (also see FIG. 112).

The firing cycle is now complete. A user operating the weapon 500 via the trigger may continue through another firing cycle in the same manner as described above.

Figure 117:
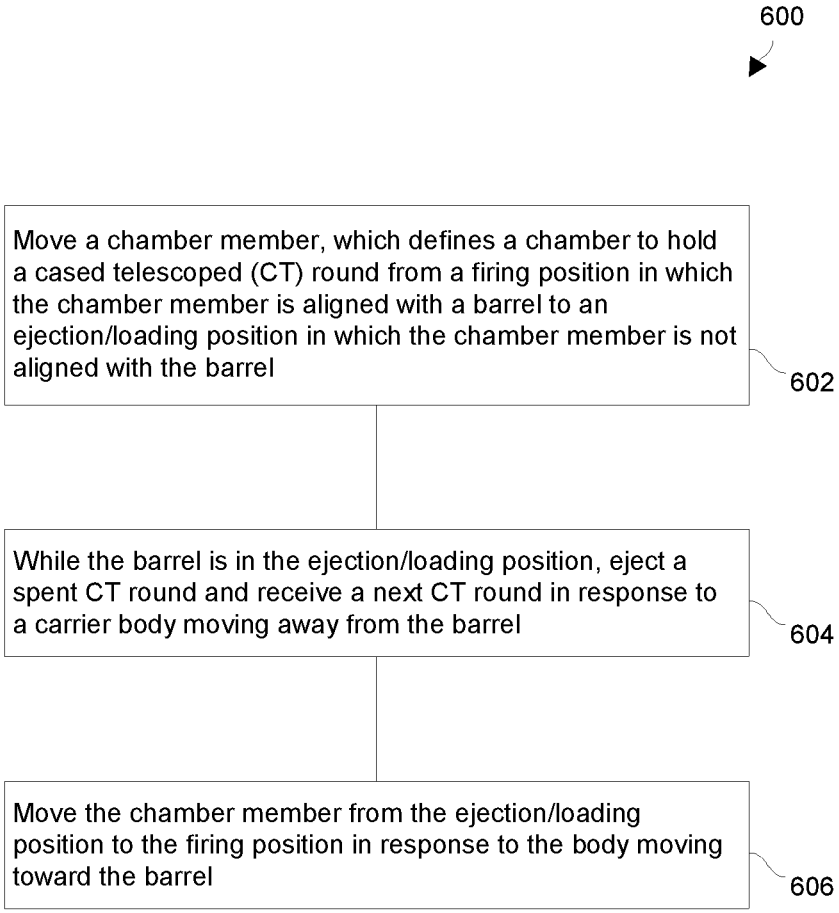
FIG. 117 is a flowchart of a procedure which is performed by a weapon for firing CT ammunition rounds in accordance with certain embodiments.

FIG. 117 provides certain operating details of a weapon for firing CT ammunition rounds in accordance with certain embodiments. In particular, FIG. 117 shows a flowchart of a procedure 600 which is performed by a set of components of the weapon.

At 602, the set of components moves a chamber member, which defines a chamber configured to hold a CT round for firing from the weapon, from a firing position in which the chamber member is aligned with a barrel of the weapon to an ejection/loading position of the weapon in which the chamber member is not aligned with the barrel. In some arrangements, such activity may be effectuated by linkage in response to actuation of a trigger of the weapon.

At 604, while the barrel is in the ejection/loading position, the set of components ejects a spent CT round and receives a next CT round in response to a carrier body of the weapon moving away from the barrel.

At 606, the set of components moves the chamber member from the ejection/loading position to the firing position in response to the carrier body moving toward the barrel. In some arrangements, the order of activities may vary such as 606 occurring before or contemporaneously with 604.

It should be understood that the procedure 600 may be performed repetitively. For example, the procedure 600 may be repeated for each CT round within a magazine mounted to the weapon (e.g., see FIG. 112).

The various individual features of the particular arrangements, configurations, and embodiments disclosed herein can be combined in any desired manner that makes technological sense. Additionally, such features are hereby combined in this manner to form all possible combinations, variants and permutations except to the extent that such combinations, variants and/or permutations have been expressly excluded or are impractical. Support for such combinations, variants and permutations is considered to exist in this document.

As described herein and in accordance with certain embodiments, certain firearms involve cased telescoped weapon action feeding from a magazine. Along these lines, such a weapon action fires, feeds, and ejects cased telescoped ammunition. The weapon may be sized for a high velocity, high pressure cartridge, utilizing a vertically cammed action to actuate the cartridge. Previously, there have been weapon actions for the cased telescoped ammunition, but the weapons described herein may be sized to support the higher-pressure and velocity cartridge, in addition to the increased reliability from the vertically, fully cammed weapon action.

In accordance with certain embodiments, the weapon utilizes a chamber split from the barrel, like previous cased telescoped systems. It was sized around the 6.8 mm NGSW cartridge, which utilizes higher chamber pressure to achieve greater than normal projectile velocities for its weight. An advantageous design was based upon another 6.5 mm weapon action, which utilized a cam to drive the chamber down, but then sprung the chamber up. This advantageous design utilizes a fully cam driven system, greatly improving its reliability. The action utilizes a carrier with a disconnecting rammer to feed cartridge from a magazine and cams the chamber vertically. It is powered by a short stroke gas piston system and utilizes a drive spring to return the carrier into battery. A hammer strikes the firing pin, which ignites the cartridge. An ejector, used on previous cased telescoped weapon systems, prevents cartridges from over traveling during ramming and ejects the cartridge from the system. A suppressor reduces the pressure and contains some of the flame exiting the muzzle.

In accordance with certain embodiments, a cam system lowers and raises the chamber. Such embodiments are well suited for a magazine fed weapon system, as well as a closed bolt configuration.

What is claimed is:

1. A weapon for firing cased telescoped (CT) ammunition rounds, the weapon comprising:

a barrel;

a chamber member that defines a chamber configured to hold a CT round for firing from the weapon;

a carrier body; and linkage that moves the chamber member (i) from a firing position in which the chamber member is aligned with the barrel for firing the CT round to an ejection/loading position in which the chamber member is not aligned with the barrel for ejecting a spent CT round and receiving a next CT round in response to the carrier body moving away from the barrel, and (ii) from the ejection/loading position to the firing position in response to the carrier body moving toward the barrel, wherein the linkage includes:

a linkage feature that pushes the chamber member from the firing position into the ejection/loading position in response to movement of the carrier body moving in a recoil direction away from the barrel and pushes the chamber member from the ejection/loading position into the firing position in response to movement of the carrier body moving in a counter recoil direction toward the barrel, the recoil direction being opposite the counter recoil direction along a carrier body travel axis, and a chamber carrier having grooves that are in constant mechanical communication with the linkage feature, the chamber member being retained by the chamber carrier and moving along a vertical axis that is perpendicular to the carrier body travel axis.

2. A weapon as in claim 1 wherein the carrier body is in constant mechanical communication with the linkage feature to enable the carrier body to provide full mechanical control over positioning the chamber member between the firing position and the ejection/loading position via the linkage body and the chamber carrier.

3. A weapon as in claim 2 wherein the carrier body is constructed and arranged to impart counter-recoil force on the linkage feature when the carrier body moves in the counter-recoil direction; and wherein the linkage feature is constructed and arranged to translate the counter-recoil force into an upward force on the chamber carrier to raise the chamber member from the ejection/loading position into the firing position.

4. A weapon as in claim 3 wherein the linkage feature mates with the chamber carrier and the carrier body to enable each of the carrier body, the linkage feature and the chamber carrier to move together.

5. A weapon as in claim 2, further comprising:

a lower receiver that houses the linkage, the lower receiver having a magazine well that is constructed and arranged to interface with a magazine that vertically stores CT rounds and feeds the CT rounds into the lower receiver through the magazine well.

6. A weapon as in claim 5, further comprising:

an upper receiver that houses the carrier body, the upper receiver coupling with a top of the lower receiver, and the magazine well residing at a bottom of the lower receiver.

7. A weapon as in claim 5, further comprising:

an upper receiver that houses the carrier body, the upper receiver preventing the carrier body from rotating within the weapon.

8. A weapon as in claim 5, further comprising:

a disconnecting rammer coupled with the carrier body, the disconnecting rammer being constructed and arranged to push the next CT round fed from the magazine into the chamber member and disconnect from the carrier body while the carrier body moves in the counter-recoil direction.

9. A weapon as in claim 5, further comprising:

a trigger group coupled with the lower receiver, the trigger group being constructed and arranged to initiate closed bolt firing action.

10. A weapon as in claim 1 wherein the carrier body is non-rotating when moving within the weapon along the carrier body travel axis during firing of the weapon.

11. A weapon as in claim 1 wherein the carrier body is non-rotating when moving along the carrier body travel axis during firing of the weapon, relative to the barrel, the chamber member, and the linkage.

12. A method of operating a weapon for firing cased telescoped (CT) ammunition rounds, the method comprising:

moving a chamber member, which defines a chamber configured to hold a CT round for firing from the weapon, from a firing position in which the chamber member is aligned with a barrel of the weapon to an ejection/loading position of the weapon in which the chamber member is not aligned with the barrel, at least in part by a linkage feature pushing the chamber member from the firing position into the ejection/loading position in response to movement of a carrier body moving in a recoil direction away from the barrel;

while the chamber is in the ejection/loading position, ejecting a spent CT round and receiving a next CT round in response to a non-rotating carrier body of the weapon moving away from the barrel along a carrier body travel axis during firing of the weapon;

moving the chamber member from the ejection/loading position to the firing position in response to the non-rotating carrier body moving toward the barrel, at least in part by the linkage feature pushing the chamber member from the ejection/loading position into the firing position in response to movement of the carrier body moving in a counter recoil direction toward the barrel, the recoil direction being opposite the counter recoil direction along the carrier body travel axis; and wherein grooves of a chamber carrier are maintained in constant mechanical communication with the linkage feature, the chamber member being retained by the chamber carrier and moving along a vertical axis that is perpendicular to the carrier body travel axis.

13. A method of operating a weapon for firing cased telescoped (CT) ammunition rounds, the method comprising:

moving a chamber member, which defines a chamber configured to hold a CT round for firing from the weapon, from a firing position in which the chamber member is aligned with a barrel of the weapon to an ejection/loading position of the weapon in which the chamber member is not aligned with the barrel, at least in part by a linkage feature pushing the chamber member from the firing position into the ejection/loading position in response to movement of a carrier body moving in a recoil direction away from the barrel;

after the chamber reaches the ejection/loading position, moving the chamber member from the ejection/loading position to the firing position in response to a non-rotating carrier body moving toward the barrel along a carrier body travel axis during firing of the weapon, ejecting a spent CT round, and receiving a next CT round in response to the non-rotating carrier body of the weapon moving away from the barrel, at least in part by the linkage feature pushing the chamber member from the ejection/loading position into the firing position in response to movement of the carrier body moving in a counter recoil direction toward the barrel, the recoil direction being opposite the counter recoil direction along the carrier body travel axis; and wherein grooves of a chamber carrier are maintained in constant mechanical communication with the linkage feature, the chamber member being retained by the chamber carrier and moving along a vertical axis that is perpendicular to the carrier body travel axis.

* * * * *